US006208817B1

(12) United States Patent
Chadani et al.

(10) Patent No.: US 6,208,817 B1
(45) Date of Patent: Mar. 27, 2001

(54) DEVELOPING APPARATUS AND METHOD FOR ASSEMBLING THE SAME

(75) Inventors: Kazuo Chadani, Shizuoka-ken; Hiroomi Matsuzaki, Mishima; Akira Suzuki, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,991

(22) Filed: Oct. 25, 1999

(30) Foreign Application Priority Data

Oct. 26, 1998 (JP) ..... 10-321293
Nov. 20, 1998 (JP) ..... 10-347796

(51) Int. Cl.[7] ..... G03G 15/00; G03G 15/08

(52) U.S. Cl. ..... 399/104; 399/90; 399/111; 430/120

(58) Field of Search ..... 399/104, 103, 399/90, 111, 119, 120, 274, 284, 285; 430/120

(56) References Cited

U.S. PATENT DOCUMENTS 6,038,414 * 3/2000 Inami et al. ..... 399/104
6,044,237 * 3/2000 Numagami et al. ..... 399/104

FOREIGN PATENT DOCUMENTS 5-040402 * 2/1993 (JP) .
9-274391 * 10/1997 (JP) .

* cited by examiner

*Primary Examiner*—Sophia S. Chen
(74) *Attorney, Agent, or Firm*—Fitzpatrick, Cella, Harper & Scinto

(57) ABSTRACT

The present invention relates to a developing apparatus which has a developer bearing member for bearing and conveying developer to a developing position, a developer regulating member for regulating a thickness of the developer born on the developer bearing member, and voltage being applied to the developer regulating member, a magnetic seal member opposed to an end in a longitudinal direction of the developer bearing member, and an elastic member for urging the magnetic seal member against the developer regulating member to establish electrical communication between the developer regulating member and the magnetic seal member.

26 Claims, 58 Drawing Sheets

DEVELOPING APPARATUS AND METHOD FOR ASSEMBLING THE SAME

BACKGROUND OF THE INVENTION

1. Field of the Invention

The present invention relates to a developing apparatus for developing an electrostatic latent image formed on an image bearing member, and a method for assembling such a developing apparatus.

2. Related Background Art

Conventionally, in electrophotographic image forming apparatuses using an electrophotographic process, there has been used a process cartridge which integrally incorporates an electrophotographic photosensitive drum (image bearing member) and process means acting on the electrophotographic photosensitive drum and which is detachably attachable to a main body of an electrophotographic image forming apparatus. By adopting such a process cartridge, since an operator himself can perform maintenance of the apparatus without any expertise, operability can be improved considerably. For this reason, the process cartridge has widely been used in the electrophotographic image forming apparatus.

Regarding a developing apparatus incorporated into such a process cartridge, magnetic seal members such as magnetic seals are provided on both ends of a rotating developer bearing member with a predetermined gap with respect to the image bearing member, thereby preventing leakage of toner (developer).

The magnetic seal members which are not grounded are charged by voltage applied to a developing roller or a developing blade or friction between the developing roller and toner existing between the magnetic seal members, with the result that charges are accumulated in the magnetic seal members. If the magnetic seal members are instantaneously caused approach to the developing blade due to difference in tolerance of parts or any shock, leak will be generated between the developing roller and the magnetic seal members, thereby generating noise. Further, if there is an electrically unstable condition that a developer regulating member is electrically contacted with and separated from the magnetic seals periodically, leakage may be generated between the developer regulating member and the magnetic seals.

SUMMARY OF THE INVENTION

An object of the present invention is to provide a developing apparatus which prevents occurrence of an electrically unstable condition that a developer regulating member is electrically contacted with and separated from the magnetic seals periodically, thereby preventing leakage and noise due to such leakage, and a method for assembling such a developing apparatus.

Another object of the present invention is to provide a developing apparatus in which electrical connection between magnetic seals and a developer regulating member can surely be established, and a method for assembling such a developing apparatus.

DETAILED DESCRIPTION OF THE PREFERRED EMBODIMENTS

Now, a preferred embodiment of the present invention will be explained. In the following explanation, a "widthwise direction" of a process cartridge is referred to as a mounting and dismounting direction of a process cartridge B with respect to a main body 14 of an image forming apparatus, which is also a recording medium conveying direction. Further, a "longitudinal direction" of the process cartridge is referred to as a direction transverse (substantially perpendicular) to the mounting and dismounting direction of the process cartridge B with respect to the main body 14 of the image forming apparatus, which is also a direction transverse (substantially perpendicular) to the recording medium conveying direction.

Figure 1:
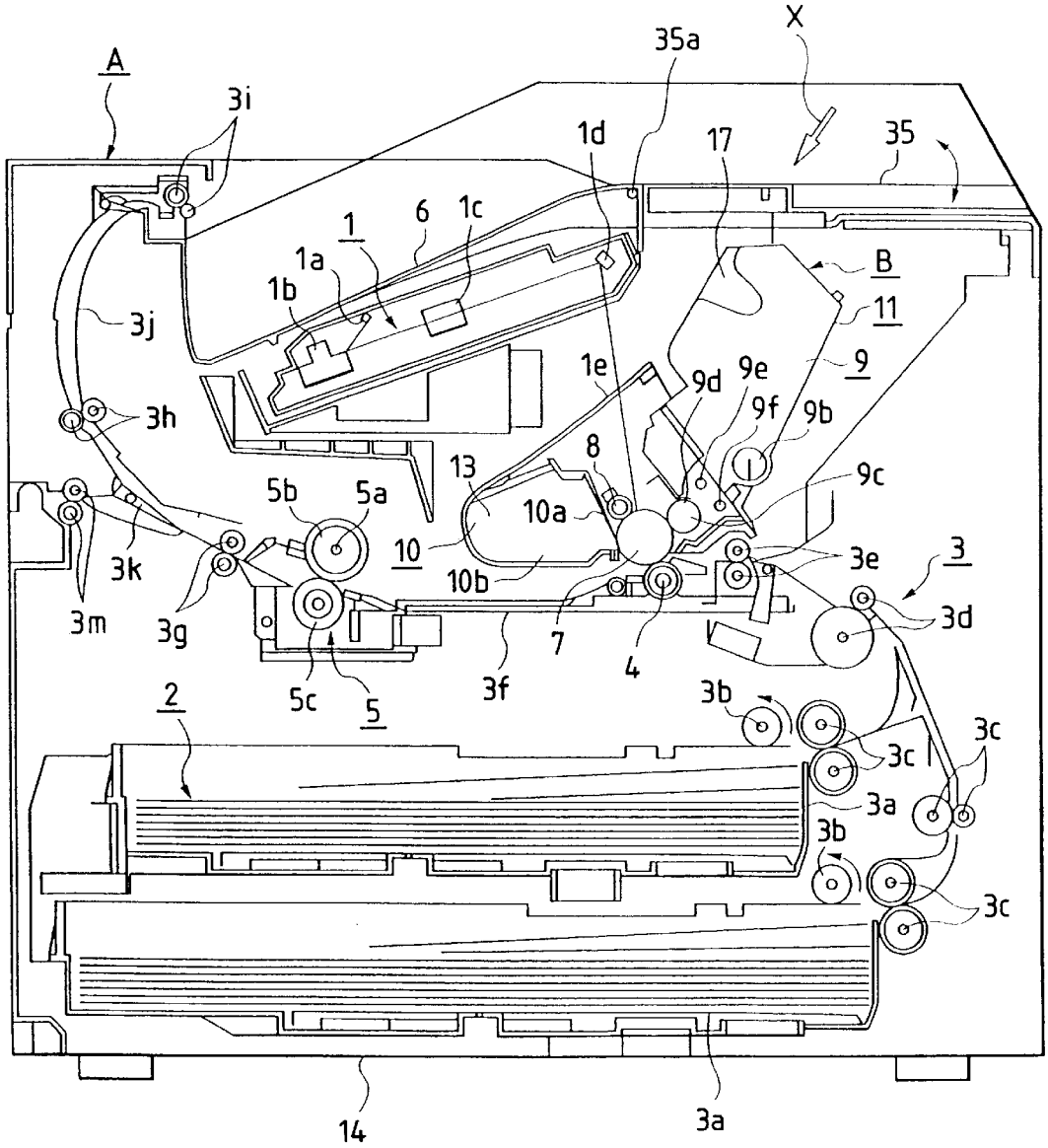
FIG. 1 is a side sectional view of an electrophotographic image forming apparatus to which an embodiment of the present invention is applied.
Figure 2:
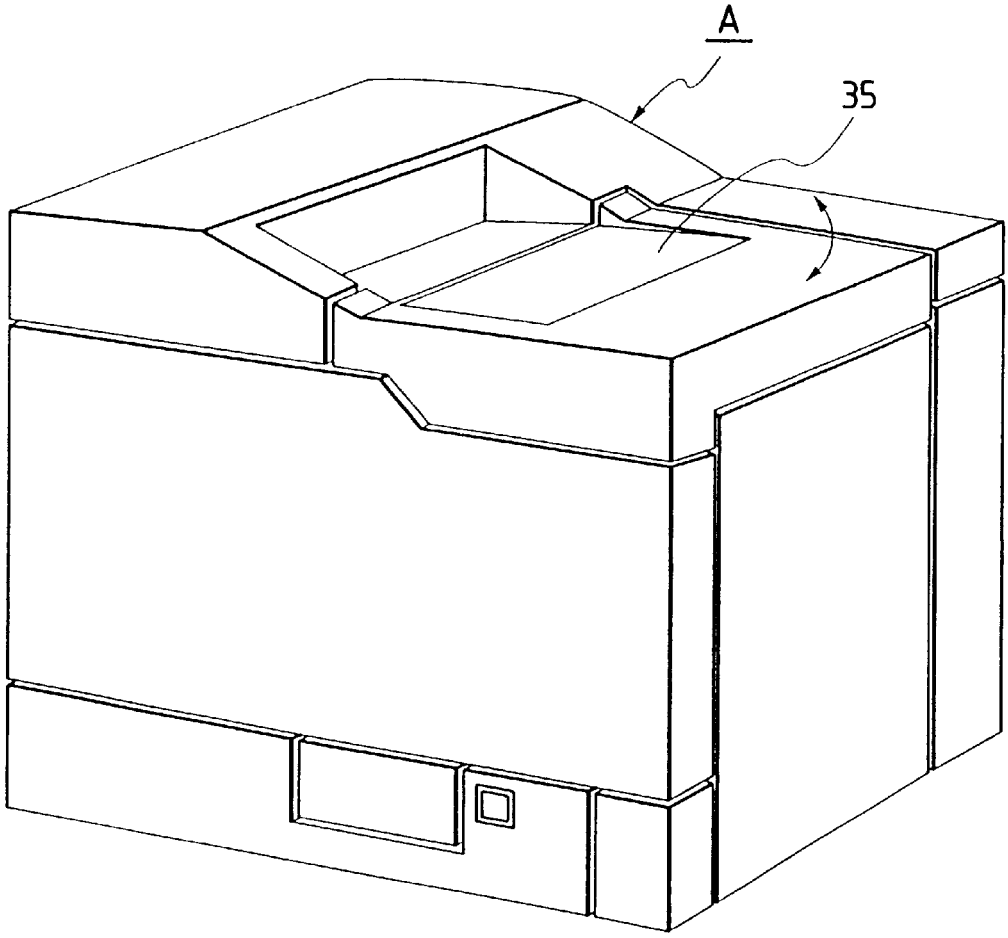
FIG. 2 is a perspective view of the apparatus of FIG. 1.
Figure 3:
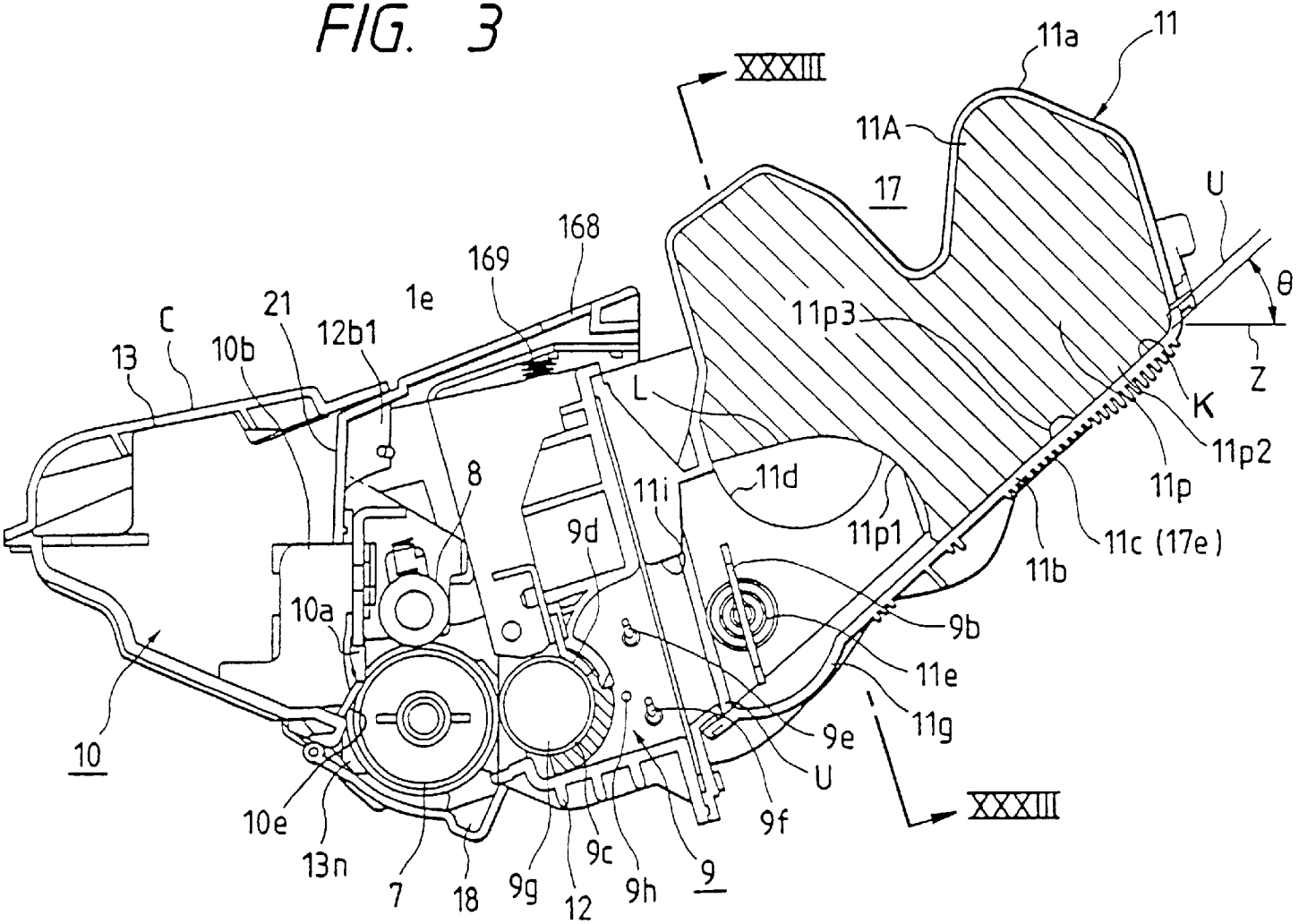
FIG. 3 is a side sectional view of a process cartridge to which an embodiment of the present invention is applied.
Figure 4:
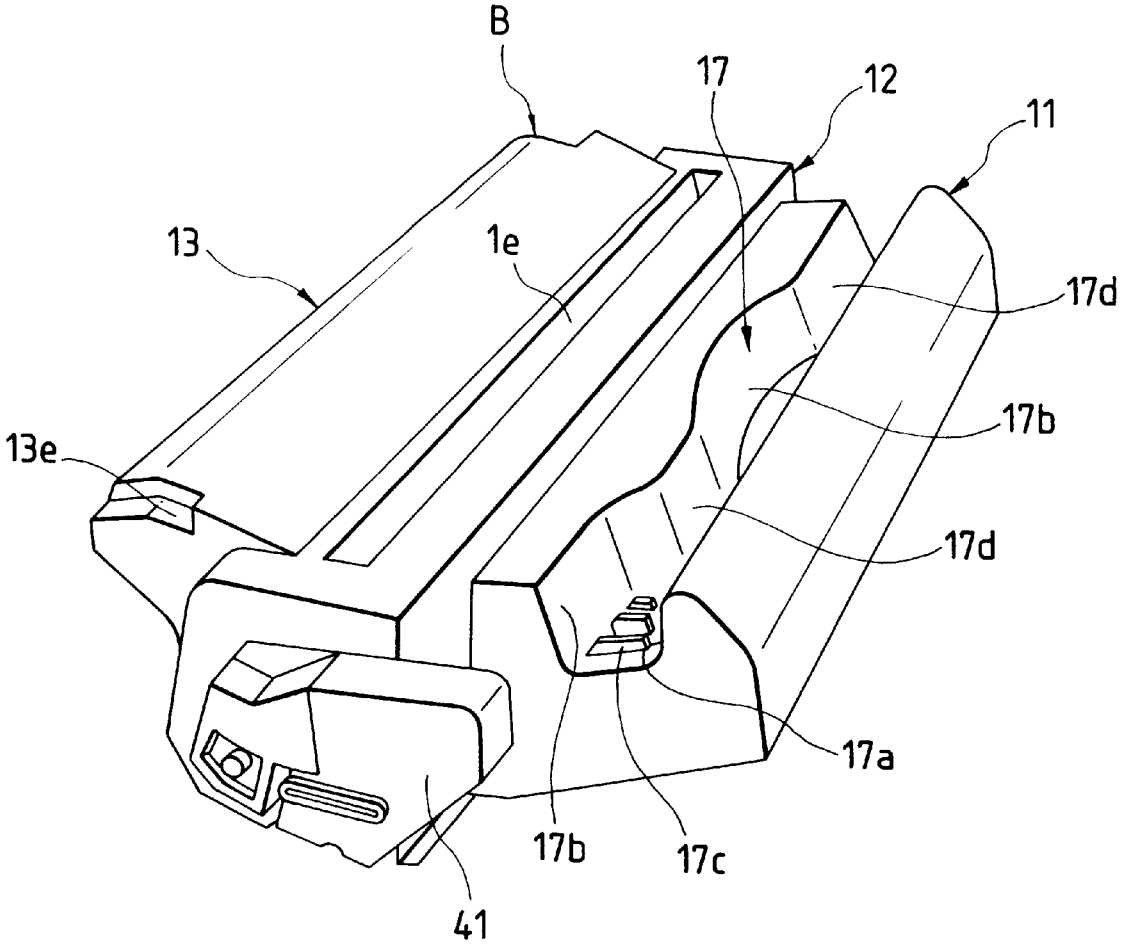
FIG. 4 is a schematic perspective view of the process cartridge of FIG. 3.
Figure 5:
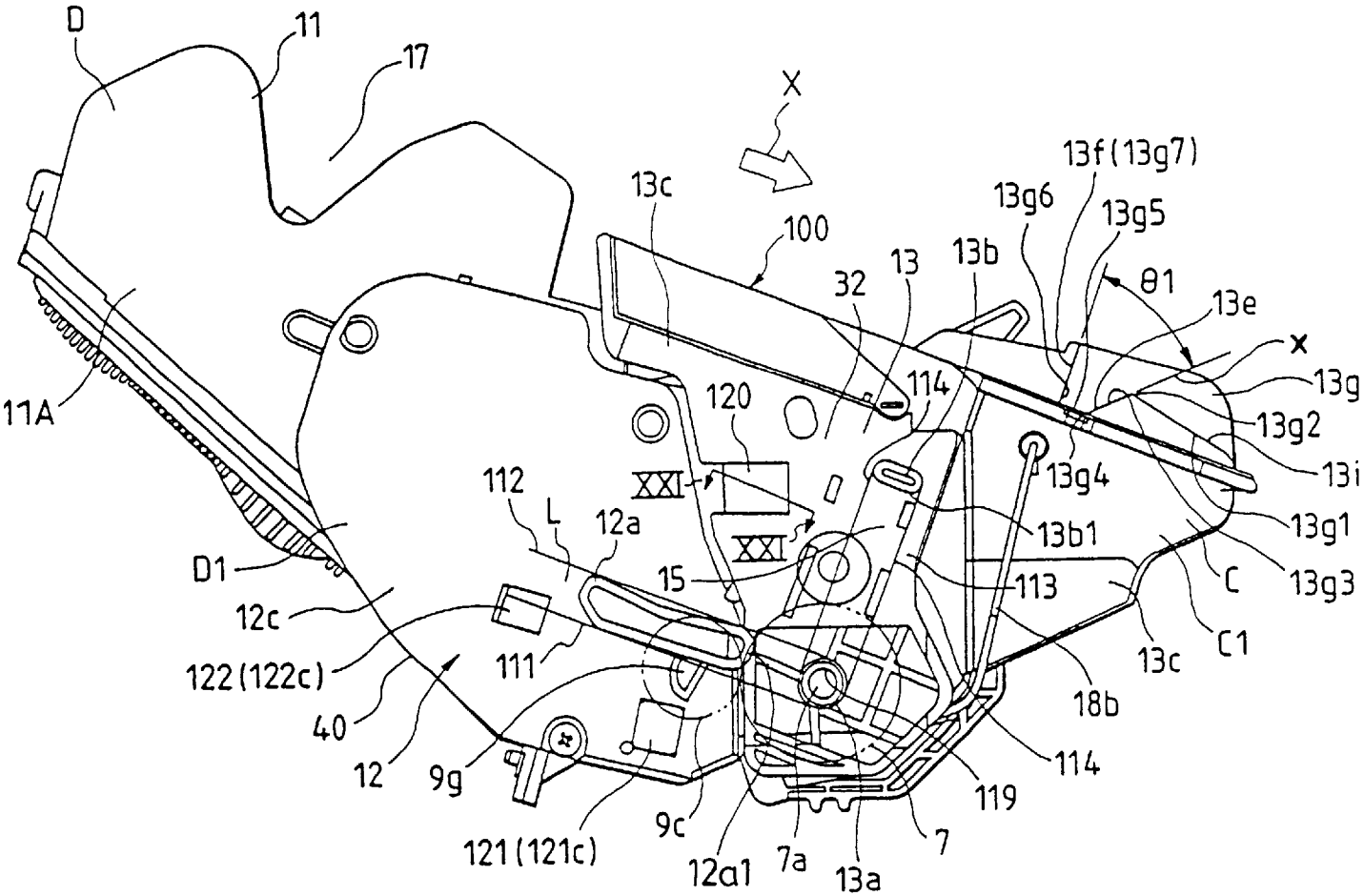
FIG. 5 is a right side view of the process cartridge of FIG. 3.
Figure 6:
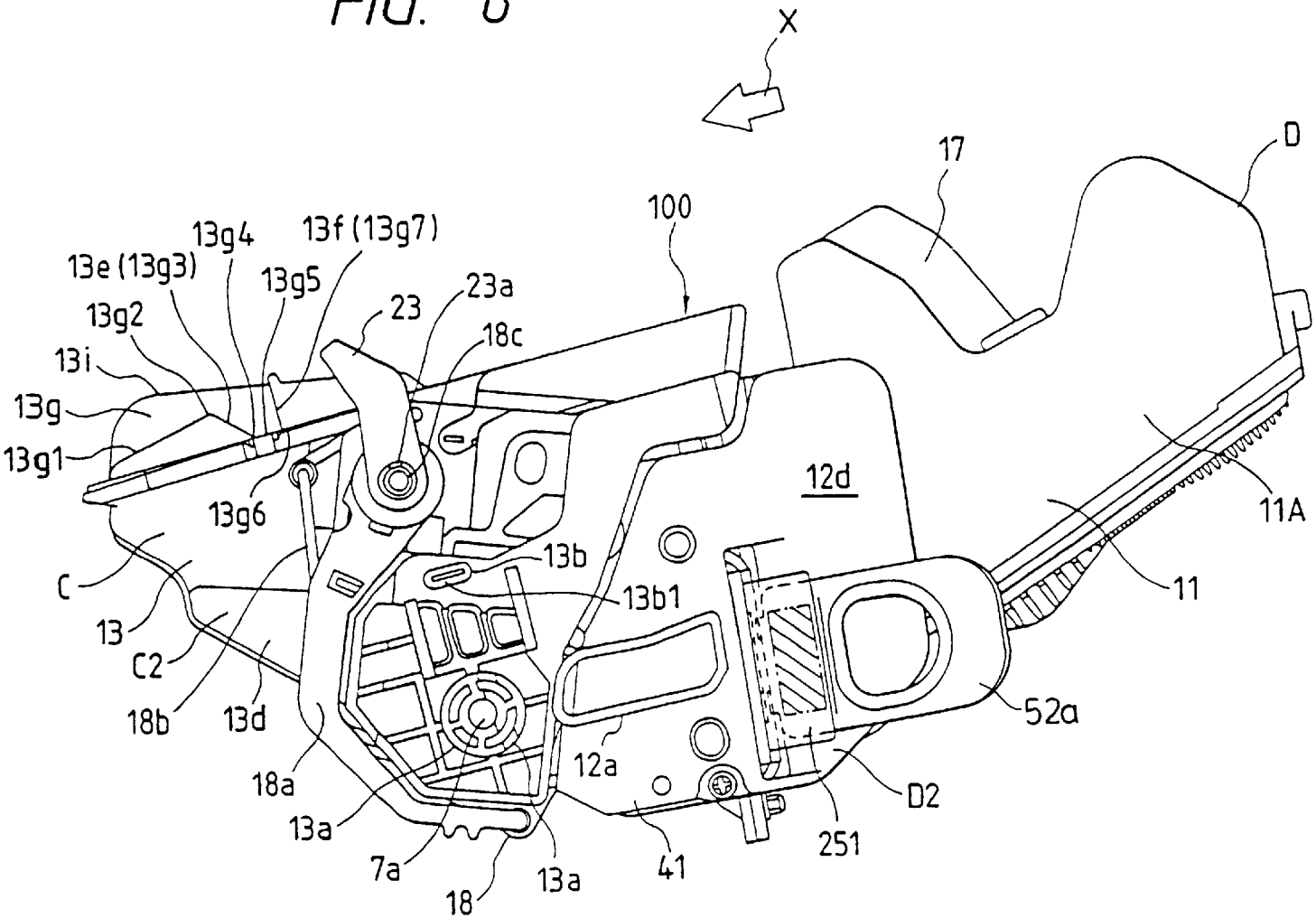
FIG. 6 is a left side view of the process cartridge of FIG. 3.
Figure 7:
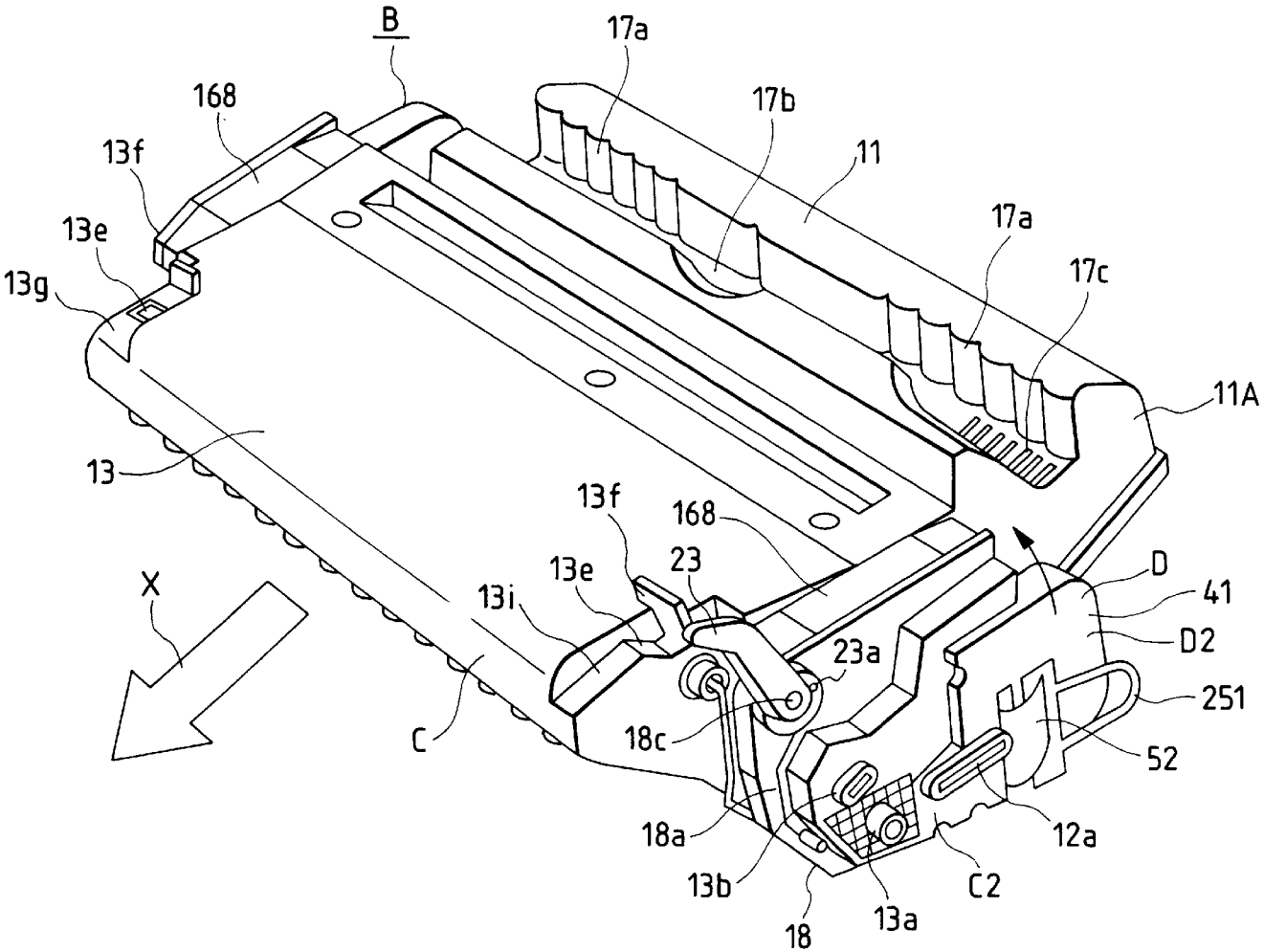
FIG. 7 is a perspective view of the process cartridge of FIG. 3.
Figure 8:
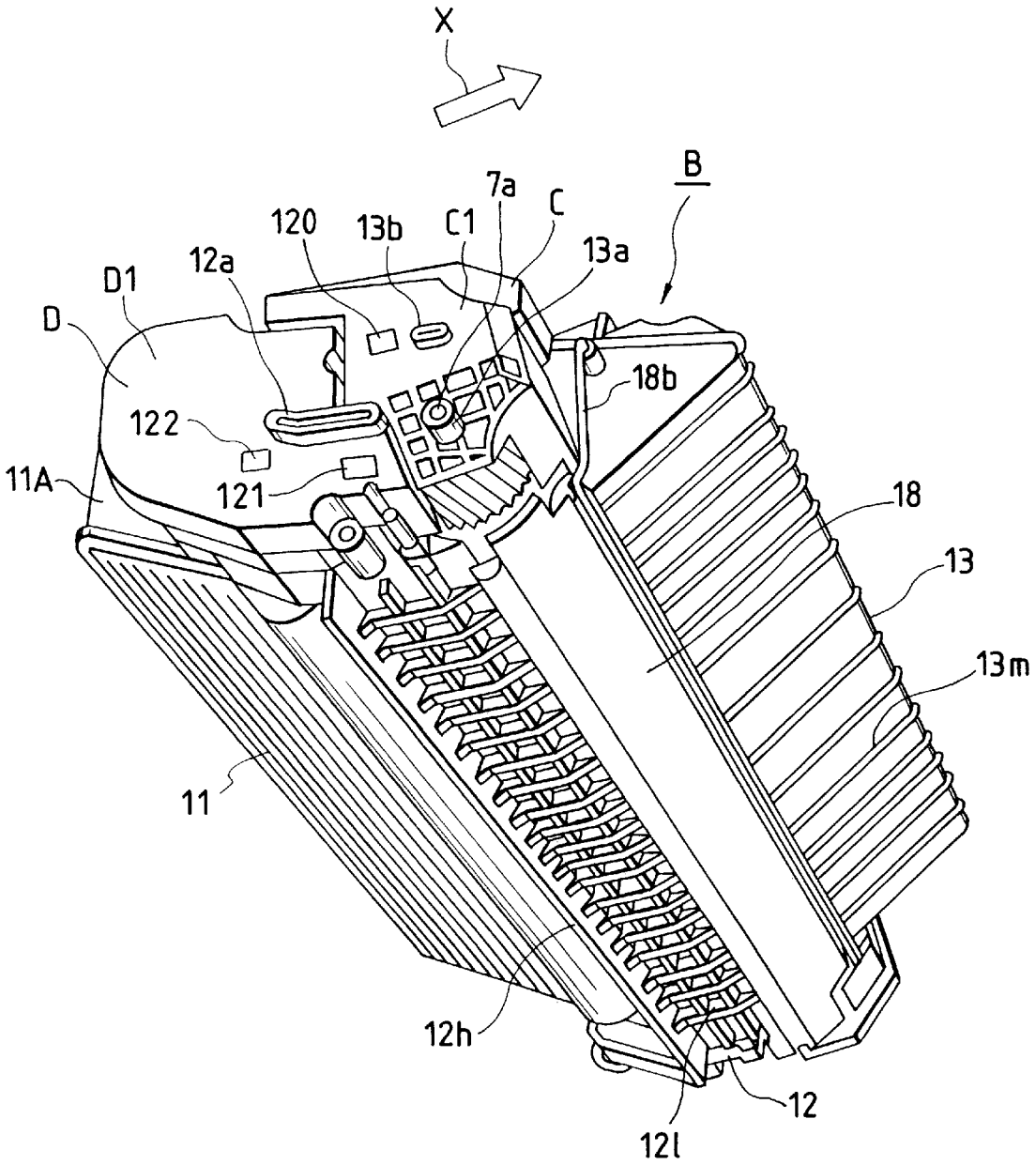
FIG. 8 is a perspective view of the process cartridge of FIG. 3, looked at from below.

FIG. 1 is an explanatory view showing a construction of an electrophotographic image forming apparatus (laser beam printer) to which an embodiment of the present invention is applied, and FIG. 2 is a perspective view of the image forming apparatus. FIGS. 3 to 8 show a process cartridge to which an embodiment of the present invention is applied. FIG. 3 is a side sectional view of the process cartridge, FIG. 4 is a schematic perspective view of the process cartridge, FIG. 5 is a right side view of the process cartridge, FIG. 6 is a left side view of the process cartridge, FIG. 7 is a perspective view of the process cartridge, looked at from above (upper surface), and FIG. 8 is a perspective view of the process cartridge, looked at from below (lower surface). Further, in the following explanation, the "upper surface" of the process cartridge is referred to as a surface located at an upper side in a condition that the process cartridge B was mounted to the main body 14 of the image forming apparatus, and the "lower surface" is referred to as a surface located at a lower side in such a condition.

(Electrophotographic image forming apparatus A and Process cartridge B)

First of all, a laser beam printer A as an electrophotographic image forming apparatus to which an embodiment of the present invention is applied will be explained with reference to FIGS. 1 and 2. FIG. 3 is a side sectional view of the process cartridge B.

As shown in FIG. 1, the laser beam printer A serves to form an image on a recording medium (for example, recording sheet, OHP sheet, cloth or the like) by using an electrophotographic image forming process. A toner image is formed on a drum-shaped electrophotographic photosensitive member (referred to as "photosensitive drum" hereinafter). More specifically, the photosensitive drum is charged by a charge means, and then, a latent image corresponding to image information is formed on the photosensitive drum by illuminating a laser beam corresponding to the image information from an optical means onto the photosensitive drum. The latent image is developed by a developing means to form a toner image. In synchronousism with the toner image formation, a recording medium 2 is conveyed from a cassette 3*a* by means of a pick-up roller 3*b*, pairs of convey rollers 3*c*, 3*d* and a pair of registration rollers 3*e* while reversing a front surface and a rear surface of the recording medium. Then, the toner image formed on the photosensitive drum of the process cartridge B is transferred onto the recording medium 2 by applying voltage to a transfer roller (transfer means) 4. Thereafter, the recording medium 2 to which the toner image was transferred is conveyed to a fixing means 5 via a convey guide 3*f*. The fixing means 5 includes a driving roller 5*c*, and a fixing roller 5*b* having a heater 5*a* therein. By applying heat and pressure to the recording medium 2 passed through the fixing means, the transferred toner image is fixed to the recording medium. Then, the recording medium 2 is conveyed by pairs of discharge rollers 3*g*, 3*h*, 3*i* and is discharged onto a discharge tray 6 through a reversing path 3*j*. The discharge tray 6 is provided on an upper surface of the main body 14 of the image forming apparatus A. Incidentally, by operating a rockable flapper 3*k*, the recording medium 2 can be discharged by a pair of discharge rollers 3*m* without passing through the reversing path 3*j*. In the illustrated embodiment, the pick-up roller 3*b*, pairs of convey rollers 3*c*, 3*d*, pair of registration rollers 3*e*, convey guide 3*f*, pairs of discharge rollers 3*g*, 3*h*, 3*i* and pair of discharge rollers 3*m* constitute a conveying means 3.

On the other hand, as shown in FIGS. 3 to 8, in the process cartridge B, the photosensitive drum 7 having a photosensitive layer 7*e* (FIG. 20) is rotated, and a surface of the drum is uniformly charged by applying voltage to a charge roller (charge means) 8. Then, by illuminating the laser beam corresponding to the image information from an optical system 1 onto the photosensitive drum 7 through an exposure opening portion le, the latent image is formed. The latent image is developed by a developing means 9. That is to say, the charge roller 8 is contacted with the photosensitive drum 7 and serves to charge the photosensitive drum 7. The charge roller 8 is rotatingly driven by rotation of the photosensitive drum 7. The developing means 9 serves to develop the latent image formed on the photosensitive drum 7 by supplying toner to a developing area on the photosensitive drum 7. The optical system 1 includes a laser diode 1*a*, a polygon mirror 1*b*, a lens 1*c* and a reflection mirror 1*d*.

In the developing means 9, toner in a toner container 11A is fed out to a developing roller 9*c* by rotation of a toner feed member 9*b*. While the developing roller 9*c* including a fixed magnet therein is being rotated, a toner layer is formed on the surface of the developing roller 9*c* by a developing blade 9*d* while applying frictional charges (triboelectricity) to the toner, and the toner (layer) is supplied to the developing area on the photosensitive drum 7. By transferring the toner onto the latent image on the photosensitive drum 7, the toner image (visualized image) is formed. The developing blade 9*d* serves to regulate an amount of toner on the peripheral surface of the developing roller 9*c*. In the vicinity of the developing roller 9*c*, a toner agitating members 9*e*, 9*f* for circulating the toner within a developing chamber are rotatably supported.

After the toner image formed on the photosensitive drum 7 is transferred onto the recording medium 2 by applying voltage having polarity opposite to that of the toner image to the transfer roller 4, residual toner remaining on the photosensitive drum 7 is removed by a cleaning means 10. In the cleaning means 10, the toner remaining on the photosensitive drum 7 is scraped by an elastic cleaning blade 10*a* urged against the photosensitive drum 7, and the scraped toner is collected into a waste toner reservoir 10*b*.

Incidentally, the process cartridge B is obtained by joining a toner frame body 11 having a toner container (toner containing portion) 11A for containing the toner to a developing frame body 12 for holding the developing means 9 such as a developing roller 9*c* to form an assembly and by joining a cleaning frame body 13 to the photosensitive drum 7, the cleaning means 10 such as the cleaning blade 10*a* and the charge roller 8 are attached to the assembly. The process cartridge B is detachably attachable to the main body 14 of the apparatus by the operator.

The exposure opening portion le through which the light corresponding to the image information is illuminated onto the photosensitive drum 7 and a transfer opening portion 13*n* through which the recording medium 2 is opposed to the photosensitive drum 7 are formed in the process cartridge B. More specifically, the exposure opening portion le is formed in the cleaning frame body 13, and the transfer opening portion 13*n* is defined between the developing frame body 12 and the cleaning frame body 13.

Next, a construction of the housing of the process cartridge B according to the illustrated embodiment will be explained.

In the process cartridge B according to the illustrated embodiment, the photosensitive drum 7, charge roller 8, developing means 9 and cleaning means 10 are housed in the housing obtained by joining the toner frame body 11 to the developing frame to form the assembly and by further rotatably joining the cleaning frame to the assembly. The process cartridge B is detachably mounted to a cartridge mounting means provided in the main body 14 of the apparatus.

(Construction of housing of process cartridge B)

As mentioned above, in the process cartridge B according to the illustrated embodiment, the housing is constituted by joining the toner frame body 11, developing frame body 12 and cleaning frame body 13. Now, the construction of the housing will be explained.

Figure 9A:
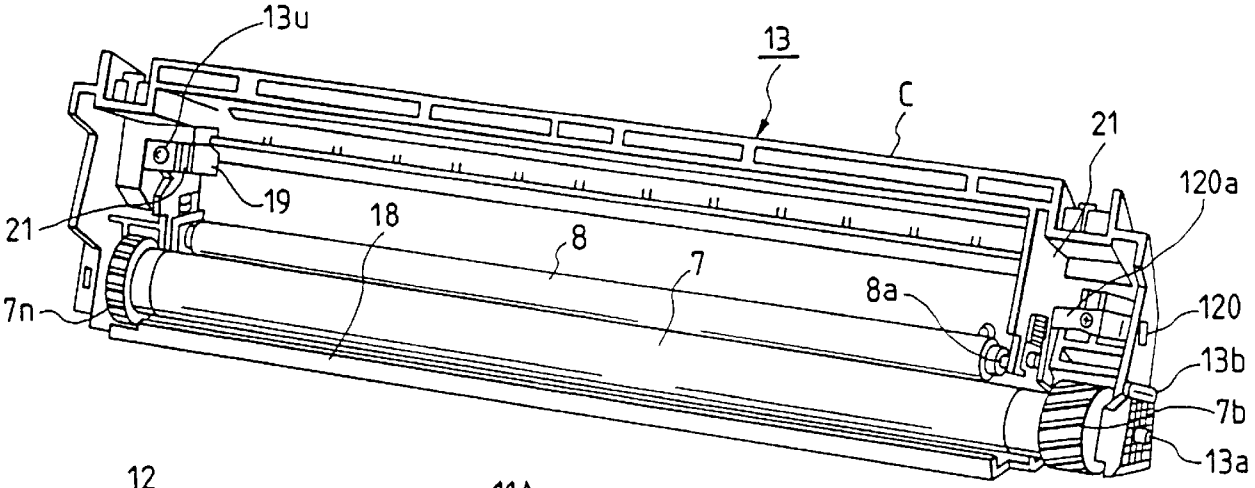
FIG. 9A is a perspective view of a cleaning unit of the process cartridge of FIG. 3.
Figure 9B:
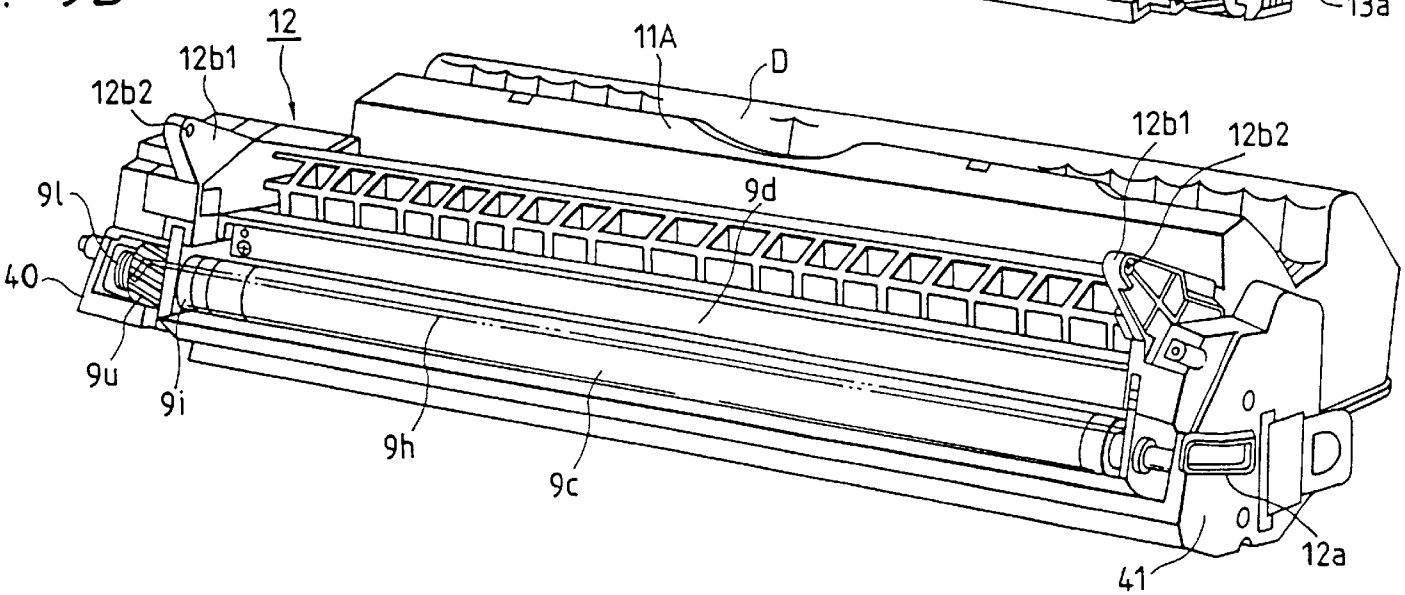
FIG. 9B is a perspective view of a developing unit of the process cartridge of FIG. 3.

As shown FIG. 3, a toner feed member 9*b* is rotatably attached to the toner frame body 11. Further, the developing roller 9*c* and the developing blade 9*d* are attached to the developing frame body 12, and the toner agitating members 9*e*, 9*f* for circulating the toner in the developing chamber are rotatably attached in the vicinity of the developing roller 9*c*. An antenna rod 9*h* is attached substantially in parallel with the developing roller 9*c* along the longitudinal direction of the developing roller 9*c*. The toner frame body 11 is welded (by ultrasonic welding in the illustrated embodiment) to the developing frame body 12 to form a unitary developing unit (second frame) D (FIG. 9B).

Further, the photosensitive drum 7, charge roller 8 and cleaning means 10 are attached to the cleaning frame body 13. A drum shutter member 18 for covering the photosensitive drum 7 to protect the drum from being exposed to the light for a long term and from being contacted with foreign matter when the process cartridge B is dismounted from the main body 14 of the apparatus is attached to form a cleaning unit (first frame) C (FIG. 9A).

(Construction of cleaning unit)

Figure 38:
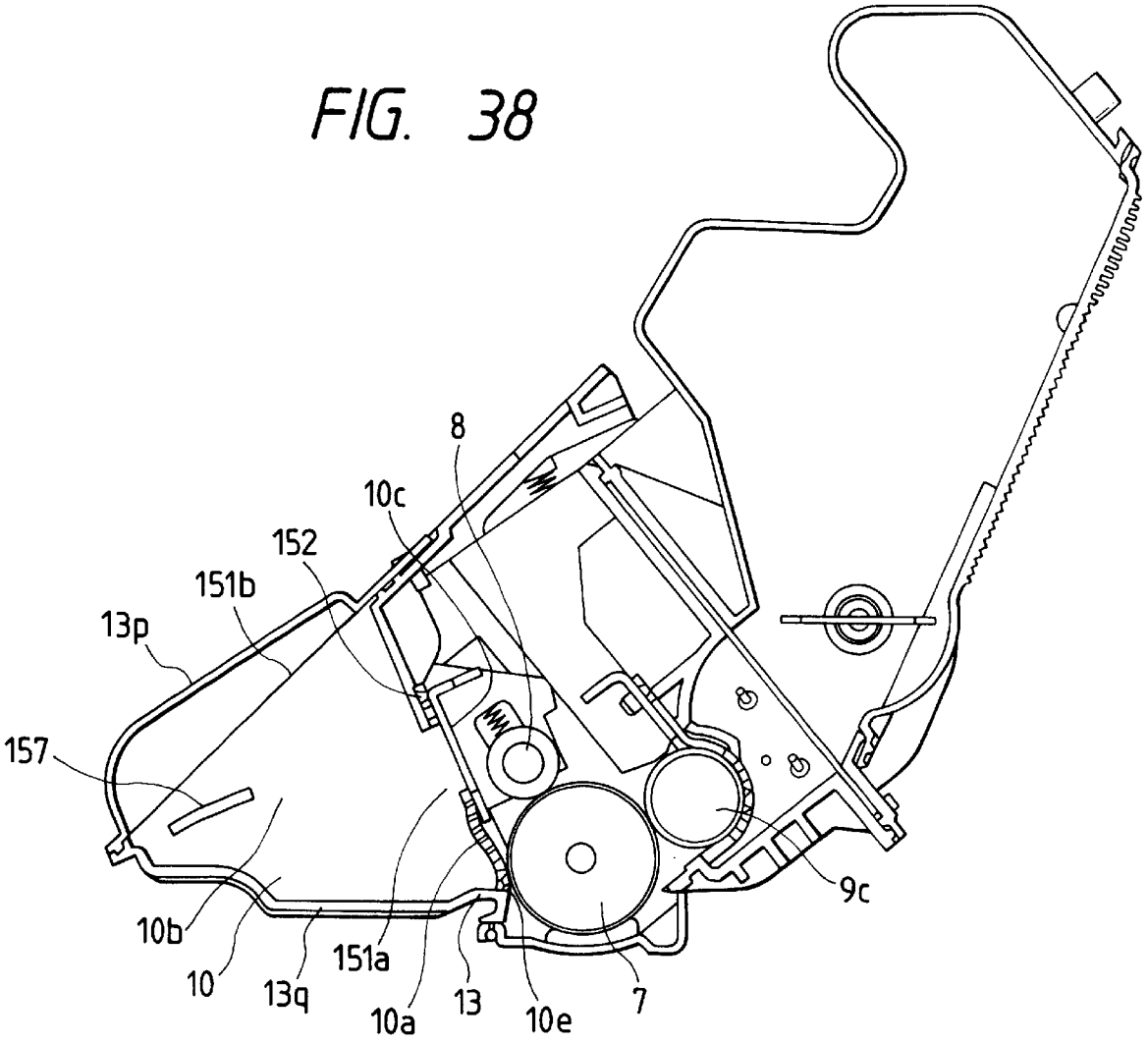
FIG. 38 is a side sectional view of a process cartridge to which an embodiment of the present invention is applied.

Now, the cleaning means 10 will be described with reference to FIG. 38. The frame 13 for the cleaning means 10 is constituted by a cleaning frame body 13*q* and a lid 13*p*, and the photosensitive drum 7, the cleaning blade 10*a*, a dip sheet 10*e* and the charge roller (charging means) 8 are integrally incorporated into the single cleaning frame body 13*q*. Further, the waste toner reservoir 10*b* is provided within the cleaning frame body 13*q*, and the waste toner reservoir 10*b* is covered by a cleaning blade metal plate 10*c*. A dimension of an opening portion 151*a* of the cleaning frame 13*q* covered by the cleaning blade metal plate 10*c* is made small so that such an opening portion can be covered by the cleaning blade metal plate 10*c* having a small width.

Figure 39:
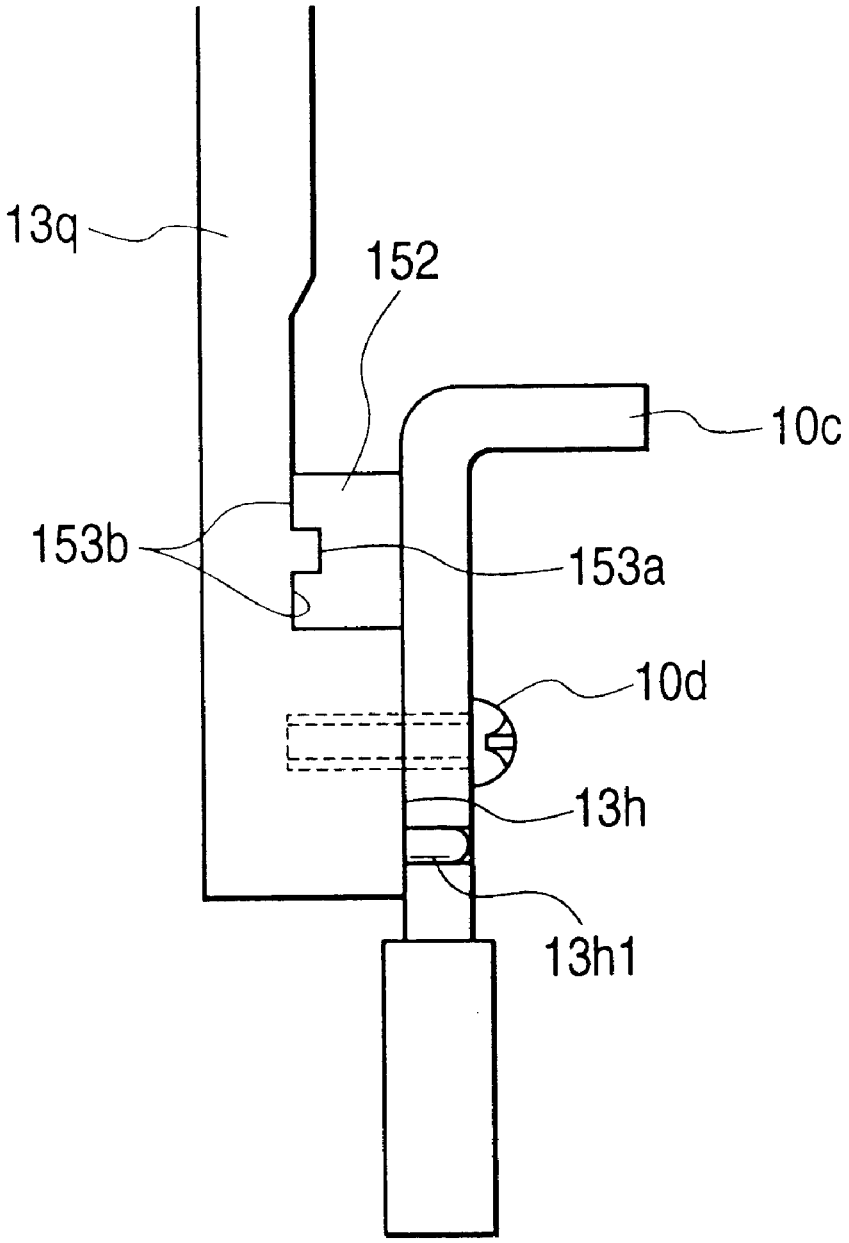
FIG. 39 is a longitudinal sectional view showing a seal arrangement between a cleaning blade and a cleaning frame.

Further, as shown in FIG. 39, a strip-shaped seal member 152 is provided on a toner seal between the cleaning blade metal plate 10*c* and the cleaning frame body 13*q*. The seal member 152 is adhered to a seal adhering rib 153*a* of the cleaning frame body 13*q*. Since the seal member 152 is also adhered to stepped surfaces 153*b* on both sides of the seal adhering rib 153*a*, good sealing ability can be achieved. The seal member 152 extends substantially along the entire longitudinal length of the cleaning blade metal plate 10*c*. Further, between the dip sheet 10*e* and both longitudinal ends of the cleaning blade metal plate 10*c*, spaces between the photosensitive drum 7 and the cleaning frame body 13*q* are sealed by sealing materials (not shown) in the widthwise direction, thereby sealing the waste toner reservoir 10*b*.

The cleaning blade metal plate 10*c* abuts against seat portions 13*h* of the cleaning frame body 13*q* provided in correspondence to both longitudinal ends thereof, so that, after the metal plate 10*c* is inserted, by threading small screws 10*d* into the seat portions 13*h*, both ends of the metal plate are secured to the cleaning frame body 13*q*. As a result, a distance between the metal plate 10*c* and the rib (longitudinal ridge) 153*a* is determined, and thus, a compression margin of the seal member having a rectangular cross-section and having a thickness greater than such a distance is determined. For example, the seal member 152 is made of foam urethane rubber. Incidentally, the seat members 13*h* are provided with a positioning joggle 13*h*1 by which the position of the cleaning blade metal plate 10*c* is determined.

(Construction of cleaning frame body)

Figure 40:
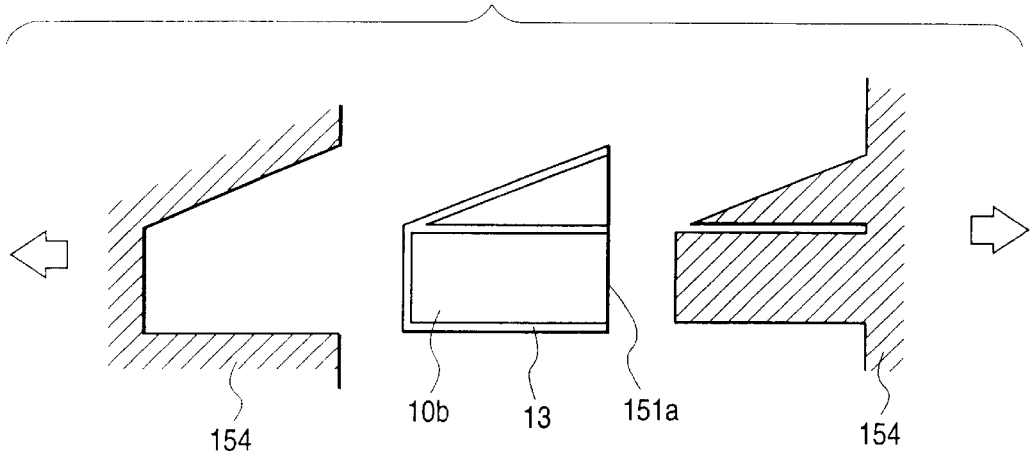
FIG. 40 is a view for explaining a mold for molding a conventional cleaning frame.
Figure 41:
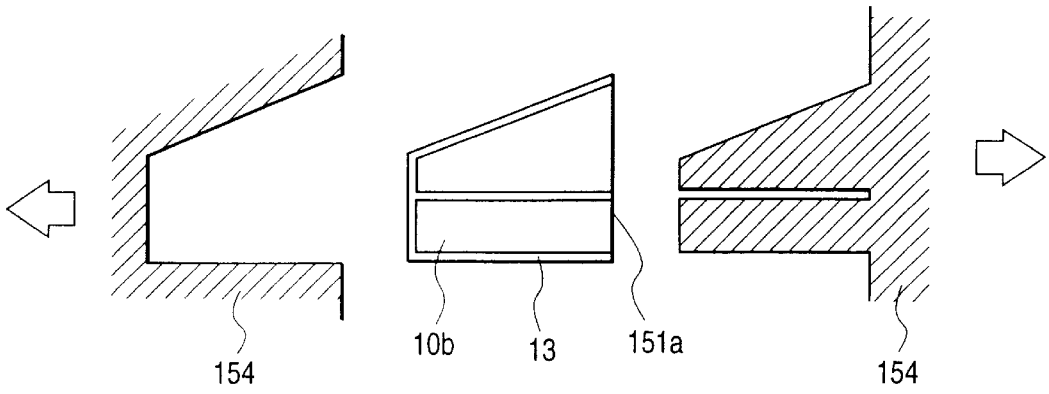
FIG. 41 is a view for explaining a mold for molding a conventional cleaning frame.
Figure 42:
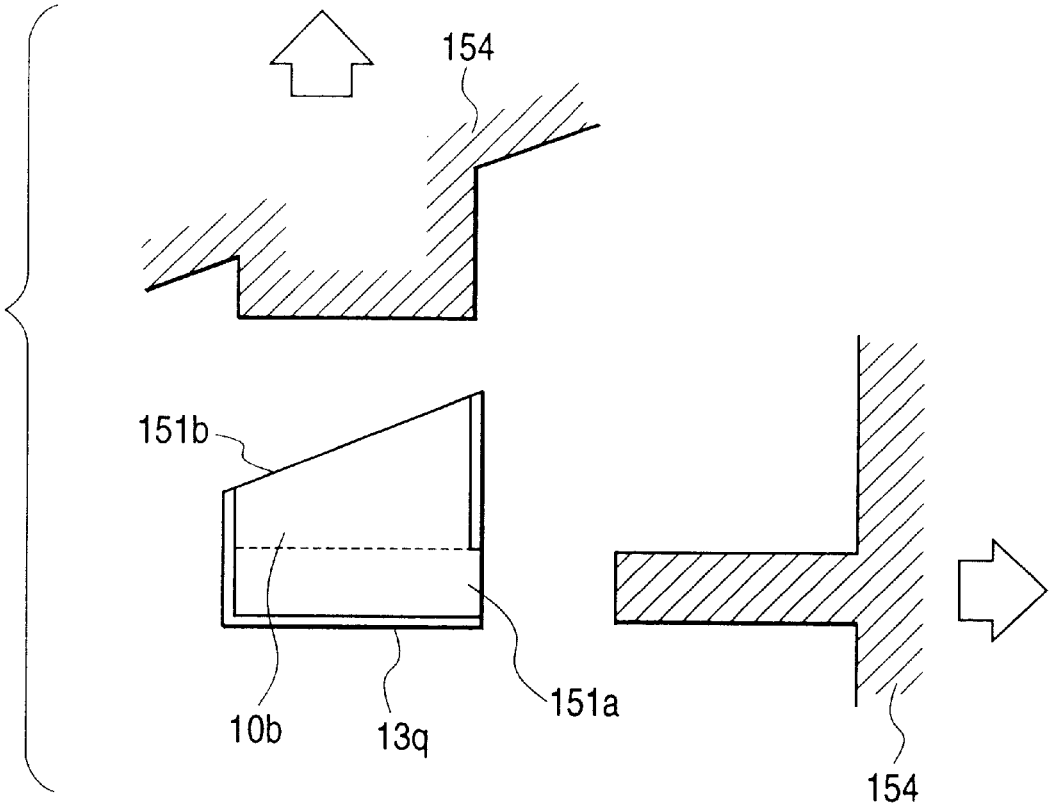
FIG. 42 is a view for explaining a mold for molding a cleaning frame according to an embodiment of the present invention.

Since the cleaning frame body 13 is formed from resin, a conventional mold 154 generally comprises a single male mold part and a female mold part, as shown in FIG. 40. When the opening portion 151*a* is made smaller, as shown in FIG. 41, the waste toner reservoir 10*b* is also made smaller due to the inherent structure of the mold 154. In consideration of the structural feature of the mold, in order to maintain a large waste toner reservoir 10*e*, as shown in FIG. 42, it is required for providing an opening portion 151*b* transverse to the opening portion 151*a*. In this case, the opening portion 151*b* is covered or closed by the lid 13*p* of the cleaning frame later. The cleaning frame body 13*q* and the cleaning frame lid 13*p* are joined together by vibration welding, ultrasonic welding, adhesive or screws to prevent toner leakage. Further, in a condition that the cleaning frame body 13*q* and the cleaning frame lid 13*p* are joined together, since the entire cleaning frame has a box shape, rigidity of the cleaning frame body 13 is enhanced, thereby suppressing vibration which effects a bad influence upon image formation.

Figure 43:
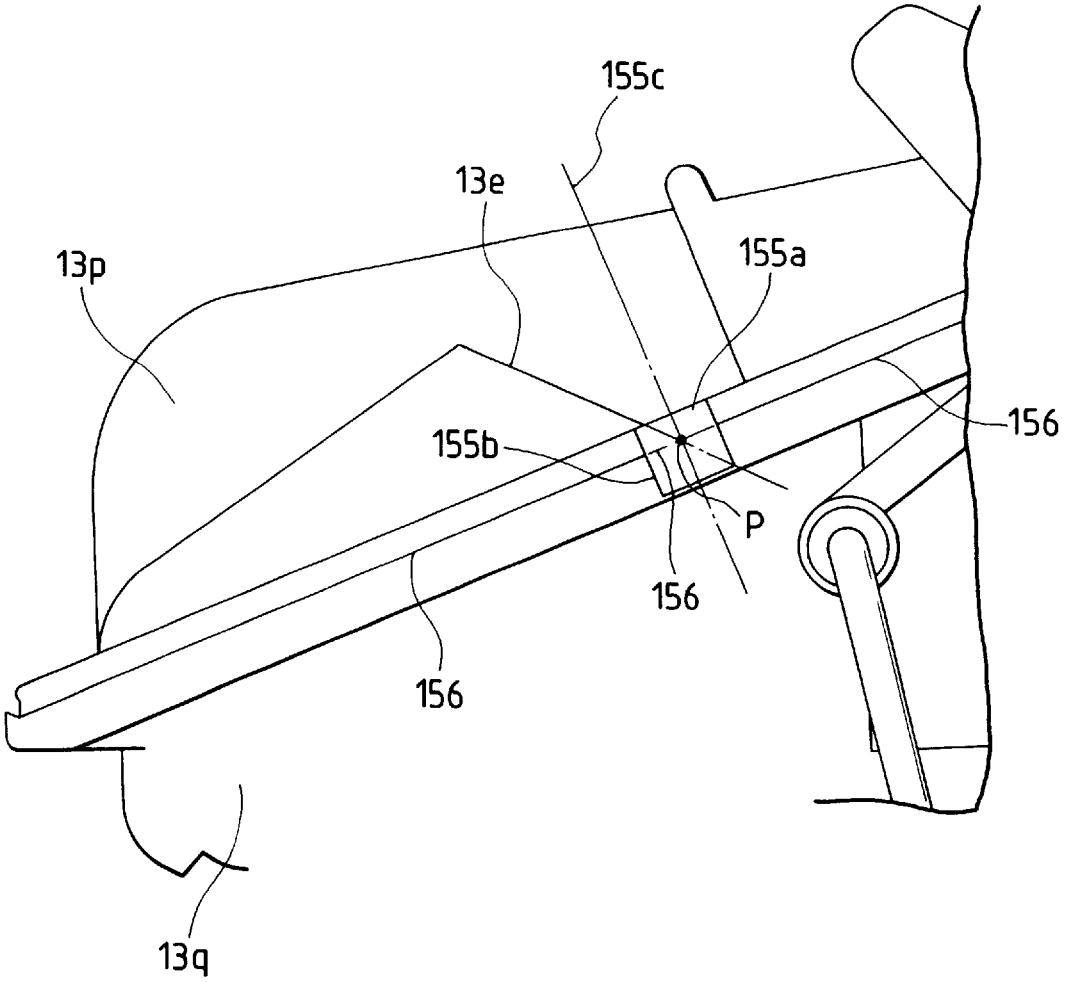
FIG. 43 is a side view showing a welding position positioning portion and a positioning (with respect to the main body of the apparatus) of the cleaning frame according to an the embodiment of the present invention.

Further, as shown in FIG. 43, the cleaning frame lid 13*p* is provided with a regulating abutment portion 13*e* for positioning the process cartridge B with respect to the main body 14 of the apparatus. In order to align the cleaning frame lid 13*p* with the cleaning frame body 13*q*, width-wise edges on both longitudinal ends of the cleaning frame lid 13*p* are provided with positioning portions (downwardly directing projections) 155*a*, which positioning portions 155*a* are fitted into notches 155*b* formed in end-wise edges on both longitudinal ends of the cleaning frame body 13*q*. With this arrangement, the cleaning frame lid 13*p* can be positioned with respect to the cleaning frame body 13*q* by a straight center 155*c* perpendicular to a welding surface 156 (interface between the cleaning frame lid 13*p* and the cleaning frame body 13*q*) and passing through a position bisecting the width of each positioning portion 155*a*. In this arrangement, it is selected so that extension of the regulating abutment portion 13*e* of the cleaning frame lid 13*p*, the center 155*c* of the positioning portion 155*a* of the cleaning frame lid 13*p*, the welding surface 156 pass through the same point P, as shown in FIG. 43. Since the positioning relationships pass through the same point P, after the cleaning frame lid 13*p* and the cleaning frame body 13*q* are welded together, the positioning accuracy of the process cartridge B with respect to the main body 14 of the image forming apparatus is enhanced.

Figure 44:
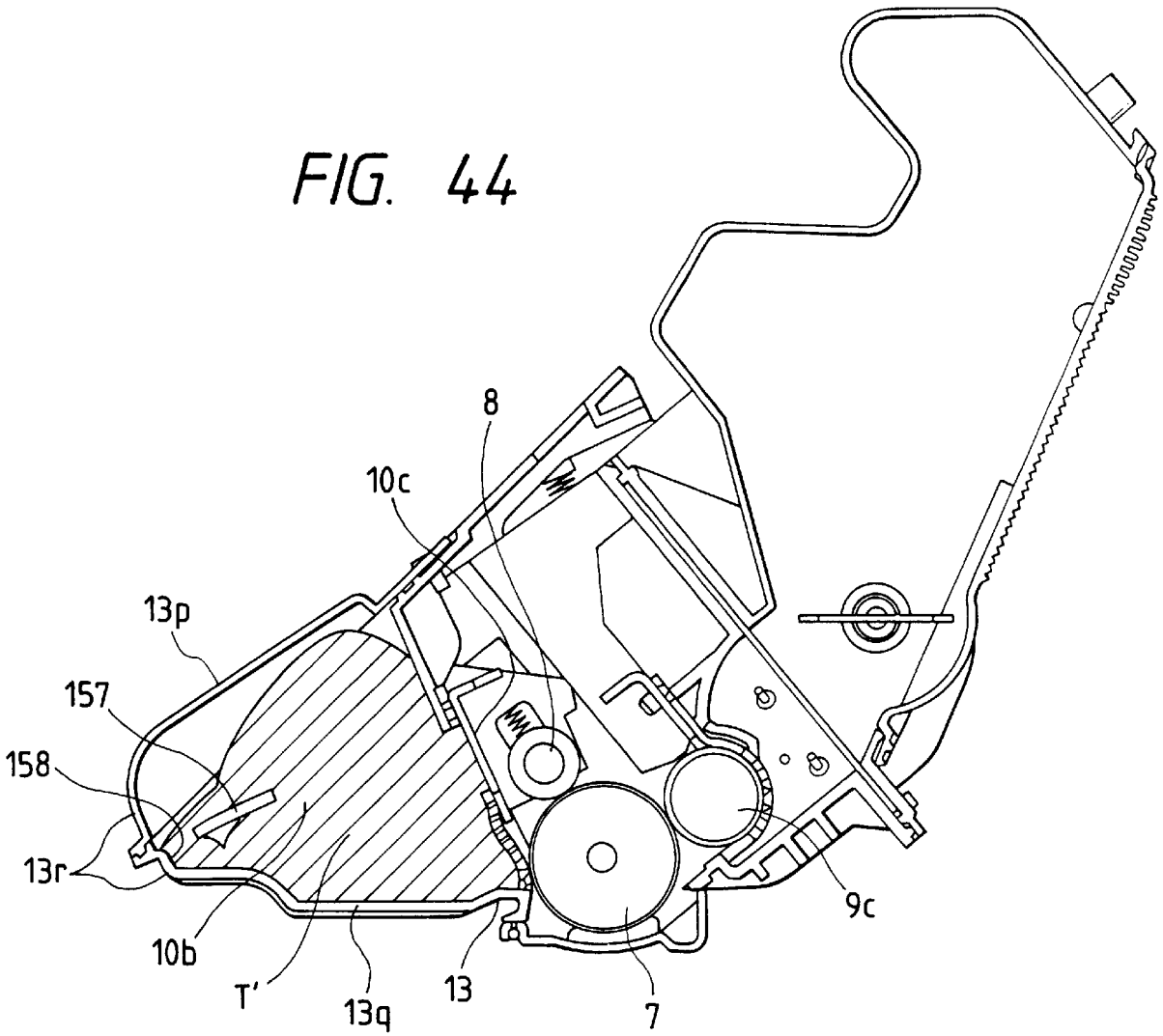
FIG. 44 is a longitudinal sectional view showing a condition that waste toner is accumulated in the cleaning frame according to an embodiment of the present invention.
Figure 45:
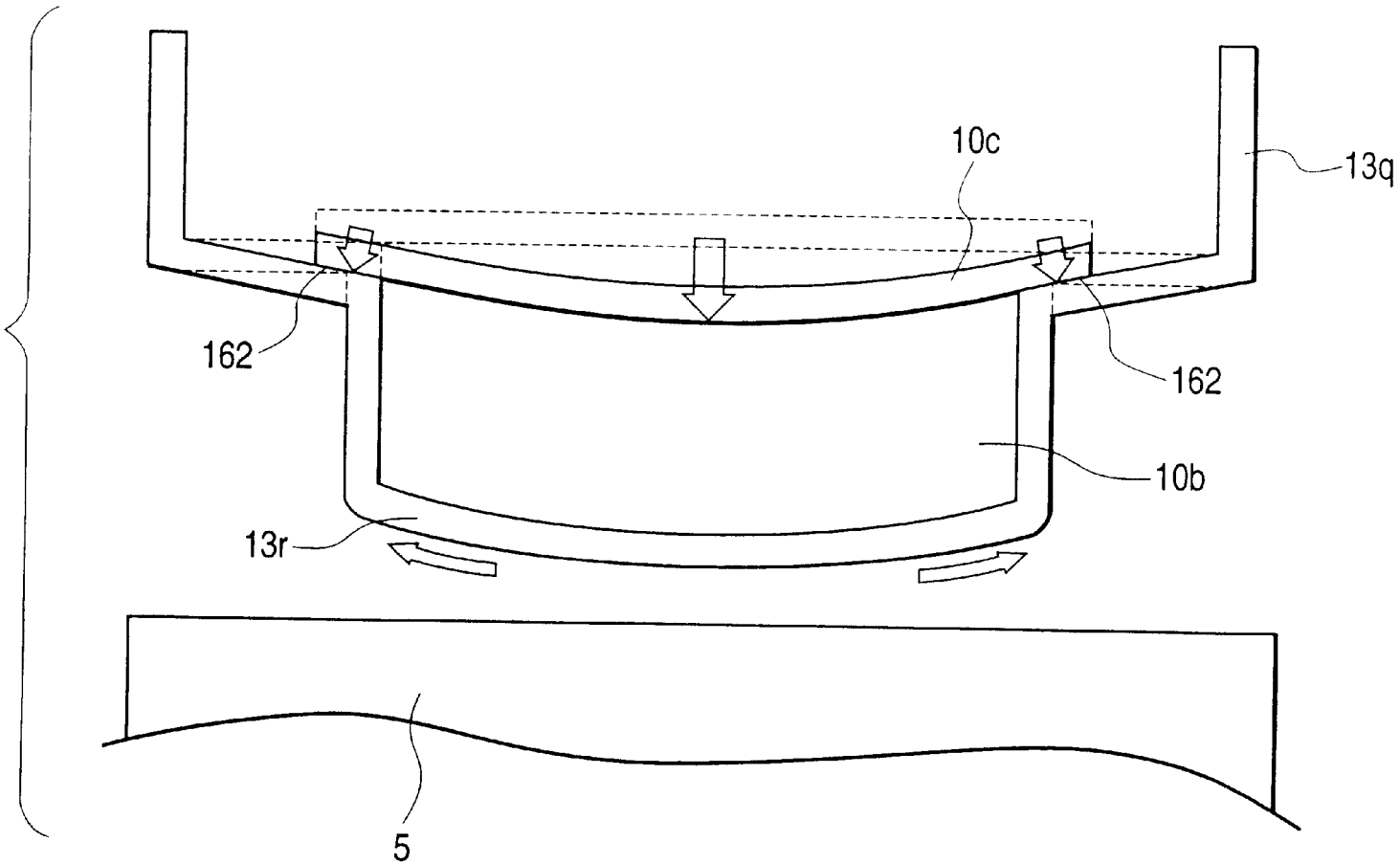
FIG. 45 is a schematic horizontal sectional view showing a condition that a conventional cleaning frame and a conventional cleaning blade are expanded and deformed by heat from a fixing device.
Figure 46:
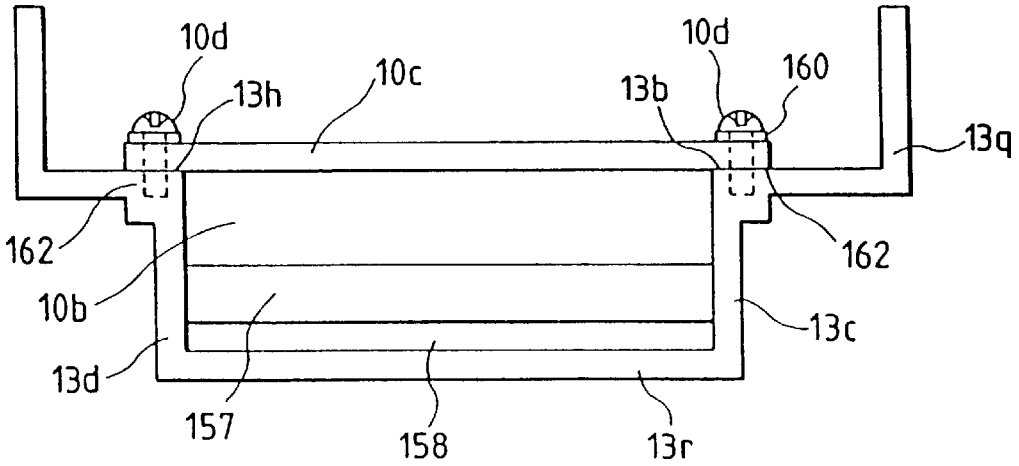
FIG. 46 is a horizontal sectional view of a cleaning frame according to an embodiment of the present invention.

Further, as shown in FIG. 46, a rib 157 is provided within the cleaning frame body 13*q* along its entire longitudinal length as a reinforcing member for the cleaning frame. The rib 157 extends along the entire longitudinal length and is spaced apart from a leading end side (rear side) wall 13*r* of the cleaning frame body 13*q* by 0.5 to 15 mm. The distance between the wall 13*r* and the rib 157 is preferably 0.5 to 3.0 mm. By providing such a distance (gap) 158, transfer of heat from the wall is prevented, and, as shown in FIG. 44, if the waste toner T' is accumulated, the waste toner T' can drop toward the rear side through this gap 158. The rib 157 has a thickness of 1 to 4 mm and a width of 5 to 40 mm. As shown in FIG. 45, if there is no rib 157, when the wall 13*r* of the cleaning frame body 13 near the fixing means 5 (heat source) is heated causing it to be abruptly expanded, due to difference in thermal expansion between the abruptly heated portion and nonheated portion, deformation of the cleaning frame body 13, and, particularly, deformation of an attachment portion 162 for the cleaning blade 10*a* (important for cleaning) will occur. By providing the rib 157, such deformation can be suppressed, thereby providing a cleaning frame having great resistance against thermal deformation.

Figure 47:
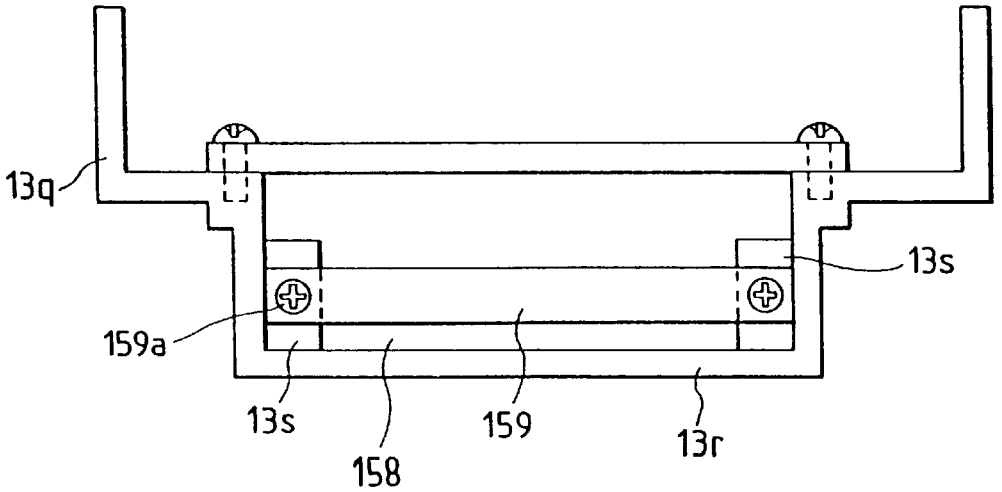
FIG. 47 is a horizontal sectional view of a cleaning frame according to another embodiment of the present invention.

As another embodiment improving the above-mentioned arrangement, as shown in FIG. 47, in place of the rib, a metal plate 159 may be used so that the metal plate is secured to both ends 13*s* by screws within the cleaning frame body 13*q*.

Further, since there is difference in coefficients of thermal expansion between the cleaning frame body 13 made of resin and the cleaning blade metal plate 10*c* made of metal, as shown in FIG. 46, in order to permit slight sliding movement between the cleaning frame body 13 and the cleaning blade metal plate 10*c* when the cleaning unit is heated, the cleaning blade 10*a* is locked by small screws 10*d* via resin washers 160. Incidentally, the washer 160 may be made of nylon.

(Ozone removing air flow)

Figure 48:
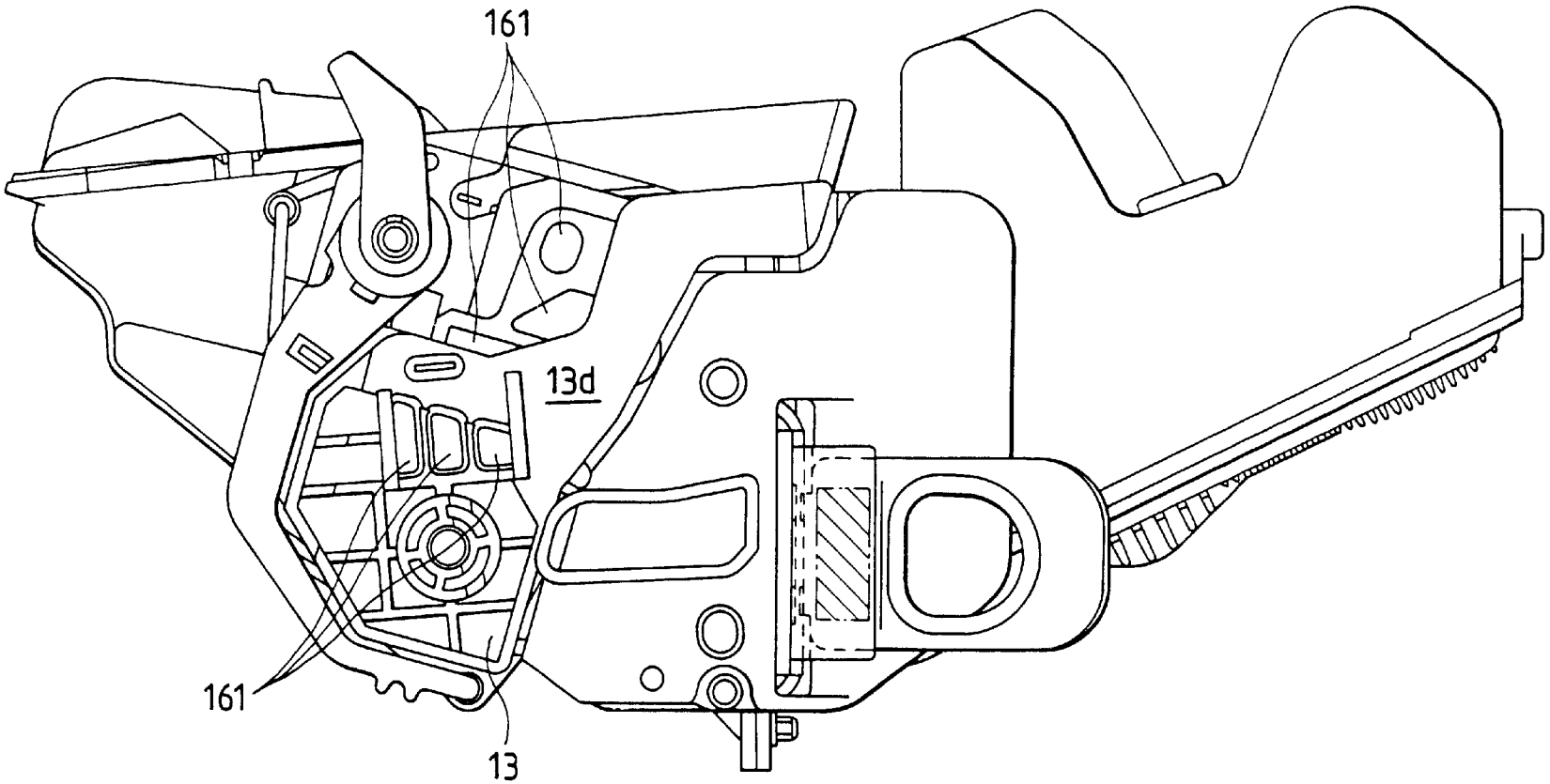
FIG. 48 is a side view of a process cartridge according to an embodiment of the present invention.
Figure 49:
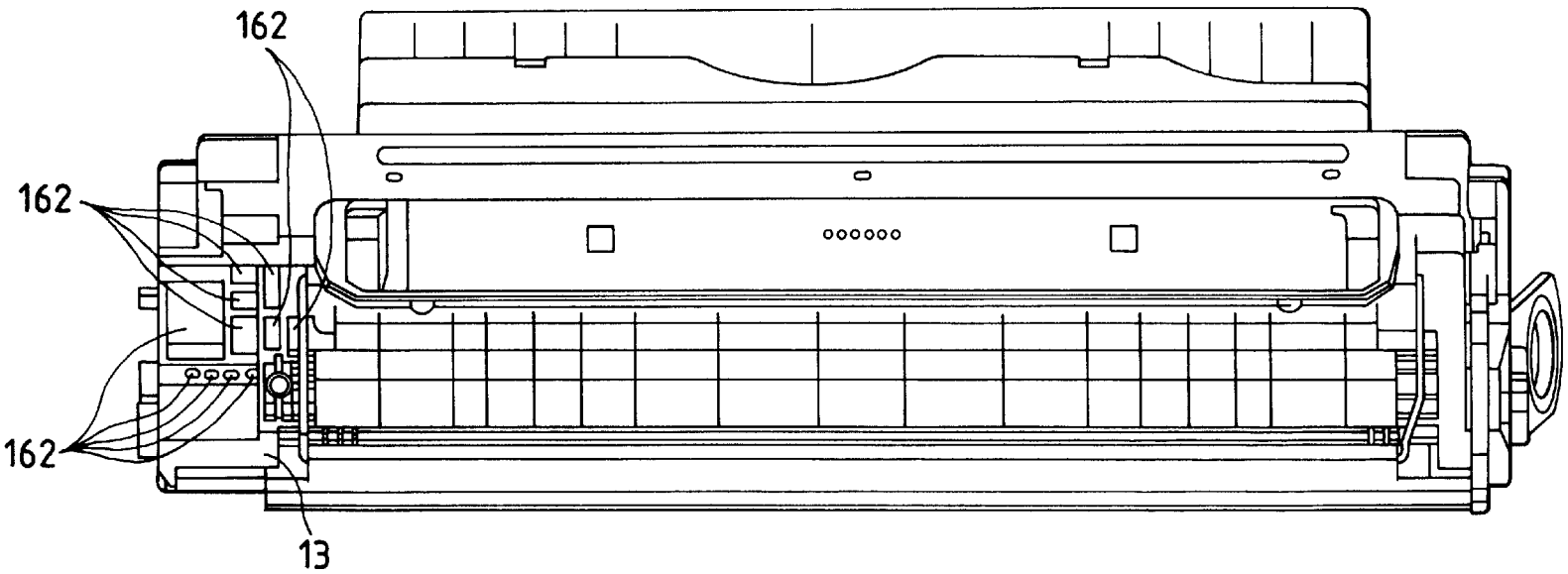
FIG. 49 is a front view of a process cartridge according to an embodiment of the present invention.

Now, air flow for removing ozone (generating during the charging) which is one of factors for causing image-flow will be explained with reference to FIGS. 48 and 49. A left end 13*d* of the cleaning frame body 13 is provided with a plurality of holes 161 at an area where the charge roller 8 is contacted with the photosensitive drum 7. Further, the main body 14 of the image forming apparatus is also provided with holes (not shown) for introducing external air in a confronting relationship to the holes 161. In addition, a plurality of holes 162 are formed in a side wall of the cleaning frame body 13 at the drive gear side facing the fixing means 5, and a fan (not shown) is provided in a confronting relationship to the holes 162 so that ozone around the charge roller 8 within the cleaning frame body 13 can directly be sucked or absorbed without contacting the ozone with other members.

(Charging means)

Figure 63:
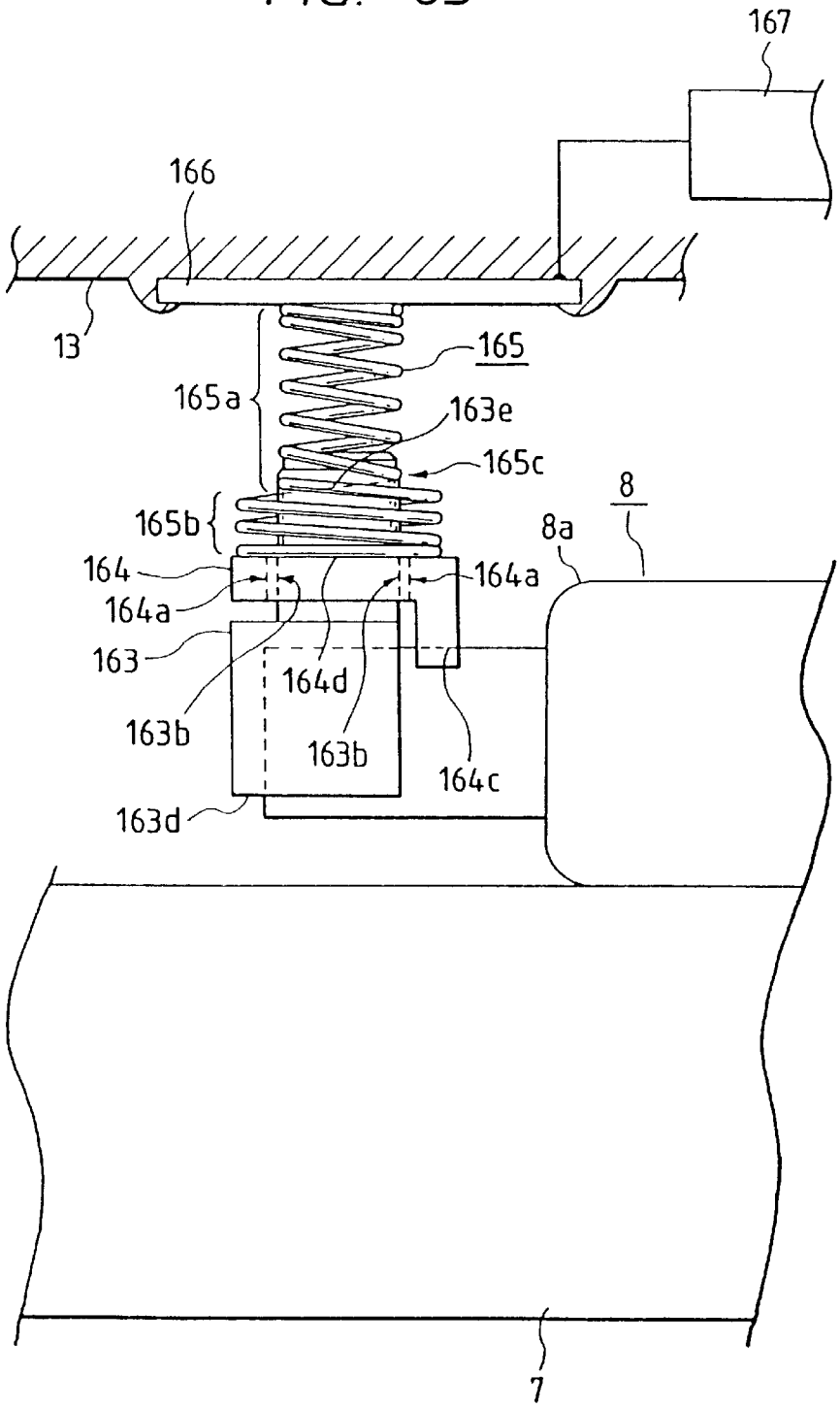
FIG. 63 is a front view showing a charge roller bearing.

As shown in FIG. 63, the charge roller 8 has a charge roller shaft 8*a* passing through the center of the roller, and both ends of the charge roller shaft are rotatably supported by bearings 163 guided by guides (not shown) in a radial direction of the photosensitive drum 7. The bearings 163 are biased toward the photosensitive drum 7 by springs 165 disposed between the bearings 163 and the cleaning frame body 13 so that the charge roller is urged against the photosensitive drum 7 with predetermined pressure. Incidentally, the charge roller 8 does not have a positive driving means and is rotatingly driven by rotation of the photosensitive drum 7.

An electrode 166 is fixedly supported by the cleaning frame body 13 by caulking or the like. When the process cartridge B is mounted to the predetermined position within the main body 14 of the apparatus, a power source 167 of the main body 14 of the apparatus is electrically connected to the electrode 166 of the process cartridge B.

Figure 50:
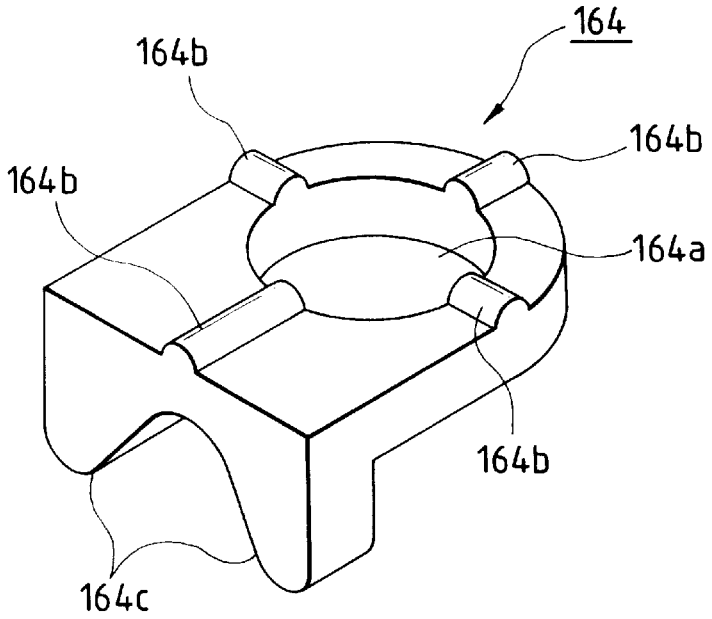
FIG. 50 is a perspective view of a bearing for a charge roller according to an embodiment of the present invention.
Figure 51:
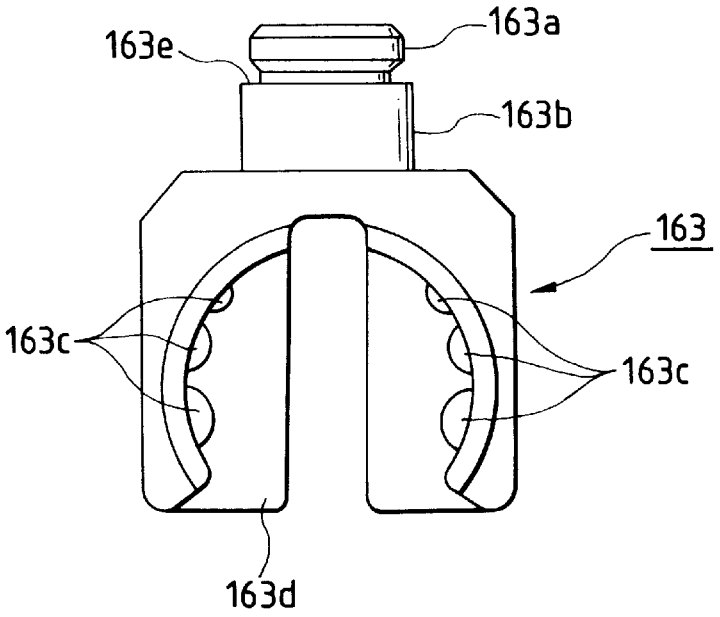
FIG. 51 is a front view of a power supplying contact member for the charge roller according to an embodiment of the present invention.

Now, a construction of the bearing 163 at an electricity supplying side will be explained with reference to FIGS. 50, 51 and 63.

A spring 165 is formed as a two-stage spring in which a first spring portion 165*a* is integrally connected to a second spring portion 165*b* having a diameter greater than that of the first spring portion 165*a*. An end 165*c* of the first spring portion 165*a* of the two-stage spring is fitted onto a bearing boss 163*a* so that the bearing is pressurized by the first spring portion 165*a*. The bearing 163 has a pressure receiving seat surface 163*e* and the end 165*c* of the first spring portion 165*a* has at least one seat winding so that the pressure of the first spring portion 165*a* can positively be received by the pressure receiving seat surface 163*e* of the bearing 163.

The bearing 163 is slidably fitted in a guide of a charge member attaching portion 19 radially of the photosensitive drum 7, as shown in FIG. 9A.

The bearing 163 is made conductive by dispersing carbon fibers in the material of the bearing during the manufacture thereof. Since the charge roller is pressurized by spring pressure of 400 gf to 1000 gf of the first spring portion 165*a*, the bearing 163 may be formed from material obtained by dispersing carbon fibers in base resin having sliding ability, for example, polyacetal including carbon fibers of 10 to 30 weight %, in order to make conductivity and sliding ability compatible at the pressurized point.

The spring 165 is also conductive. Thus, the electrode 166 is electrically connected to the charge roller shaft 8*a* through the spring 165 and the bearing 163. Incidentally, the inner sliding surface of the bearing 163 is provided with a plurality of "mountains" 163*c* to facilitate gathering of the carbon fibers. By slidingly contacting the mountains 163*c* with the charge roller shaft 8*a*, reliability of conductivity is enhanced. Further, the bearing 163 is provided with a thrust stop 163*d* against which the end face of the charge roller 8 is slid.

A hole 164*a* of a contact member 164 is fitted on a root portion 163*b* of the bearing boss 163*a* of the bearing 163 to which the spring 165 is connected. The hole 164*a* of the contact member 164 is greater than the root portion 163*b* of the bearing boss 163*a* so that the contact member can be slid with respect to the bearing 163. An end 165*c* of the first spring portion 165*a* at the junction between the first and second spring portions 165*a*, 165*b* is secured by the bearing boss 163*a*, so that the contact member 164 is urged against the bearing 163 by the second spring portion 165*b*. A plurality of mountains 164*b* is formed on a portion of the contact member 164 pressurized by the second spring portion 165*b* to facilitate the gathering of the carbon fibers. By contacting the mountains 164*b* with the second spring portion 165*b*, reliability of conductivity is enhanced. Unlike the bearing 163, since the contact member 164 does not support the shaft but merely acts as a contact, the contact member is not required to be pressurized excessively. Thus, in the illustrated embodiment, a combination of the contact member 164 and the second spring portion 165*b* made of conductive material pressurized at low pressure of 50 gf to 200 gf is used. For example, the contact member 164 may be made of base resin of polyphenylene sulfide (capable of including many carbon fibers (weight %) including carbon fibers of 30 to 40 weight %. Incidentally, the bearing 163 and the contact member 164 is controlled or governed with electrical resistance value of 5 kΩ.

Contact portions 164*c* between the charge roller shaft 8*a* and the contact member 164 rides over the charge roller shaft 8*a* and there are two such contact portions on one side of the center axis of the spring 165. In this arrangement, although the position of the bearing is sometimes regulated by the longitudinal position of the cleaning blade 10*a*, by using such in a manner as shown in FIG. 63, the arrangement can be used in different kinds of process cartridges, with the result that, by using the same elements in various cartridges, mass-production can be achieved to reduce the manufacturing cost. Further, an end 164*d* of the second spring portion 165*b* contacted with the contact member 164 has at least one seat winding. Since the two contact portions 164*c* are provided on one side of the center axis of the spring 165, the pressure difference due to the position of the end of the winding of the spring is avoided by using this arrangement.

With the above-mentioned arrangement of the contact member 164, an electricity supplying path from the power source (power supply) 167 to the charge roller 8 is constituted by a first electricity supplying path including a proximal end of the electrode 166, conductive spring 165 and conductive bearing 163, and a second electricity supplying path for supplying electricity from the conductive spring 165 through the contact member 164. (Joining of cleaning unit and developing unit).

Next, the connection between the cleaning frame (first frame) 13 for supporting the photosensitive drum and the developing frame (second frame) 12 for supporting the developing roller 9*c* will be fully described with reference to FIG. 64. Incidentally, the developing frame body 12 is one aspect of a toner developing frame obtained by joining it to the toner frame body 11.

As shown in FIG. 64, a frame joining member 168 includes a compression spring 169 for urging the developing roller 9*c* against the photosensitive drum 7, a spring support portion 170*e* for supporting the compression spring 169, a fixed member 170, a shaft portion 171 for rotatably joining the developing frame body 12 and the cleaning frame body 13, a second shaft portion 171*d* fitted into a hole portion 170*f* of a side surface 13*k* of the cleaning frame body 13 to support the shaft portion 171 and support both longitudinal ends of the developing frame body 12 in an inboard fashion, an inverted pawl portion 170*c*, and a dislodgment preventing portion 170*b* provided on the fixed member 170 and adapted to preventing dislodgment of the frame joining member 168.

Figure 64A:
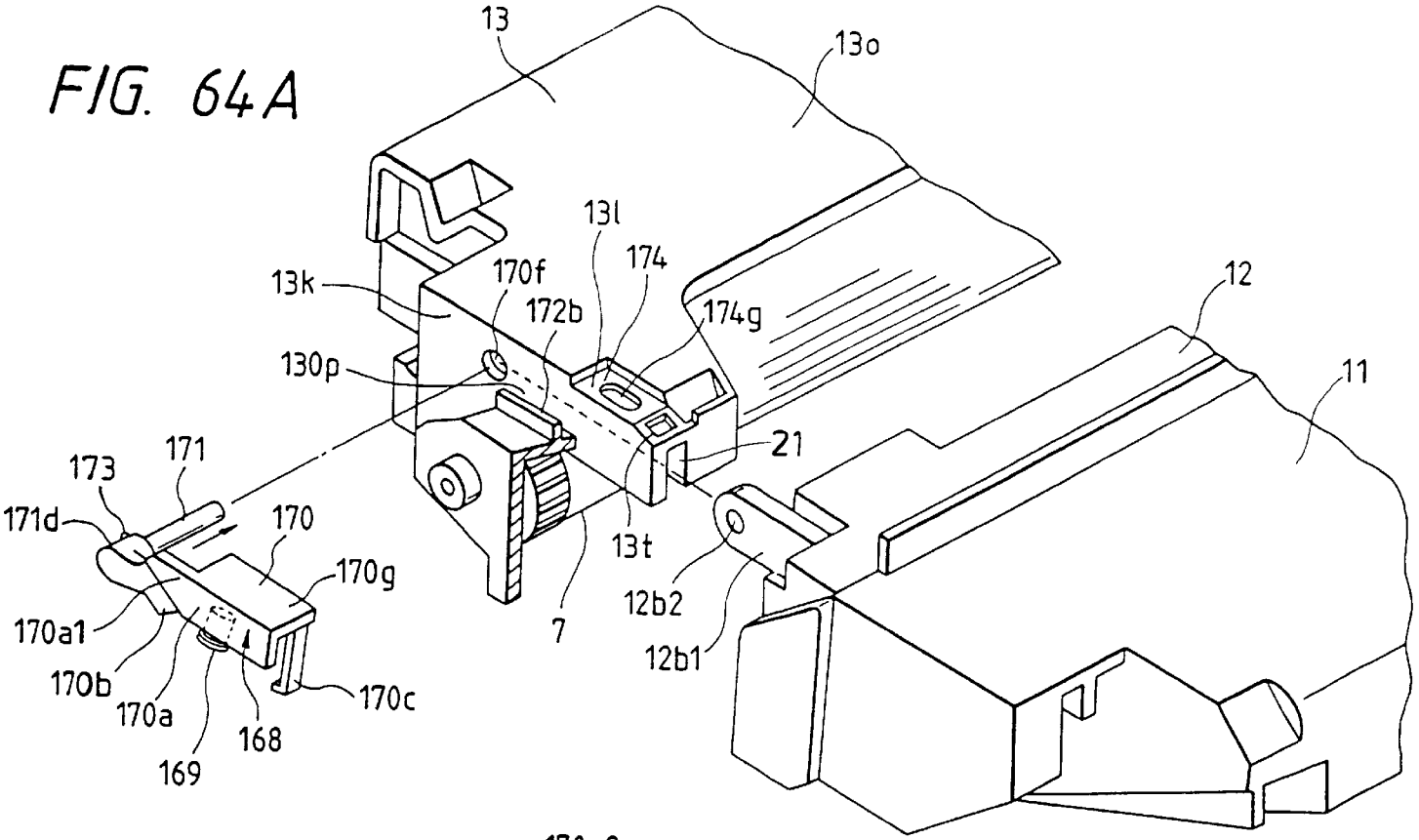
FIG. 64A is an exploded perspective view showing connection between the developing roller unit and the cleaning unit.

Now, a configuration of the frame joining member 168 will be described. The frame joining member 168 is formed by molding the fixed member 170 integrally with the metal shaft portion 171. As shown in FIG. 64A, in an attached condition, a plate-shaped vertical side portion 170*a* of the fixed member 170 is positioned in parallel with both side surfaces 13*k* of the cleaning frame body 13 perpendicular to the longitudinal direction. A longitudinal upper portion 170*g* bent inwardly from the plate-shaped side portion 170*a* is a substantially horizontal plate-shaped member, and a cross-section of the upper portion 170*g* and the side portion 170*a* assumes a substantially L-shape. The upper portion 170*g* has a configuration just fitted into a recessed seat 131 provided on an upstream corner of an upper surface 13*o* of the cleaning frame body 13 looked at from a process cartridge B inserting direction. The side portion 170*a* of the fixed member 170 has an extension portion 170*a*1 extending in the process cartridge B inserting direction in a condition that the frame joining member is assembled to the cartridge frame, and the second round shaft portion 171*d* extending inwardly of the cleaning frame body 13 is provided on the extension portion 170*a*1. The dislodgment preventing portion 170*b* is formed on a lower edge of the extension portion 170*a*1. The dislodgment preventing portion 170*b* is slightly offset outwardly in the longitudinal direction in comparison with the side portion 170*a*. The dislodgment preventing portion 170*b* is fitted into a dislodgment preventing groove 130*p* dug downwardly between the side surface 13*k* of the cleaning frame body 13 and an upper surface of a rib 172*b*, thereby preventing dislodgment of the fixed member 170 in the longitudinal direction and positioning the fixed member.

Further, in order to further ensure the prevention of dislodgment of the fixed member 170, the second shaft portion 171*d* is provided with a dislodgment preventing boss (small projection) 173. During the assembling, the dislodgment preventing boss 173 is press-fitted into the hole portion 170*f* of the side surface 13*k* of the cleaning frame body 13 so as not to be removed from the hole portion after assembling. When the upper portion 170*g* of the fixed member 170 is fitted into the recessed seat 131 of the upper surface of the cleaning frame body 13, the inverted pawl 170*c* of the fixed member 170 of the frame joining member 168 is hooked to an edge of a corner hole 13*t* at the end of the recessed seat 131.

Figure 64B:
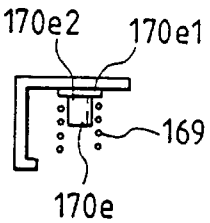
FIG. 64B is a side sectional view of a pressurizing spring.

As shown in FIG. 64B, the spring support portion 170*e* for locking the compression coil spring 169 is protruded from a lower surface of the upper portion 170*g* of the fixed member 170 of the frame joining member 168. The spring support portion 170*e* comprises a stepped peg having a large diameter portion 170*e*1 a circumference of which acts as a spring seat, and a small diameter portion 170*e*2 onto which the compression coil spring 169 is fitted. An axis of the spring support portion 170*e* coincides with a center line of the compression coil spring 169 press-fitted onto the small diameter portion 170*e*2, so that, in the assembled condition that the compression coil spring 169 is compressed, the center line becomes perpendicular to an upper surface of an arm portion 12*b*1 of the developing frame body 12. The hole portion 170*f* has a center located on a plane perpendicular to the longitudinal direction. Further, the spring support portion 170*e* is located between the inverted pawl 170*c* and the shaft portion 171.

The shaft portion 171 is provided at the center of the cylindrical second shaft portion 171*d* having a longitudinal center.

Regarding the frame joining member 168 assembled as mentioned above, in the condition that the process cartridge B is mounted to the main body 14 of the apparatus, the shaft portion 171 is parallel with the longitudinal direction, the compression coil spring 169 is directed toward an up-and-down direction, and the shaft portion 171 and the compression coil spring 169 cross each other in a staggered fashion.

As shown in FIG. 9, the cleaning frame body 13 is provided at its longitudinal both ends with recessed portions 21 into which arm portions 12*b*1 provided on both longitudinal ends of the developing frame body 12 and protruding toward the cleaning frame body 13 are fitted. Outer through hole portions 170*f* into which the second shaft portions 171*d* of the frame joining members 168 are fitted are formed in the side surfaces 13*k* of the cleaning frame body 13, which hole portions are directed toward the recessed portions 21, and holes 174*g* through which the compression coil springs 169 pass are formed in first bottom surfaces 174 of the recessed seats 131. In a condition that the arm portions 12*b*1 are inserted into the recessed portions 21, the holes 174*g* are located immediately above intermediate portions of the arm portions 12*b*1.

When the arm portions 12*b*1 of the developing frame body 12 are inserted into the recessed portions 21 of the cleaning frame body 13 and urged against the bottoms of the recessed portions 21, holes 12*b*2 provided at centers of semicircular tip end portions of the arm portions 12*b*1 are moved to slightly exceed a position where the holes are aligned with inner through holes 13*u*, but, these holes 12*b*2, 13*u* approximately coincide with each other (FIGS. 9A and 9B).

As already mentioned, the inverted pawl 170*c* suspended from the upper portion 170*g* is provided on the frame joining member 168 at the end opposite to the end on which the shaft portion 171 is provided, and the corner hole 13*t* into which the inverted pawl 170*c* is snap-fitted is formed in the recessed seat 131 of the cleaning frame body 13.

During assembling, similar to the above, in the condition that the fixed member 170 is cocked upwardly, the shaft portion 171 is fitted into the inner through hole 13*u* and the second shaft portion 171*d* is fitted into the outer through hole 171*f*, and then, the upper portion 170*g* is rotated around the shaft portion 171 and the second shaft portion 171*d* to be fitted into the recessed seat 131. As a result, the inverted pawl 170*c* enters into the corner hole 13*t*, so that the tip end of the pawl is flexed by the edge of the corner hole 13*t* to be shifted away from the shaft portion 171. When the inverted pawl 170*c* is completely inserted, the original posture is restored, thereby locking the inverted pawl 170*c* to the edge of the corner hole 13*t*.

(Construction of a guide means for process cartridge B)

Next, a guide means for mounting and dismounting the process cartridge B with respect to the main body of the apparatus will be explained. The guide means is shown in FIGS. 5 to 9A and 9B. FIG. 5 is a right side view of the process cartridge B looked at from the direction (shown by the arrow X) along which the process cartridge is mounted to the main body 14 of the apparatus, and FIG. 6 is a right side view of the process cartridge.

As shown, the housing (cartridge frame) 100 (11, 12, 13, 40, 41) is provided at its both outer surfaces with guide means acting as guides when the process cartridge B is mounted and dismounted with respect to the main body 14 of the apparatus. The guide means comprises a cylindrical guide (first guide member) 13*a*, a longitudinal guide (second guide member) 12*a*, and a width-wise guide (third guide member) 13*b*.

The cylindrical guide 13*a* is a cylindrical member provided on the side surface of the cleaning frame body 13 to be protruded outwardly coaxially with the axis of the photosensitive drum 7. The cylindrical member supports the drum shaft 7*a* supporting the photosensitive drum 7 so as not to rotate the shaft. The longitudinal guide 12*a* is provided on the side surface of the developing frame body 12 to straddle between the side surfaces of the developing frame body 12 and the cleaning frame body 13. The widthwise guide 13*b* is provided on the side surface of the cleaning frame body 13 above the cylindrical guide 13*a*. More specifically, the longitudinal guide 12*a* is formed integrally with developing holders 40, 41 (described later) secured to the developing frame body 12 (refer to FIG. 23). Further, the cylindrical guide 13*a* and the widthwise guide 13*b* are formed integrally with the cleaning frame body 13.

The longitudinal guide 12*a* extends along the process cartridge inserting direction (shown by the arrow X), and an inclination thereof is selected to be substantially the same as an insertion angle of the process cartridge B. The cylindrical guide 13*a* is disposed on the extension of the longitudinal guide 12*a* extending in the process cartridge B inserting direction. Further, the width-wise guide 13*b* is disposed substantially in parallel with the longitudinal guide 12*a*.

Incidentally, as shown in FIG. 6, a cylindrical guide 13*a*, a longitudinal guide (second guide member) 12*a* and a widthwise guide (third guide member) 13*b* are also provided on a side surface opposite to the side surface shown in FIG. 5 and have the same configurations and positions as the aforementioned ones. These three guides are protruded from the outer planar surface by same amounts.

Now, a detailed explanation is made of the foregoing embodiment.

The cylindrical guide (first guide member) 13*a* is provided on one side end (right side end 13*c*) C1 and the other side end (left side end 13*d*) C2 of the cleaning unit C. Here, "one side end C1" is a right side end 13*c* of the cleaning frame body 13 located at the right end with respect to the axial direction of the photosensitive drum 7 when the process cartridge B is looked at from the developing unit D side (when the process cartridge B is looked at from the inserting direction). Further, "the other side end C2" is a left side end 13*d* of the cleaning frame body 13 located at the left with respect to the axial direction of the photosensitive drum 7. The cylindrical guide 13*a* is the cylindrical member protruded outwardly from both side ends 13*c*, 13*d* of the cleaning frame body 13 coaxially with the axial direction of the photosensitive drum 7. The metallic drum shaft 7*a* is supported by the cylindrical guide 13*a*. The cylindrical guide 13*a* is disposed to surround the drum shaft 7*a*. Thus, the drum shaft 7*a* is guided by a guide portion 16*a* (described later) of the main body 14 of the apparatus through the cylindrical guide 13*a* and is positioned by a groove 16*a*5 (refer to FIGS. 10 to 17).

The longitudinal guide (second guide member) 12*a* is provided on one side end (right side end 12*c*) D1 and the other side end (left side end 12*d*) D2 of the developing unit D. Here, "one side end D1" is a portion of the developing frame body 12 located at the right end with respect to the axial direction of the photosensitive drum 7. Further, "the other side end D2" is a portion of the developing frame body 12 located at the left with respect to the axial direction of the photosensitive drum 7. The longitudinal guide 12*a* is disposed at a position spaced apart from the cylindrical guide 13*a* and upstream of the cylindrical guide 13*a* in the process cartridge inserting direction (shown by the arrow X). More specifically, the longitudinal guide 12*a* is disposed in an area L pinched between upper and lower imaginary lines 111, 112 (FIG. 5) extending toward an upstream side from the outer peripheral surface of the cylindrical guide 13*a* with respect to the inserting direction. The longitudinal guide 12*a* has a tip end 12*a*1 (in the inserting direction) slightly (about 1 to 3 mm) straddling toward the cleaning frame body 13.

Further, the widthwise guide (third guide member) 13*b* is provided right and left side ends 13*c*, 13*d* of the cleaning unit C. The widthwise guide 13*b* is disposed above the cylindrical guide 13*a*. More specifically, the widthwise guide 13*b* is located substantially immediately above the cylindrical guide 13*a*, when the process cartridge B is looked at from the inserting direction. That is to say, the widthwise guide 13*b* is disposed in an area 15 pinched between straight lines 113, 114 extending substantially in perpendicular to the process cartridge inserting direction (shown by the arrow X) to be contacted with the outer peripheral surface of the cylindrical guide 13*a*. Further, the widthwise guide 13*b* is disposed substantially parallel with the longitudinal guide 12*a*.

Now, an example of a size of the guide member will be described.

Incidentally, an allowable range is referred to as a range adopted to the process cartridge B according to the illustrated embodiment, and so on.

The cylindrical guide 13*a* has a driving side outer diameter of about 10.0 mm (allowable range: 7.5 mm to 10.0 mm) and a nondriving side outer diameter of 17.0 mm (allowable range: 14.5 mm to 17.0 mm), the longitudinal guide 12*a* has a length of about 36.0 mm (allowable range: 15.0 mm to 41.0 mm), a driving side width of about 8.0 mm (allowable range: 1.5 mm to 10.0 mm) and a nondriving side width of about 15.0 mm (allowable range: 1.5 mm to 17.0 mm), and the widthwise guide 13*b* has a length of about 10.0 mm (allowable range: 3.0 mm to 17.0 mm) and a width of about 4.0 mm (allowable range: 1.5 mm to 7.0 mm). Further, a distance between the outer peripheral surface of the cylindrical guide 13*a* and the tip end 12*a*1 (in the inserting direction) of the longitudinal guide 12*a* is about 9.0 mm at the driving side and about 5 mm at the nondriving side, and a distance between the outer peripheral surface of the cylindrical guide 13*a* and the lower end 13*b*1 of the widthwise guide 13*b* is about 35.5 mm (allowable range: 33.5 mm to 37.5 mm) at the driving side and about 19 mm (allowable range: 17 mm to 21 mm) at the nondriving side.

Next, the regulating abutment portion 13*e* and releasing abutment portion 13*f* provided on the upper surface 13*i* of the cleaning unit C will be explained. Here, "upper surface" means a surface located at an upper side when the process cartridge B is mounted to the main body 14 of the apparatus.

In the illustrated embodiment, the regulating abutment portions 13*e* and the releasing abutment portions 13*f* are provided on the upper surface 13*i* of the cleaning unit C at the right side end 13*c* and the left side end 13*d* thereof in a direction perpendicular to the process cartridge inserting direction. The regulating abutment portions 13*e* serve to regulate the position relating the posture of the process cartridge B when the process cartridge B is mounted to the main body 14 of the apparatus. That is to say, when the process cartridge B is mounted to the main body 14 of the apparatus, the regulating abutment portions 13*e* abut against fixed members 25 (FIGS. 10 to 17) of the main body 14 of the apparatus, thereby regulating the position of the process cartridge B. Further, the releasing abutment portions 13*f* function when the process cartridge B is dismounted from the main body 14 of the apparatus. That is to say, when the process cartridge B is dismounted from the main body 14 of the apparatus, the releasing abutment portions 13*f* abut against the fixed members 25 to permit smooth removal of the process cartridge B with the aid of a moment. The mounting and dismounting of the process cartridge B will be described later in connection with FIGS. 10 to 17.

More specifically, in the illustrated embodiment, recessed portions 13*g* are provided on the upper surface 13*i* of the cleaning unit C at both side ends thereof in a direction perpendicular to the process cartridge inserting direction. The recessed portion 13*g* is provided with a first inclined surface 13*g*1 inclined upwardly from a tip end in the inserting direction (shown by the arrow X), a second inclined surface 13*g*3 lowering from an upper end 13*g*2 of the inclined surface 13*g*1, a fourth inclined surface 13*g*5 further lowering from a lower end 13*g*4 of the inclined surface 13*g*3 looked at from the direction X. An upper end 13*g*6 of the inclined surface 13*g*5 has a wall (inclined surface) 13*g*7. The second inclined surface 13*g*3 corresponds to the regulating abutment portion 13*e*, and the wall 13*g*7 corresponds to the releasing abutment portion 13*f*.

Now, an example of various sizes will be described.

First of all, the regulating abutment portion 13*e* has an inclination angle of 0° with respect to a horizontal line x (FIG. 5) of the process cartridge B mounted to the main body 14 of the apparatus and a length of about 6.0 mm (allowable range: 4.5 mm to 8.0 mm). Further, the releasing abutment portion 13*f* has an inclination angle θ1 of about 45° with respect to the horizontal line x and a length of about 10.0 mm (allowable range: 8.5 mm to 15.0 mm).

(Mounting and dismounting of the process cartridge)

Next, a process for mounting and dismounting the process cartridge B with respect to the main body 14 will be explained with reference to FIGS. 10 to 19.

The process cartridge B constructed as mentioned above is detachably attachable to the cartridge mounting means of the main body 14 of the apparatus.

Figure 17:
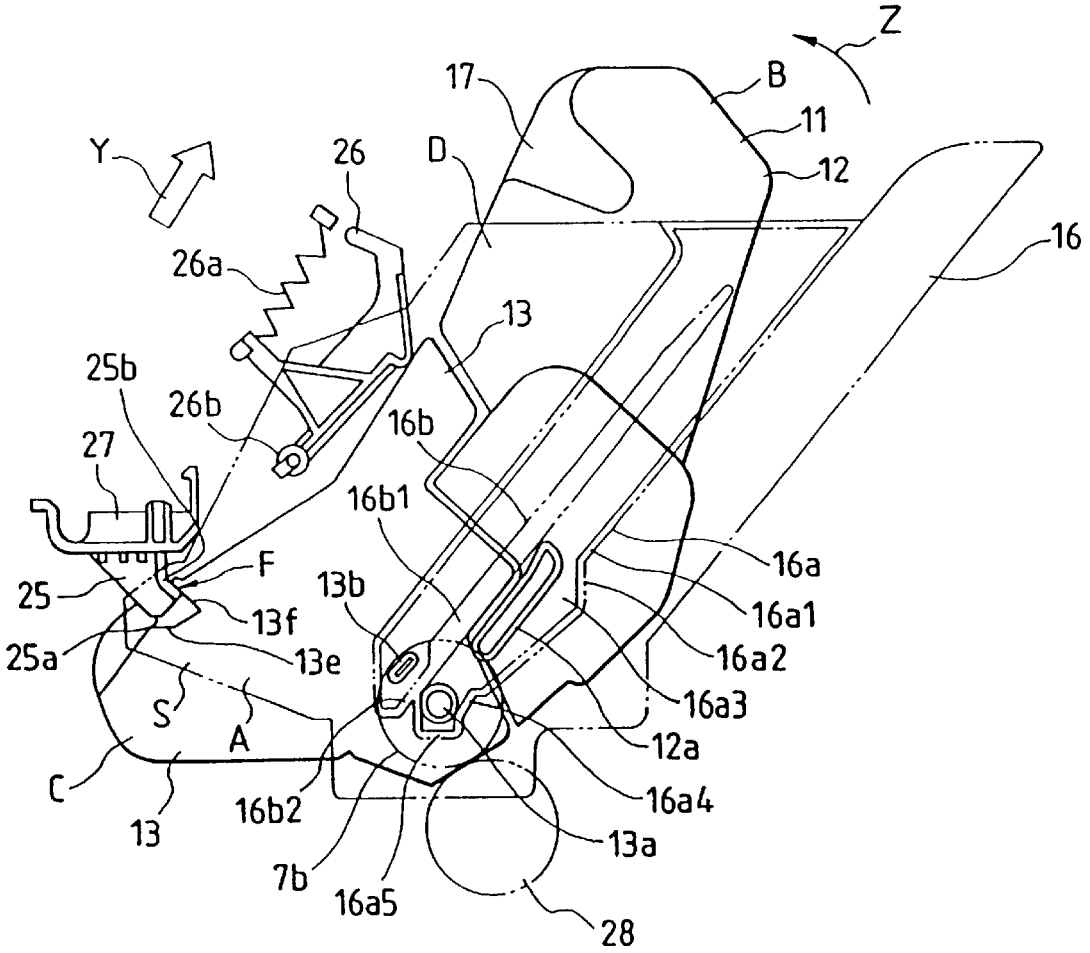
FIG. 17 is a side view showing a mounting and dismounting process for the process cartridge of FIG. 3 with respect to a main body of an image forming apparatus.
Figure 18:
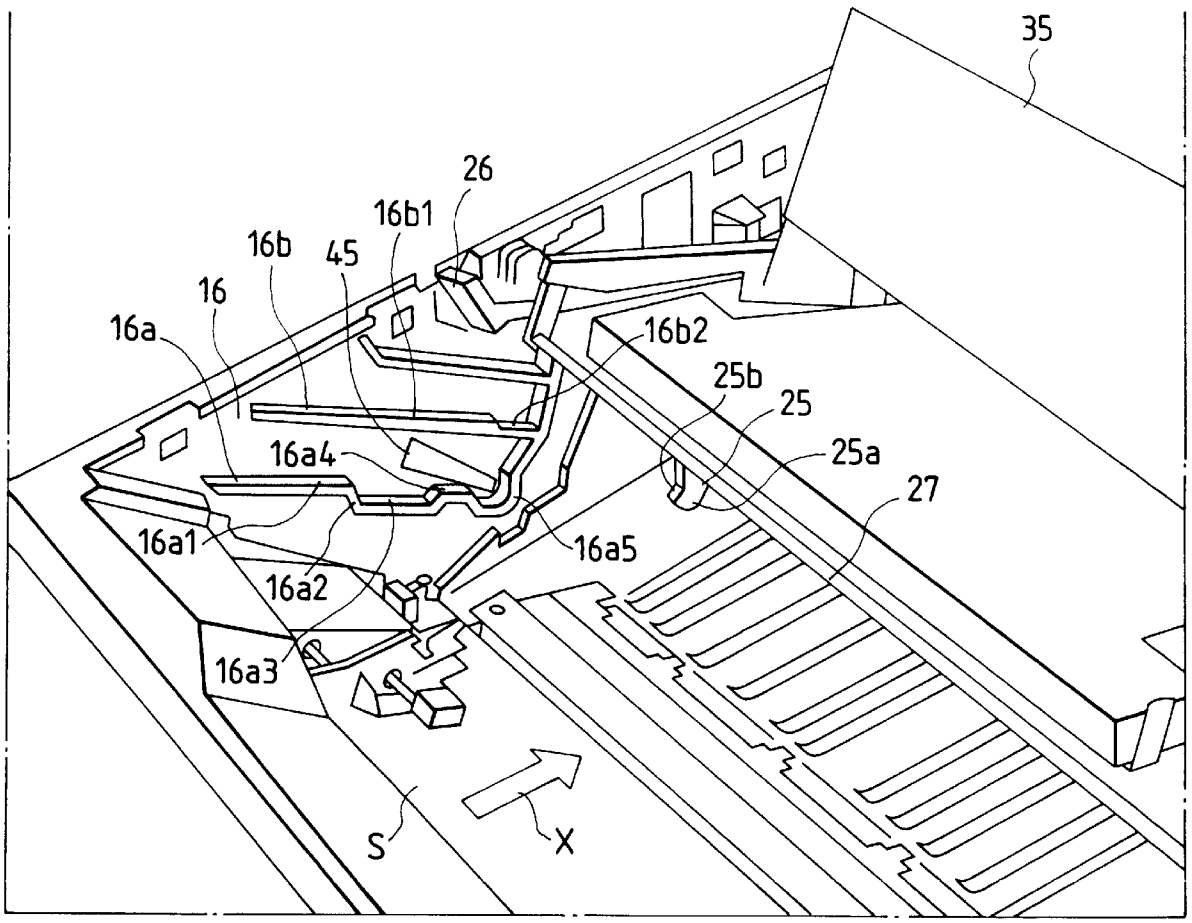
FIG. 18 is a perspective view showing interior of the main body of the apparatus.

In FIG. 1, when an openable and closable member 35 is opened around a fulcrum 35*a* by the operator, as shown in FIGS. 18 and 19, a cartridge mounting space S is revealed, and cartridge mounting guides 16 are attached to left and right inner surfaces of the main body 14 of the apparatus. The left and right guide members 16 are provided with first guide portions 16*a* and second guide portions 16*b* for guiding the guides of the process cartridge B, which (left) first and second guide portions are opposed to corresponding (right) first and second guide portions. After the process cartridge B is inserted along the guide portions 16*a*, 16*b*, when the openable and closable member 35 is closed, the mounting of the process cartridge B to the image forming apparatus A is completed. Incidentally, as shown in FIGS. 10 to 17, the process cartridge B is mounted and dismounted with respect to the main body 14 of the apparatus along a direction transverse to the axis of the photosensitive drum 7. More specifically, the process cartridge is mounted and dismounted along a direction substantially perpendicular to the axis of the photosensitive drum. The process cartridge is mounted with the cleaning unit C directing forwardly and the developing unit D directing rearwardly.

Further, during mounting and dismounting, a recessed portion as a grip portion 17 (FIG. 3) is formed on the process cartridge B along the longitudinal direction thereof to facilitate the gripping of the cartridge. Thus, the operator can mount (attach) and dismount (detach) the process cartridge B while gripping the grip portion 17 by his both hands.

(Drum shutter)

The process cartridge B is provided with a drum shutter member 18 (FIG. 3) driven in synchronousism with the cartridge mounting and dismounting operations to open and close the transfer opening portion 13*n*. When the process cartridge B is removed from the laser beam printer A, the shutter member 18 is closed to protect the transfer area of the photosensitive drum 7. Incidentally, as shown in FIG. 6, the shutter member 18 is pivotally connected to and supported by a tip end of an arm 18*a* rotatably supported by the cleaning frame body 13 and a tip end of a link member 18*b*. While the process cartridge B is being mounted to the main body 14 of the apparatus along the direction X (FIG. 6), when a tip end of a lever 23 secured to the root of the shutter arm 18*a* at a fulcrum 18*c* for supporting the shutter arm 18*a* abuts against a stopper (not shown) of the main body 14 of the apparatus, the shutter member 18 is opened. When the process cartridge B is removed from the main body 14 of the apparatus, the shutter member is closed by an elastic force of a torsion coil spring 23*a*.

Figure 66A:
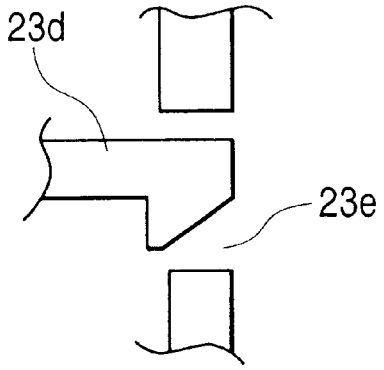
FIG. 66A is a sectional view showing attachment of the drum shutter member to the cartridge frame.
Figure 66B:
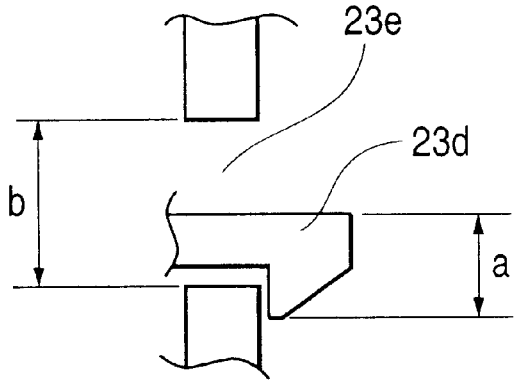
FIG. 66B is a sectional view of the dislodgment preventing mechanism in a condition that the drum shutter member is opened.
Figure 66C:
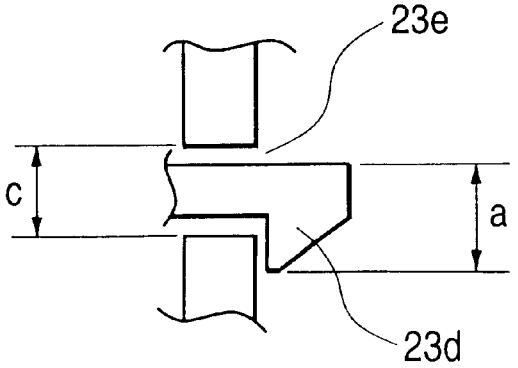
FIG. 66C is a sectional view of the dislodgment preventing mechanism in a condition that the drum shutter member is closed.

Further, as shown in FIG. 66C, when the process cartridge B is removed from the main body 14 of the apparatus and left alone, the drum shutter 18 is in the closed condition. In this case, the tip end 23*b* of the lever 23 is protruded. Thus, the shutter arm 18*a* is provided with a pawl 23*d* for preventing dislodgment of the shutter arm 18*a* even if the operator erroneously apply a force to the lever. As shown in FIGS. 65 and 66A to 66C, a radial dimension c of a portion a of a sector hole 23*e* (of the cleaning frame body 13) having a center at a pivot shaft 18*c* for snap-fitting the shutter arm 18*a* is selected to be smaller than a thickness a of the snap-fit pawl 23*d* of the shutter arm 18*a*. As shown in FIG. 66C, when the drum shutter member 18 is closed, the pawl 23*d* is rotated into the portion a. In FIGS. 66A to 66C, a relationship between the thickness of the pawl 23*d* and the sector hole 23*e* is b>a and c<b. When the shutter arm 18*a* is attached, since a portion b of the sector hole 23*e* is greater than the thickness of the snap-fit pawl 23*d* of the shutter arm 18*a*, the shutter arm 18*a* can be attached. As shown in FIG. 66A, in a condition that the drum shutter member 18 is opened, since the pawl 23*d* is located in the portion b, when the pawl 23*d* is flexed in opposition to elasticity and is inserted into the hole 23*e* as shown in FIG. 66A, a condition as shown in FIG. 66B is obtained.

As shown in FIGS. 10 to 17, the first guide portion 16*a* is located at a lower part of the guide member 16 and serves to guide the longitudinal guide 12*a* and the cylindrical guide 13*a* of the process cartridge B. On the first guide portion 16*a*, there are provided, from an upstream side to a downstream side, a main guide portion 16*a*1, a stepped portion 16*a*2, an escape portion 16*a*3, an auxiliary guide portion 16*a*4 and a positioning groove 16*a*5. The main guide portion 16*a*1 serves to guide the longitudinal guide 12*a* and the cylindrical guide 13*a*. The auxiliary guide portion 16*a*4 serves to guide the cylindrical guide to the positioning groove 16*a*5. The positioning groove 16*a*5 serves to receive the cylindrical guide 13*a*, thereby regulating the position of the process cartridge B. The second guide portion 16*b* is located at an upper part of the guide member 16 and serves to guide the widthwise guide 13*b*. On the second guide portion 16*b*, there are provided, from an upstream side to a downstream side in the process cartridge B inserting direction, a downwardly inclined surface 16*b*1 and a downstream escape portion 16*b*2.

In the cartridge mounting space S of the main body 14 of the apparatus, the fixed members (rotation regulating members) 25 secured to a stay 27 are disposed at both left and right side ends. The fixed members 25 serve to abut against the regulating abutment portions 13*e* to thereby prevent the process cartridge B from rotating in a clockwise direction in FIG. 15. When the cylindrical guides 13*a* are fitted into the positioning grooves 16*a*5 and the regulating abutment portions 13*e* abut against the fixed members 25, the process cartridge B is correctly mounted at the predetermined mounting position. As will be described later, when the process cartridge B is removed, the fixed members 25 abut against the releasing abutment portions 13*f* to permit the smooth removal of the process cartridge B.

Further, in the cartridge mounting space S, pressing members 26 are disposed at both left and right side ends (FIGS. 10 to 19A and 19B). Each pressing member 26 can be rotated around a fulcrum 26*b* and is biased in a clockwise direction (FIGS. 10 to 17) by an elastic force of a tension coil spring 26*a*. The pressing members 26 elastically urge the upper surface of the process cartridge B, thereby preventing vibration of the process cartridge B due to vibration of the main body 14 of the apparatus.

Next, a relationship between the mounting guide members 16 of the main body 14 of the apparatus and the guides 12*a*, 13*a*, 13*b* of the process cartridge B will be explained with reference to the accompanying drawings. FIGS. 10 to 15 are schematic views showing conditions from initiation of insertion of the process cartridge B to completion of the mounting of the process cartridge to the predetermined position. Only in FIGS. 10 and 15, the entire side of the process cartridge B is shown by the solid line, and the mounting guide member of the main body 14 of the apparatus is shown by the phantom line. In FIGS. 11 to 14 showing inserting steps of the process cartridge B, regarding the process cartridge B, only the guides are shown by the solid line, and the other is shown by the two dot chain line.

Figure 10:
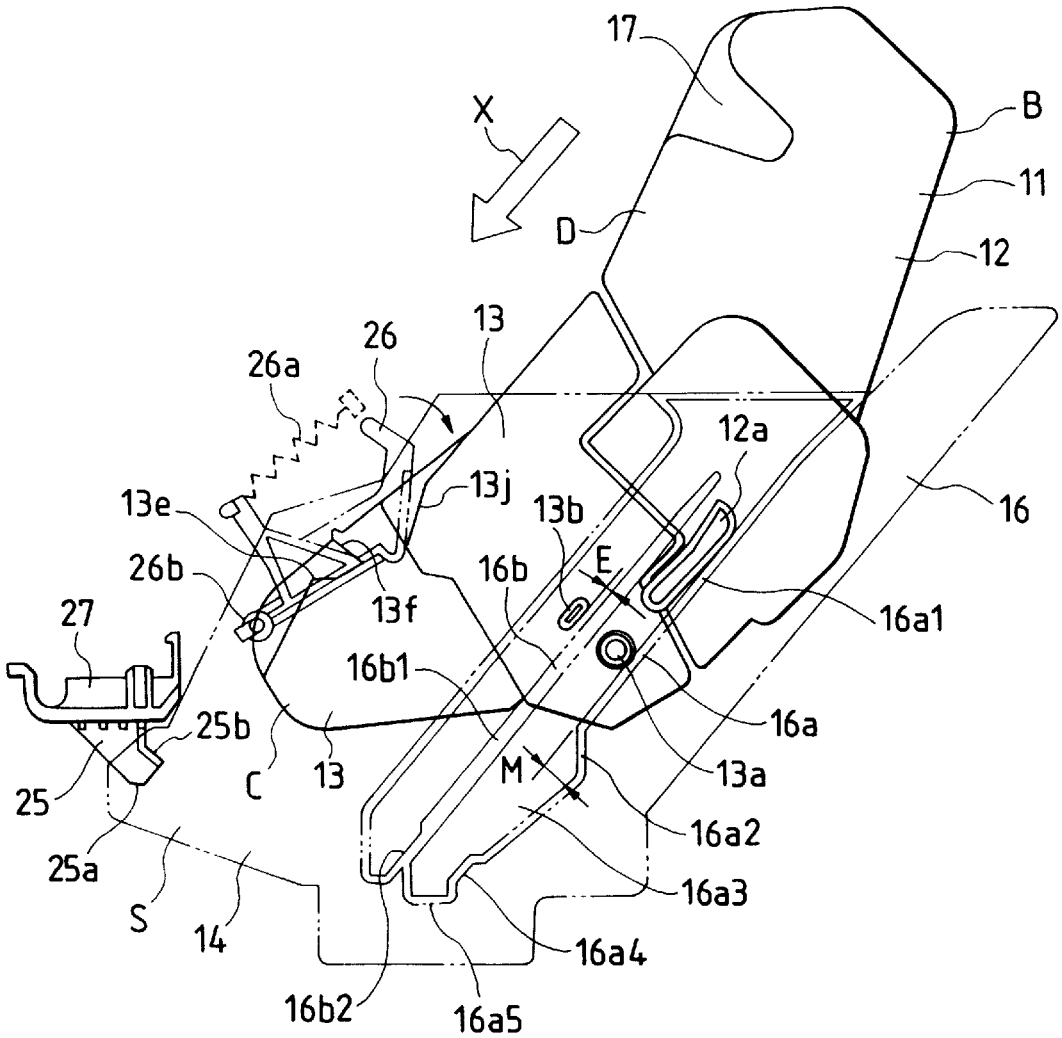
FIG. 10 is a side view showing a mounting and dismounting process for the process cartridge of FIG. 3 with respect to a main body of an image forming apparatus.

First of all, as shown in FIG. 10, when the process cartridge B is inserted into the main body 14 of the apparatus by the operator, the cylindrical guides 13*a* and the longitudinal guides 12*a* of the process cartridge B are guided on the first guide portions 16*a*. In this case, the widthwise guides 13*b* are not guided by the guide portions 16*b*, and the widthwise guides 13*b* are spaced apart from the respective second guide portions 16*b* by a predetermined distance E (about 2.0 to 4.0 mm in the illustrated embodiment).

In this case, not to obstruct the mounting of the process cartridge B, the pressing members 26 are rotated upwardly along the inclined surface 13*j* provided on the upper surface of the process cartridge B. As the process cartridge B is further inserted toward the rear side, the pressing members 26 slide on the upper surface of the process cartridge B, thereby preventing the process cartridge B from floating. Thereafter, while the process cartridge B is being mounted, the pressing members 26 continue to press the upper surface of the process cartridge B.

Figure 11:
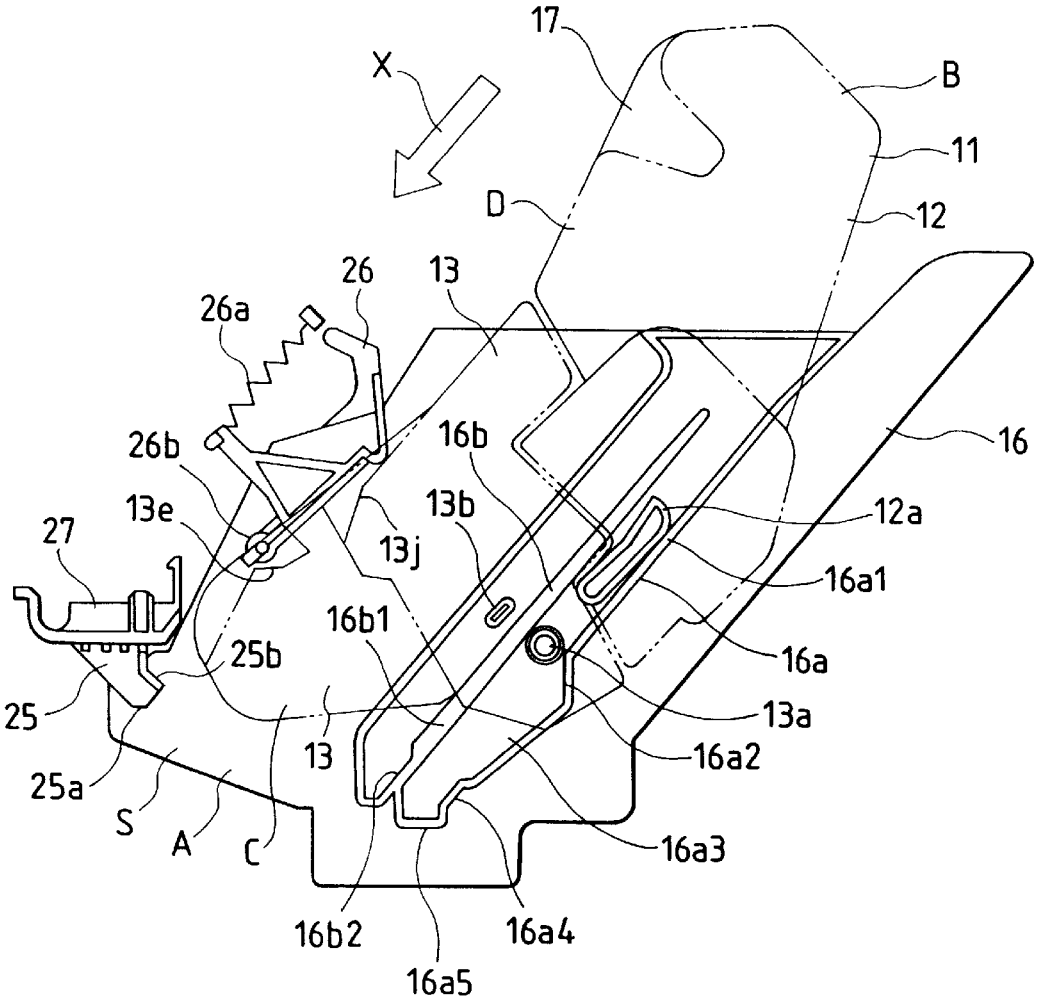
FIG. 11 is a side view showing a mounting and dismounting process for the process cartridge of FIG. 3 with respect to a main body of an image forming apparatus.

Then, when the process cartridge B reaches the condition shown in FIG. 11, the cylindrical guides 13*a* have passed through the stepped portions 16*a*2 formed on the first guide portions 16*a* and reach the escape portions 16*a*3. The escape portion 16*a*3 of the first guide portion 16*a* serves to allow the longitudinal guide 12*a* to escape when the process cartridge B reaches the predetermined position (refer to FIG. 15), and a depth M of the escape portion (refer to FIG. 10; about 4.0 to 8.0 mm in the illustrated embodiment) is selected to be greater than the aforementioned distance E (E<M). Incidentally, as shown in FIGS. 10 and 11, the widthwise guide 13*b* is not contacted with the second guide portion 16*b* (downwardly inclined surface 16*b*1).

Figure 12:
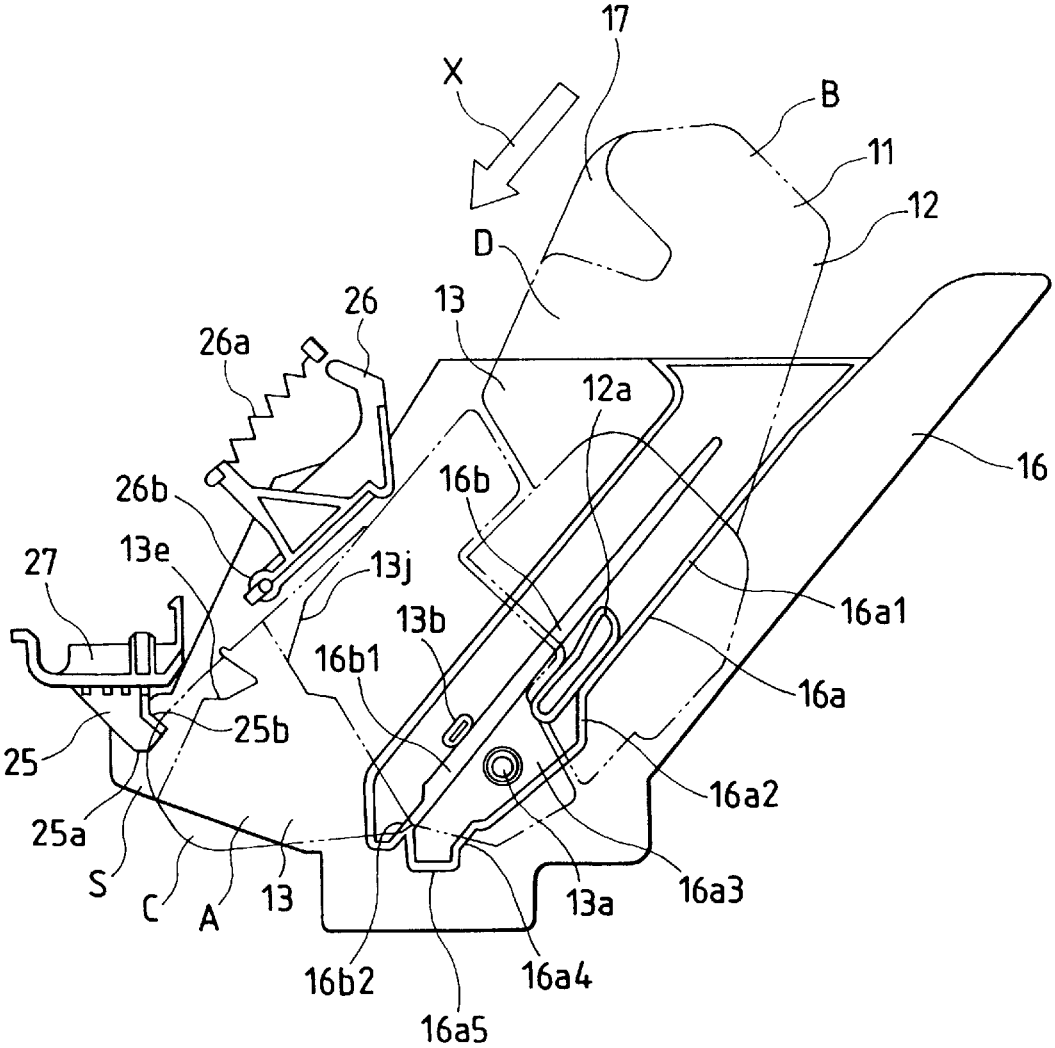
FIG. 12 is a side view showing a mounting and dismounting process for the process cartridge of FIG. 3 with respect to a main body of an image forming apparatus.

Accordingly, when the process cartridge B advances to the condition shown in FIG. 12, the widthwise guides 13*b* contact with the second guide portions 16*b* before the cylindrical guides 13*a* of the process cartridge B reach lower edges of the escape portions 16*a*3. That is to say, the longitudinal guides 12*a* and the widthwise guides 13*b* act as insertion guides for the process cartridge B, thereby suppressing any shock from the stepped portions of the process cartridge B.

Figure 13:
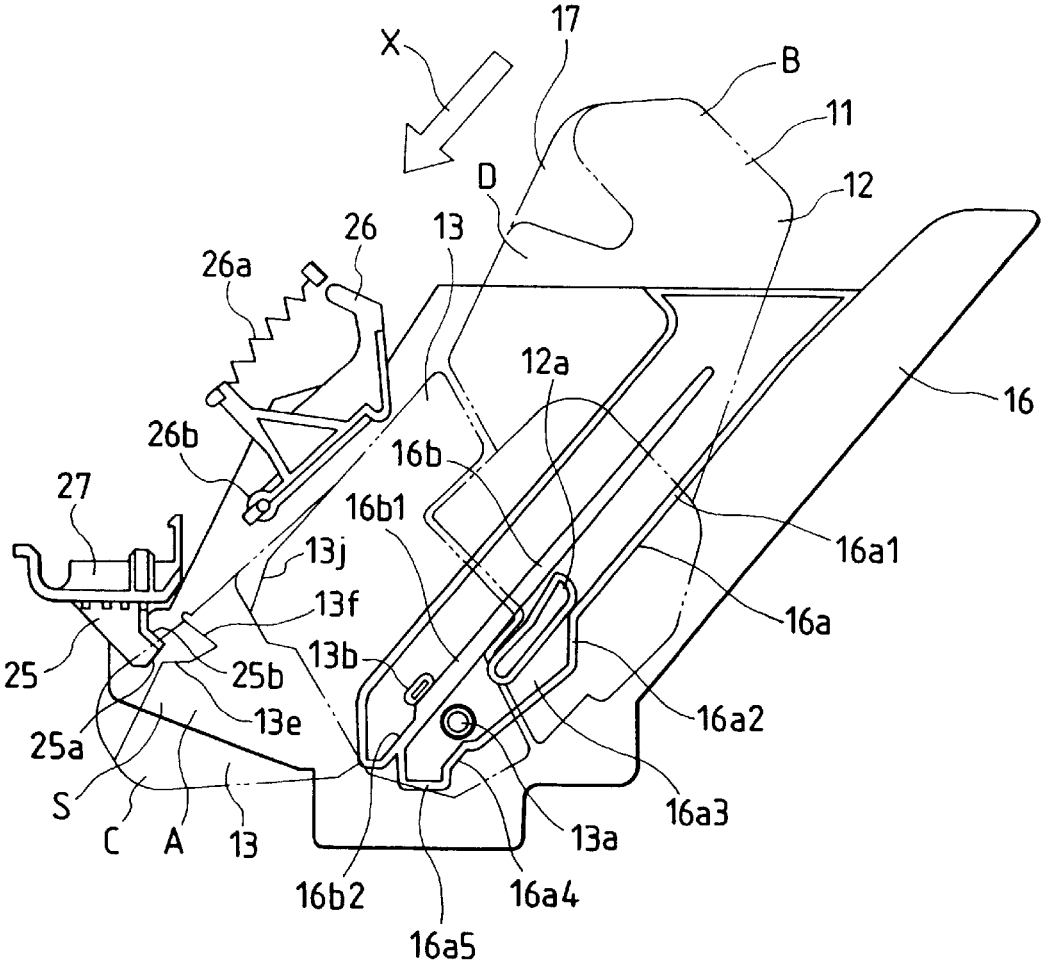
FIG. 13 is a side view showing a mounting and dismounting process for the process cartridge of FIG. 3 with respect to a main body of an image forming apparatus.

When the process cartridge B further advances to the condition shown in FIG. 13, the longitudinal guides 12*a* of the process cartridge B reach the escape portions 16*a*3 of the first guide portions 16*a*. As a result, the cylindrical guides 13*a* of the process cartridge B follow the auxiliary guide portions 16*a*4. In this case, the cylindrical guides 13*a* and the widthwise guides 13*b* of the process cartridge B are guided by the first and second guide portions 16*a*, 16*b*, respectively.

Figure 14:
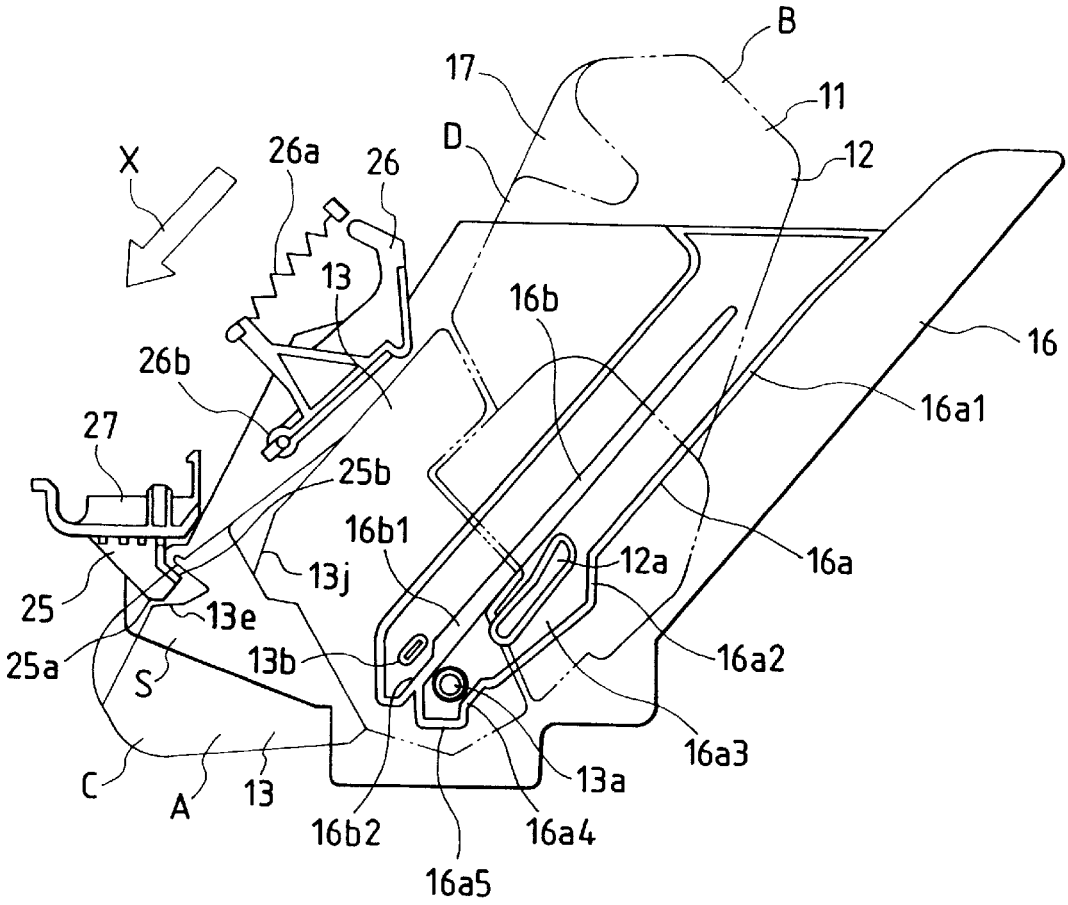
FIG. 14 is a side view showing a mounting and dismounting process for the process cartridge of FIG. 3 with respect to a main body of an image forming apparatus.
Figure 15:
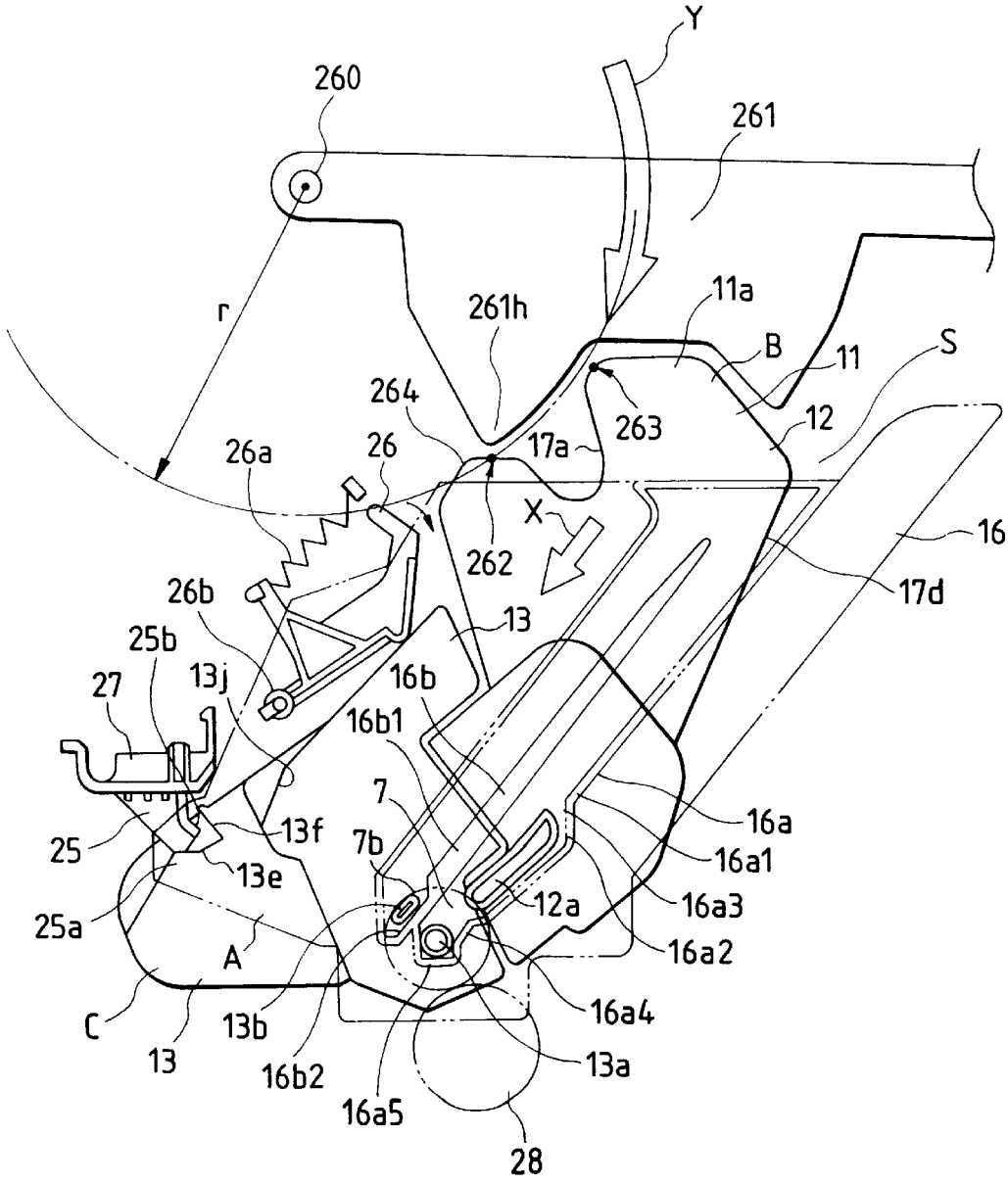
FIG. 15 is a side view showing a mounting and dismounting process for the process cartridge of FIG. 3 with respect to a main body of an image forming apparatus.

When the process cartridge B advances to the condition shown in FIG. 14, the widthwise guides 13*b* reach the escape portions 16*b*2 of the second guide portions 16*b*. While the widthwise guides 13*b* are escaped for a short time, only the cylindrical guides 13*a* follow the auxiliary guide portions 16*a*4. Lastly, the process cartridge B is slightly rotated in the counter-clockwise direction, with the result that the cylindrical guides 13*a* enter into the positioning grooves 16*a*5 of the first guide portions 16*a* (FIG. 15). Subsequently at the same time, the regulating abutment portions 13*e* formed on the cleaning frame body 13 abut against the rotation regulating portions 25*a* of the fixed members 25 of the main body 14 of the apparatus (FIG. 15). As a result, the position of the entire process cartridge B is determined. In this way, the process cartridge B is positioned around the cylindrical guides 13*a* so that the other guides (longitudinal guides 12*a*, widthwise guides 13*b*) are not contacted with any part of the guide members 16 of the main body 14 of the apparatus. Accordingly, the process cartridge B is positioned with high accuracy.

Incidentally, as will be described later, a positional relationship between the regulating abutment portion 13*e* and the rotation regulating portion 25*a* is selected to be able to support the moment caused by the driving of the process cartridge B. Further, a distance from a contact area between the regulating abutment portion 13*e* and the rotation regulating portion 25*a* to the center of the cylindrical guide 13*a* is selected to be greater than distances from the longitudinal guide 12*a* and the widthwise guide 13*b* to the center of the cylindrical guide 13*a*. Thus, the posture of the process cartridge B is further stabilized.

In the condition shown in FIG. 15, a helical drum gear 7*b* provided on one axial end of the photosensitive drum 7 is engaged by a drive helical gear 28 of the main body 14 of the apparatus. A driving force from the main body 14 of the apparatus is transmitted to the photosensitive drum 7 through the gears 28, 7*b*. When the driving force is transmitted from the helical gear 28 to the helical gear 7*b*, the process cartridge B is subjected to a force tending to rotate the drum in the clockwise direction in FIG. 15. Such movement of the process cartridge B is regulated by the regulating abutment portions 13*e*.

Further, the pressing members 26 press the process cartridge B from above. Thus, for example, even if the cylindrical guides 13*a* are not fitted into the grooves 16*a*5 of the main body 14 of the apparatus, the moment is generated around the contact portions between the rotation regulating portions 25*a* and the regulating abutment portions 13*e*, thereby fitting the cylindrical guides 13*a* into the positioning grooves 16*a*5 positively.

Next, the dismounting of the process cartridge B from the main body 14 of the apparatus will be explained with reference to FIGS. 16 and 17. Incidentally, a process cartridge B dismounting direction is shown by the arrow Y.

Figure 16:
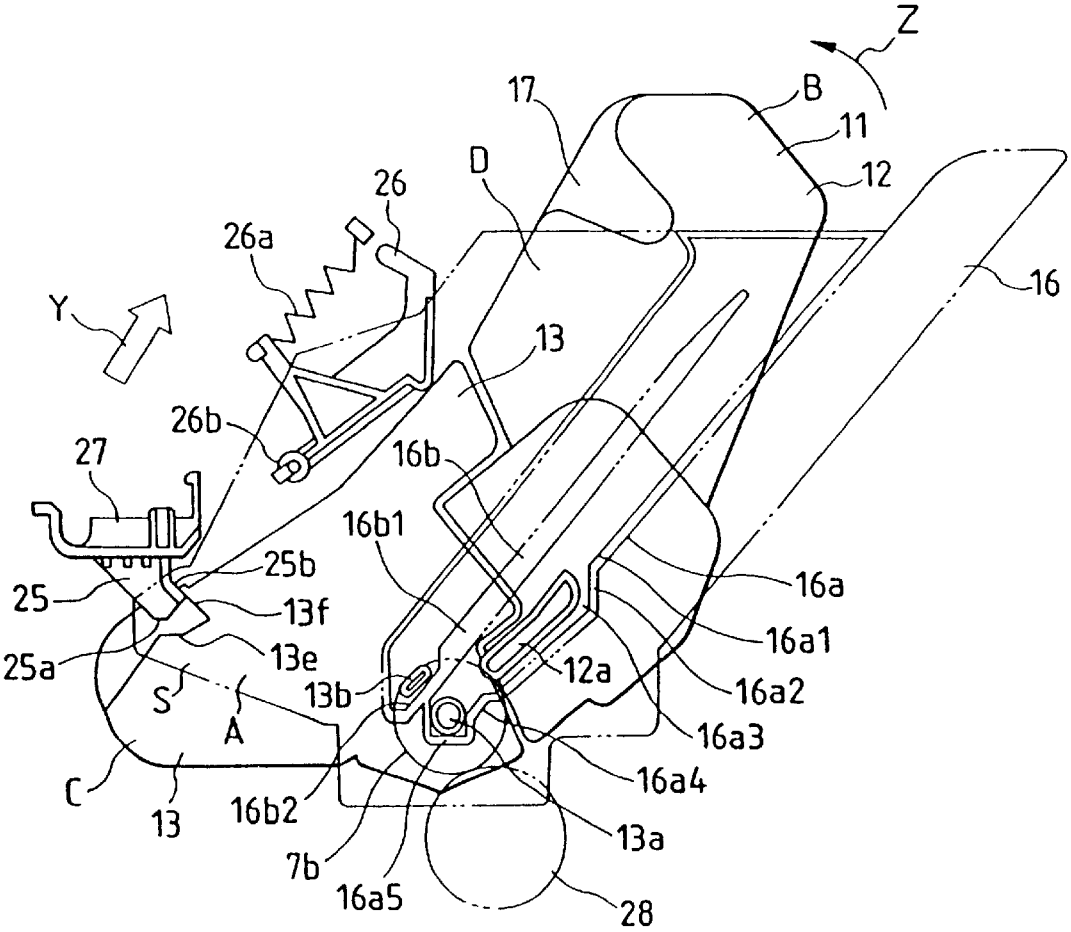
FIG. 16 is a side view showing a mounting and dismounting process for the process cartridge of FIG. 3 with respect to a main body of an image forming apparatus.

When the process cartridge B is dismounted, as shown in FIG. 16, the operator grips the grip portion 17 (portion of the toner frame body 11 downstream of the recessed portion of the developing frame body 12 in the dismounting direction) of the process cartridge B and lifts the grip portion 17 upwardly (direction shown by the arrow Z). As a result, the process cartridge B is rotated in the counter-clockwise direction around the cylindrical guides 13*a*. Then, the releasing abutment portions 13*f* of the process cartridge B abut against the releasing abutment portions 25*b* of the fixed portions 25 of the main body 14 of the apparatus. When the operator further lifts the process cartridge B, as shown in FIG. 17, the process cartridge B is rotated around contact portions between the releasing abutment portions 13*f* of the process cartridge B and the releasing abutment portion 25*b* of the fixed portions 25. By such action, the cylindrical guides 13*a* are lifted to disengaged from the positioning grooves 16*a*5. In this case, the engagement between the helical drum gear 7*b* and the drive helical gear 28 is smoothly released. In this condition, the process cartridge B is drawn straightly. As a result, the process cartridge B can be removed from the main body 14 of the apparatus in accordance with the sequences shown in FIGS. 14, 13, 12, 11 and 10 in order.

As mentioned above, according to the illustrated embodiment of the present invention, since the longitudinal guides (second guide members) extend in the cartridge inserting direction to straddle between the side surface of the developing unit D and the cleaning unit C, there is no play of the process cartridge during the mounting and dismounting thereof, thereby providing its stable insertion to improve operability.

Further, the guide means for guiding the mounting and dismounting of the process cartridge is constituted by the above-mentioned three guides (cylindrical guides 13*a*, longitudinal guides 12*a* and widthwise guides 13*b*), and, during the mounting and dismounting, the process cartridge B is guided by at least two guides. With this arrangement, even when the mounting guide members of the main body of the apparatus have the stepped portions, the shock acting on the process cartridge can be suppressed.

Further, the positioning of the process cartridge B is effected by the rotation regulating portions 25*a* disposed to support the moment generated by the driving of the process cartridge and the cylindrical guides 13*a*, and the other guides (longitudinal guides 12*a* and widthwise guides 13*b*) do not contact with the guide member of the main body of the apparatus. With this arrangement, during the driving (image formation), the posture of the process cartridge B can be more stabilized.

Incidentally, in the process cartridge B according to the illustrated embodiment, while an example that the guide means for guiding the mounting and dismounting of the process cartridge is constituted by three guide members was explained, the present invention is not limited to such an example, but, for example, the guide means may be constituted by only the cylindrical guides (first guide members) and the longitudinal guides (second guide members) or may be constituted by the above-mentioned three guides and additional guides.

Incidentally, as shown in FIGS. 9A and 9B, a spur gear 7*n* is provided on an axial end of the photosensitive drum 7 opposite to the end on which the drum gear 7*b* is provided. When the process cartridge B is mounted to the main body 14 of the apparatus, the spur gear 7*n* is engaged by a gear (not shown) coaxial with the transfer roller 4 provided within the main body 14 of the apparatus, with the result that a driving force for rotating the transfer roller 4 is transmitted from the process cartridge B.

A helical gear 9*u* provided on one axial end of the developing roller 9*c* is meshed with the helical drum gear 7*b* so that a driving force for rotating the developing roller 9*c* is transmitted from the helical drum gear 7*b*.

(Toner frame body)

Figure 30:
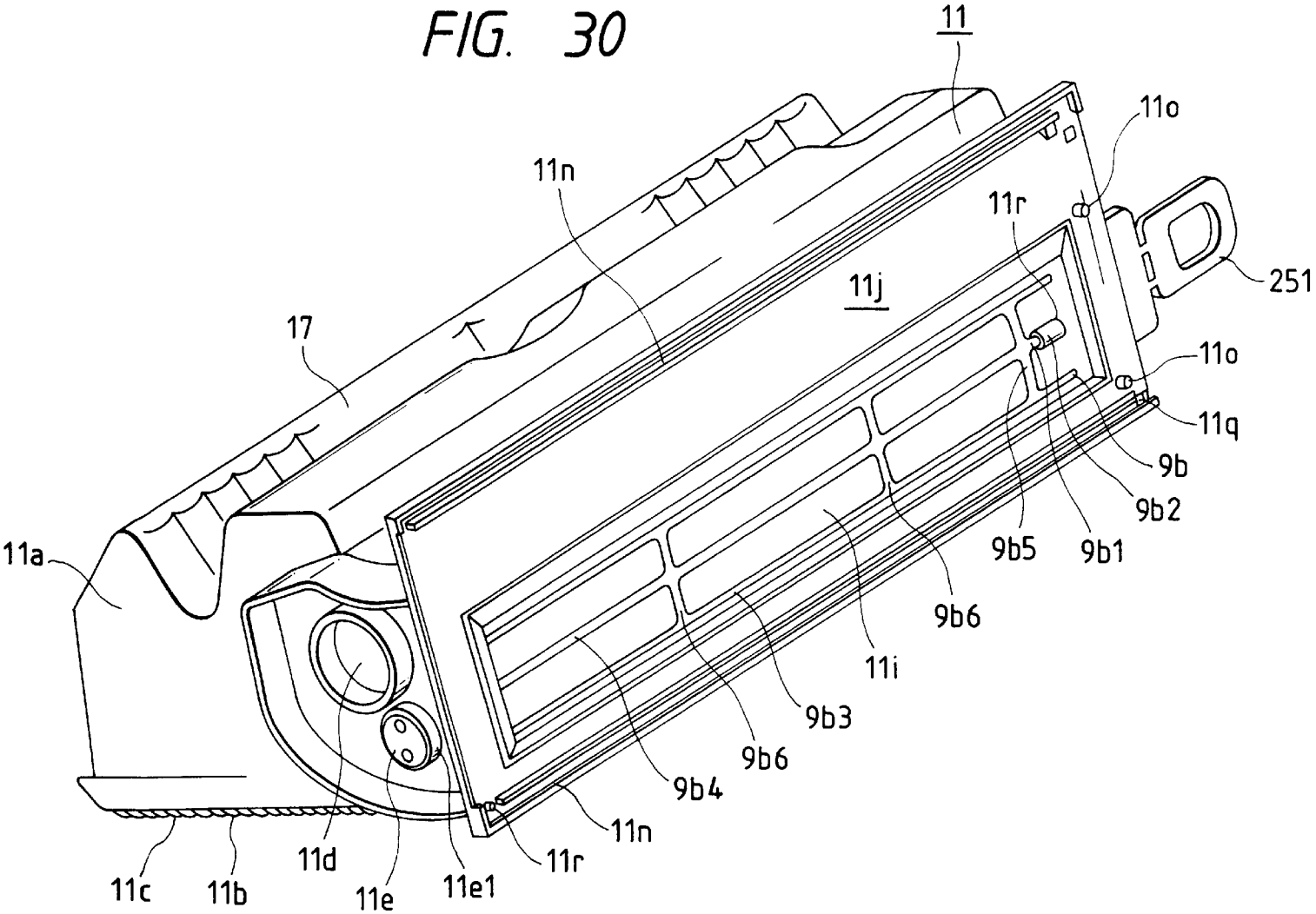
FIG. 30 is a perspective view of a toner frame.
Figure 31:
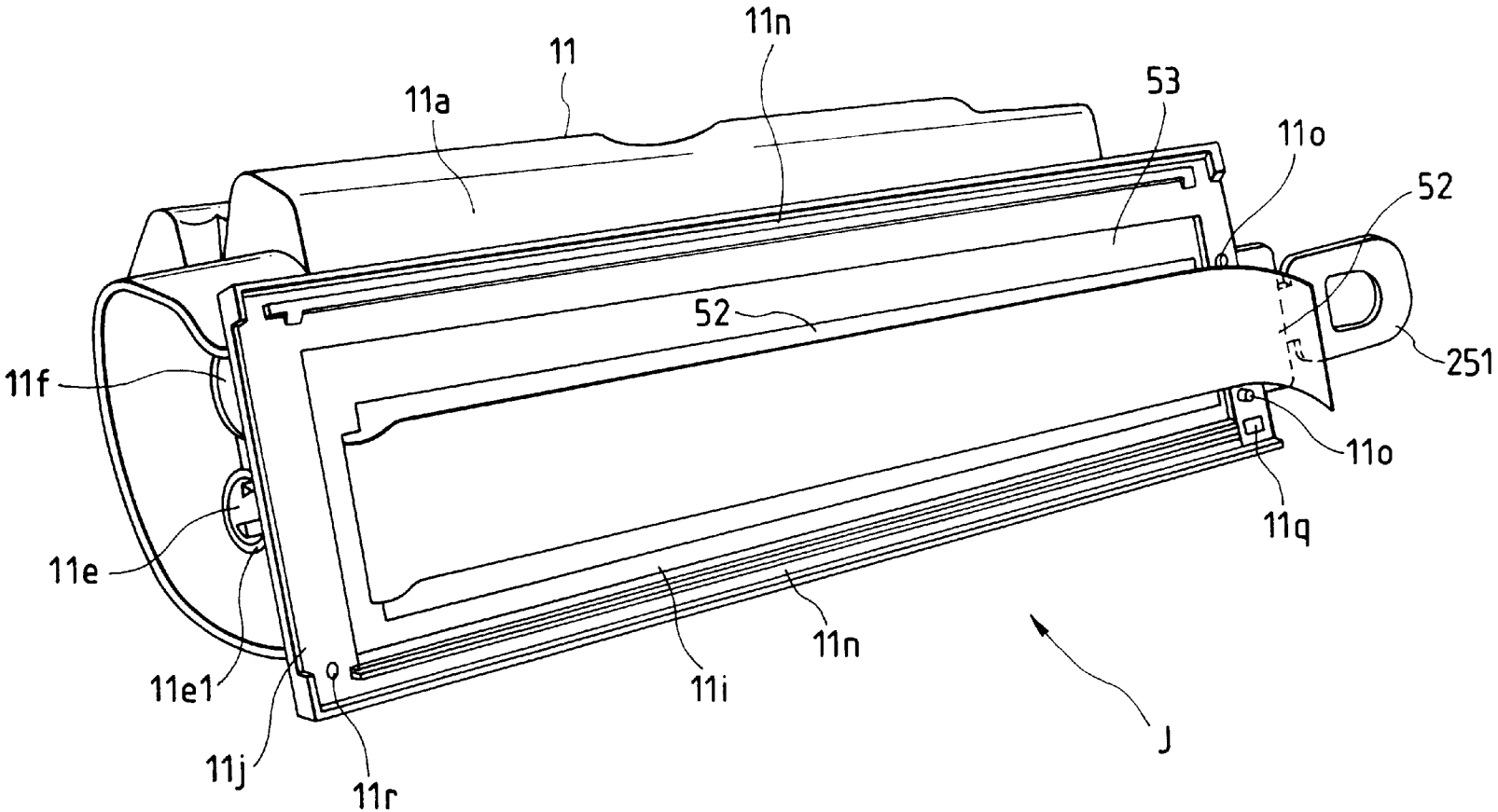
FIG. 31 is a perspective view of the toner frame after a toner seal is applied.
Figure 33:
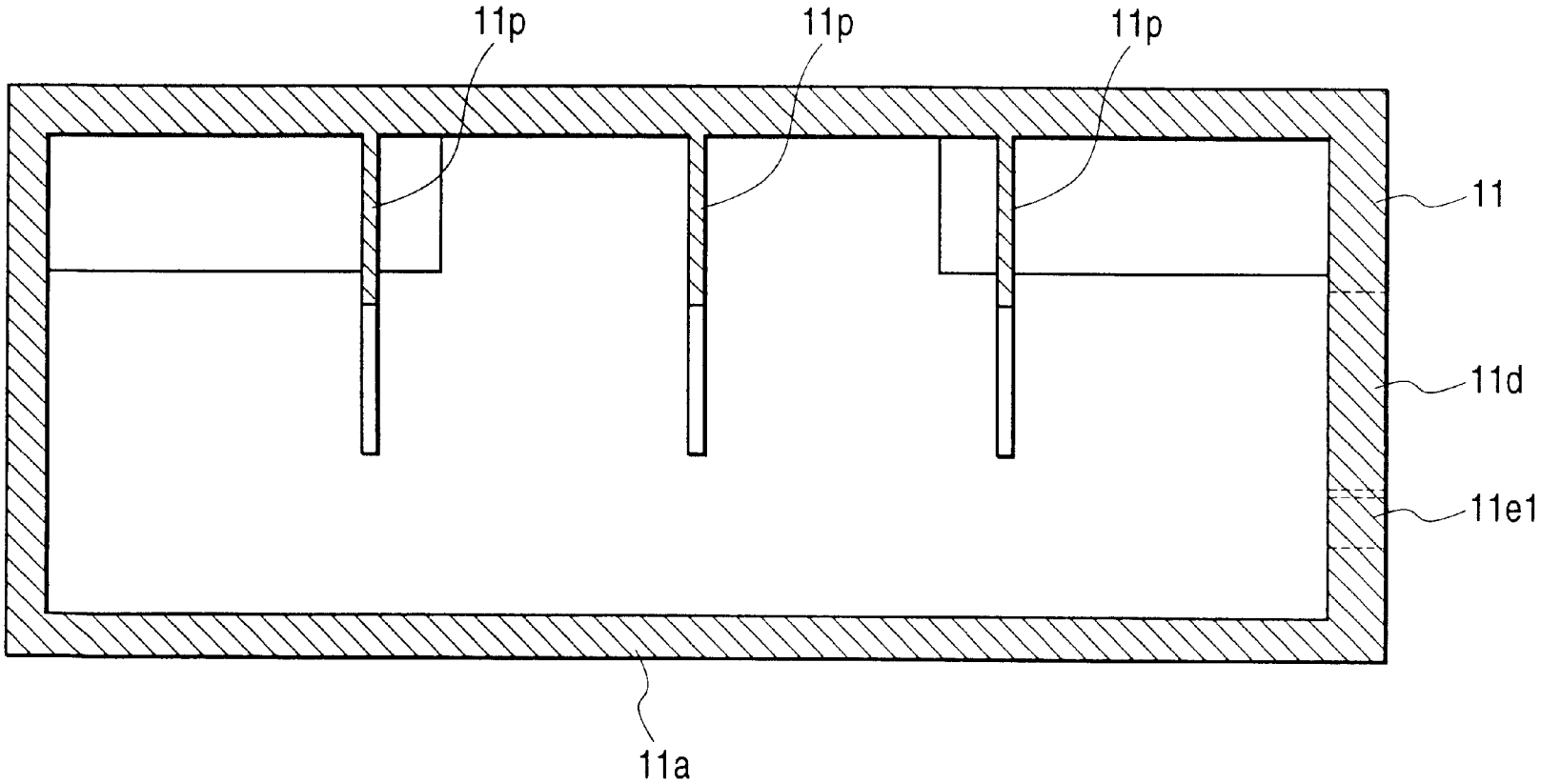
FIG. 33 is a sectional view taken along the line XXXIII—XXXIII in FIG. 3, showing interior of the toner frame.
Figure 34:
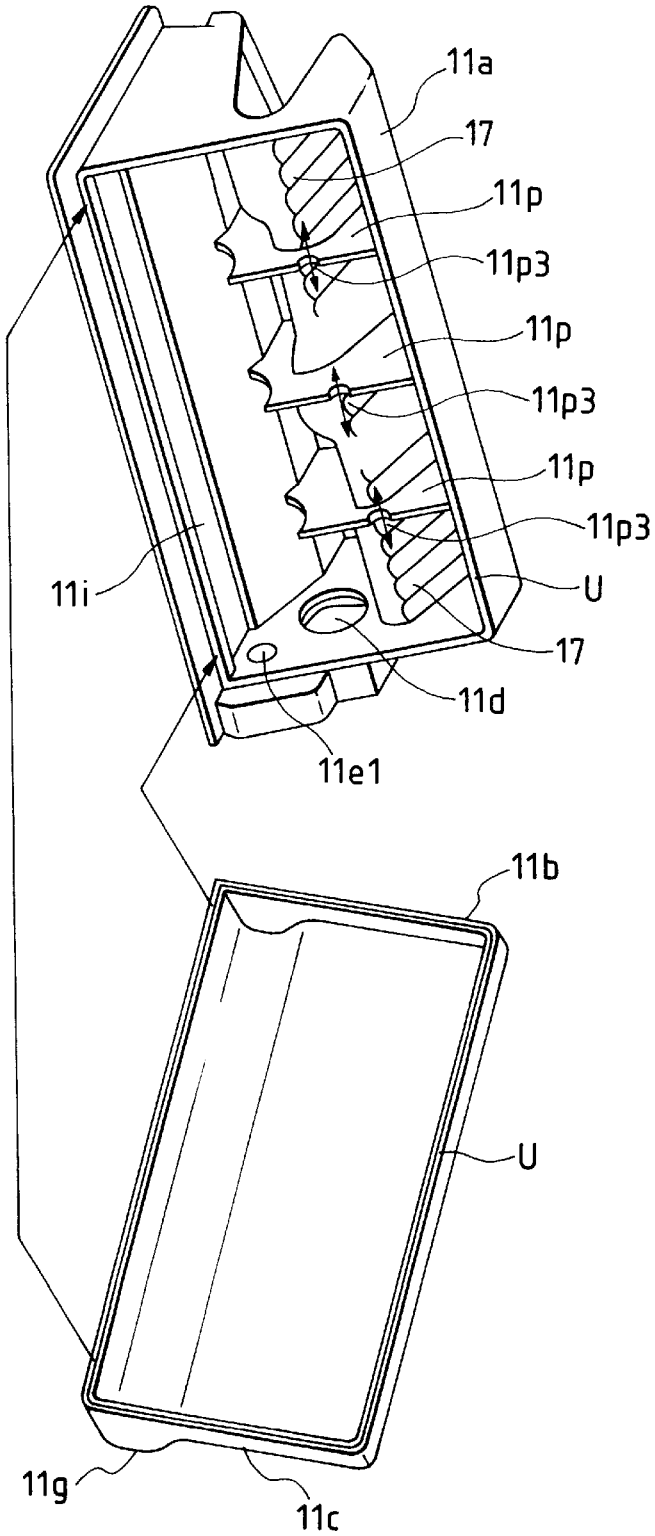
FIG. 34 is an exploded perspective view of the toner frame.

Now, the toner frame will be fully described with reference to FIGS. 3, 30, 31, 33 and 34. FIG. 30 is a perspective view showing a condition before a toner seal is welded, FIG. 31 is a perspective view showing a condition after toner is loaded, FIG. 33 is a plan view of an upper frame body 11*a*, and FIG. 34 is a perspective view showing a condition that the toner frame is disassembled.

As shown in FIG. 3, the toner frame body 11 is constituted by an upper frame body 11*a* and a lower frame body 11*b*. The upper frame body 11*a* is provided with the grip portion 17 defined by a recess extending in the longitudinal direction on the upper surface thereof. An outer surface of the lower frame body 11*b* which defines a bottom when the process cartridge B is assembled is provided with a plurality of longitudinal parallel ribs 11*c* spaced apart from each other by a distance of about 1 to 2 mm. The operator can grip the recess 17 and the ribs 11*c* with both hands. The ribs 11*c* provide s11*p* prevention when the operator grips the process cartridge B. The lower frame body 11*b* is mated with the upper frame body 11*a* at a welding surface U. By fusing welding ribs on the welding surface U by positive or forcible vibration, the frame bodies 11*a*, 11*b* are welded together. The welding method is not limited to vibration welding, but, for example, heat welding, ultrasonic welding or adhesive may be used. Incidentally, before the frame bodies 11*a*, 11*b* are joined together, the toner feed member 9*b* is incorporated within the upper frame body 11*a*. Further, coupling members 11*e* are incorporated through a hole 11*e*1 to lock both ends of the toner feed member 9*b* (condition shown in FIG. 30). The hole 11*e*1 is formed in one longitudinal end surface of the upper frame body 11*a*. And, a toner loading port 11*d* having a diameter of about 30 mm for loading the toner is formed in the same end surface in which the hole 11*e*1 is formed. The hole 11*e*1 and the toner loading port 11*d* are disposed side by side. Further, an opening portion 11*i* of the toner frame body 11 for supplying the toner from the toner frame body 11 to the developing frame body 12 is formed in the upper frame body 11*a* along the longitudinal direction, and the opening portion 11*i* is sealed by the seal (described later). Thereafter, the toner is fitted (loaded) through the toner loading port 11*d*. Then, the toner loading port 11*d* is closed by a toner cap 11*f*, thereby completing a toner unit J (FIG. 31). The toner cap 11*f* is formed from soft material such as polyethylene or polypropylene and is press-fitted into the loading port 11*d* not to be dislodged. The toner unit J is welded to the developing frame body 12 (described later) by ultrasonic welding, thereby providing the developing unit D shown in FIG. 9B. The welding method is not limited to the ultrasonic welding, adhesive or snap-fit utilizing elasticity may be used.

Further, as shown in FIG. 3, an inclined surface K of the lower frame body 11*b* of the toner frame body 11 preferably has an inclination angle θ that the toner is naturally dropped as the toner is consumed; that is, it is preferable that an angle θ between a horizontal line Z and the inclined surface K when the process cartridge B is mounted to the main body 14 of the apparatus in the condition that the main body 14 of the apparatus is in a horizontal state is about 60 degrees. A rotation area of the toner feed member 9*b* reaches below the inclined surface K. Accordingly, the lower frame 1*b* has a lower recessed portion 11*g* so as not to interfere with the rotation area of the toner feed member 9*b*. A rotation diameter of the toner feed member 9*b* is about 30 mm. (According to the illustrated embodiment, the recessed portion 11*g* is lowered from the bottom of the lower frame body 11*b* by about 4 mm. Incidentally, this value may be about 2.0 to 10 mm.) If the rotation area of the toner feed member 9*b* is located above the inclined surface K, when the toner naturally dropped along the inclined surface K from the upstream side reaches the toner feed member 9*b*, the toner between the toner feed member 9*b* and the inclined surface K will not be fed to the developing frame body 12 to remain there. However, in the illustrated embodiment, the toner can positively be fed from the toner frame body 11 to the developing frame body 12.

Incidentally, the toner feed member 9*b* is formed by blanking a flat plate having a thickness of about 1 mm and made of an iron group material. As shown in FIG. 30, the toner feed member has a rectangular outer frame 9*b*3 having a width of about 4 mm and a rotation center portion 9*b*4 to provide toner feeding ability and to suppress any increase in torque during rotation of the toner feed member. One of flat plate-shaped support portions 9*b*1 provided on opposed longitudinal ends 9*b*5 (one at a drive side is not shown) is inserted into a cylindrical rotary support member 9*b*2 which is pivotally connected to a circular hole 11*r* of the upper frame body 11*a* facing the opening portion 11*i*, and the other end at the drive side is secured to a coupling member 11*e*. A thrust movement of the coupling member 11*e* with respect to the toner frame body 11 is regulated by snap-fit or an E-ring. Incidentally, the outer frame 9*b*3 and the rotation center portion 9*b*4 are interconnected by arms 9*b*6 for reinforcement.

As mentioned above, by constituting the toner frame body 11 by the upper and lower frames 11*a*, 11*b* and by providing the recessed portion 11*g* in the bottom of the lower frame body 11*b* as the escape portion, the stable toner feeding ability can be achieved even in a large capacity process cartridge without increasing cost.

It is assumed that the toner and air in the toner frame body 11 are abruptly shifted due to vibration and/or shock during transportation of the process cartridge from a manufacturing factory to the user.

To cope with this, in the illustrated embodiment, a plurality of longitudinal partition plates 11*p* are provided within the upper frame body 11*a* of the toner frame body 11 (FIGS. 3, 33 and 34). In the illustrated embodiment, three partition plates 11*p* are provided. Each partition plate has a lower edge including an edge portion 11*p*1 facing the toner feed member 9*b* and surrounding the toner feed member 9*b* by about a quarter of its rotation circle, and an edge portion 11*p*2 contacted with the lower frame body 11*b* or slightly spaced apart from the lower frame with a small gap therebetween. The edge portion 11*p*1 facing the toner feed member 9*b* is located so that the toner loading port 11*d* is partially overlapped with the partition plate 11*p* in the longitudinal direction. Each partition plate 11*p* is provided with at least one notch 11*p*3.

In order to prevent the toner from moving within the toner container 11A, the partition plates 11*p* may be made as large as possible. However, when the toner is loaded through the toner loading port 11*d* directed upwardly, if the partition plate 11*p* is situated immediately below the toner loading port 11*d* and completely covers the toner loading port 11*i*, it will be difficult to fill the toner container 11A with the toner completely. Thus, when the partition plates 11*p* are configured as shown in the illustrated embodiment, since there is a space in the toner loading port 11*d* not covered by the partition plate 11*p*, the toner can be fully loaded. Further, since the partition plates 11*p* have a greater percentage of the cross-section of the toner frame body 11 in the direction perpendicular to the longitudinal direction, if vibration or shock is generated in the process cartridge B, the partition plates 11*p* prevent the movement of toner, thereby preventing compression of toner. The notch 11*p*3 formed in each partition plate 11*p* has an area of about 40 $mm^2$ sufficient to prevent the movement of toner and is disposed at a position spaced apart from the toner seal 52 (for example, at a center of a lower edge of the partition plate 11*p* facing the lower frame body 11*b*). The notch 11*p*3 is located remote from the upper frame body 11*a*, looked at from a side of the opening portion 11*i*. Thus, even if the air is moved in the toner frame body 11 due to vibration and/or shock of the process cartridge B, the air flow is abruptly stopped, and air shock caused by conversion from velocity energy of the air flow entraining the toner into pressure is suppressed, with the result that any load acting on the toner seal 52 is reduced, thereby preventing the toner seal from tearing. Particularly, if the air is confined between the partition plates 11*p* at the rear side of the toner frame body 11 looked at from a side of the opening portion 11*i*, air shock caused by injection of air into the toner can be avoided. Accordingly, the notches formed in the partition plates 11*p* are located at the rear side of the toner frame body 11 looked at from a side of the opening portion 11*i*. In the illustrated embodiment, while an example that the notches 11*p*3 are provided as passages for movement of air was explained, holes may be formed in the partition plates 11*p*.

(Construction of portion of the toner frame body opposed to the developing frame)

Figure 32B:
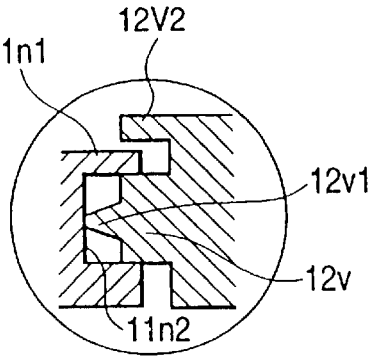
FIG. 32B shows a detail of FIG. 32A.
Figure 32A:
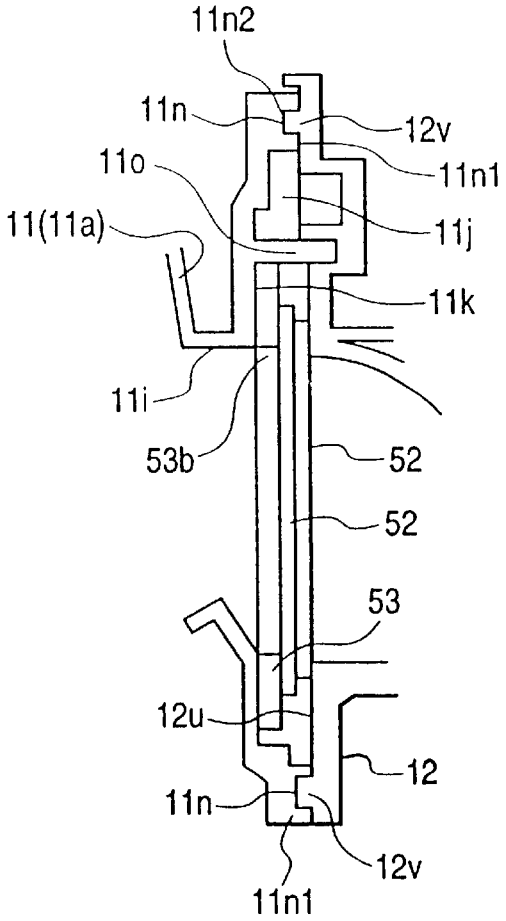
FIG. 32A is a longitudinal sectional view of the toner seal portion of FIG. 31.

As shown in FIGS. 3, 30 and 32, a joining portion of the toner frame body 11 to be joined to the developing framed 12 is provided with the opening portion 11*i* through which the toner is fed from the toner frame body 11 to the developing frame body 12. The surface 11*j* of the toner frame body 11 is provided at its longitudinal one end with pegs 11*o* for guiding the drawing of the toner seal 52, which pegs are located outside of a drawing path for the toner seal in the width-wise direction. Further, the surface 11*j* is provided at its both widthwise edges with longitudinal parallel grooves 11*n*, and bottoms 11*n*2 of the grooves 11*n* are protruded outwardly (toward the developing frame body 12) more than the surface 11*j* (FIGS. 32A and 32B).

A surface of the developing frame body 12 opposed to the toner frame body 11 is constituted by a single flat surface 12*u* having edge portions provided with longitudinal ridges 12*v* to be fitted into the grooves 11*n* of the toner frame body 11. Triangular projections 12*v*1 used in the ultrasonic welding are formed on top surfaces of the ridges 12*v* (FIGS. 32A and 32B). In a condition that the ridges 12*v* are fitted into the grooves 11*n*, the toner frame body 11 and the developing frame body 12 are welded together by ultrasonic welding along the longitudinal direction.

Figure 28:
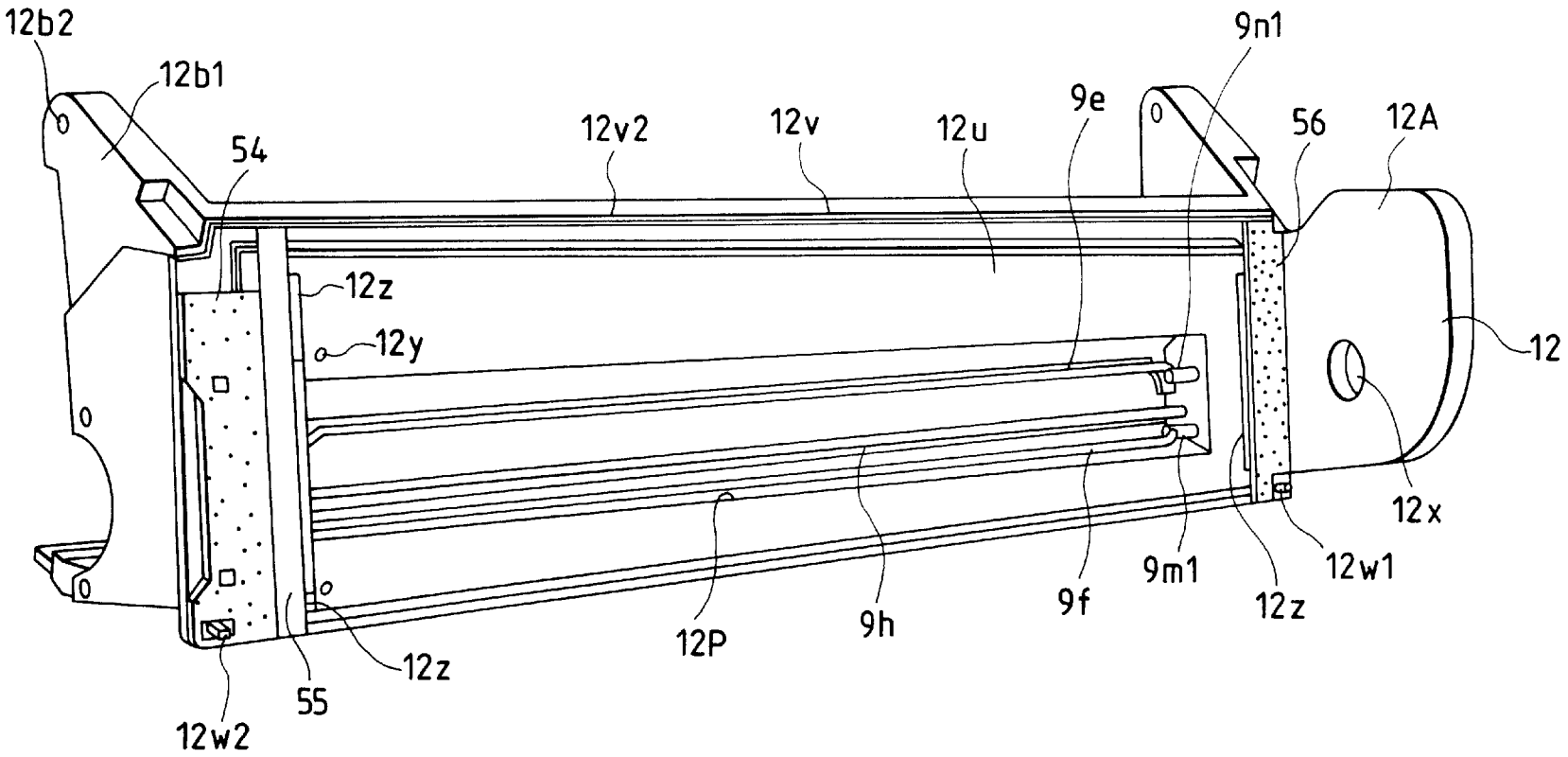
FIG. 28 is a perspective view of a developing frame.

As shown in FIGS. 31, 32A, and 32B, a cover film plate 53 having an opening portion 53*b* similar to the opening portion 11*i* is adhered to a toner seal surface 11*k* of the toner frame body 11 to close the opening portion 11*i*, the toner seal 52 which can easily be torn in the longitudinal direction is adhered to the cover film plate 53 by heat welding. The toner seal 52 is folded back at one longitudinal end of the opening portion 11*i*, and the folded portion extends out of the process cartridge between the toner frame body 11 and an elastic seal member 54 (FIG. 28) such as felt adhered to one longitudinal end of the flat surface of the developing frame body 12 opposed to the toner frame body 11. A free end of the folded portion of the toner seal 52 is adhered, by a both face adhesive tape, to a grip member 251 (FIGS. 6 and 31) by which the operator can draw the toner seal 52 from the process cartridge B. Incidentally, a tape 55 formed from synthetic resin film having small coefficient of friction is adhered to the surface of the seal member 54 at an inner end thereof. Further, an elastic seal member 56 is adhered to the surface 12*u* at the longitudinal end opposite to the longitudinal end to which the seal member 54 is adhered (FIG. 28).

When the toner frame body 11 is joined to the developing frame body 12, in order to facilitate alignment between the frames 11, 12, the surface 11*j* of the toner frame body 11 is provided with a circular hole 11*r* and a rectangular hole 11*q* which are fitted onto a cylindrical peg 12*w*1 and a prismatic peg 12*w*2 of the developing frame body 12, respectively. The circular hole 11*r* is closely fitted on the peg 12*w*1; while the rectangular hole 11*q* is fitted on the peg 12*w*2 with a small longitudinal gap therebetween. As mentioned above, the seal member 56 is adhered to the flat surface 12*u*. Further, the flat surface 12*u* of the developing frame body 12 opposed to the toner frame body 11 is provided with recessed portions 12*y* into which the pegs 11*o* of the toner frame body 11 is loosely fitted.

Figure 61:
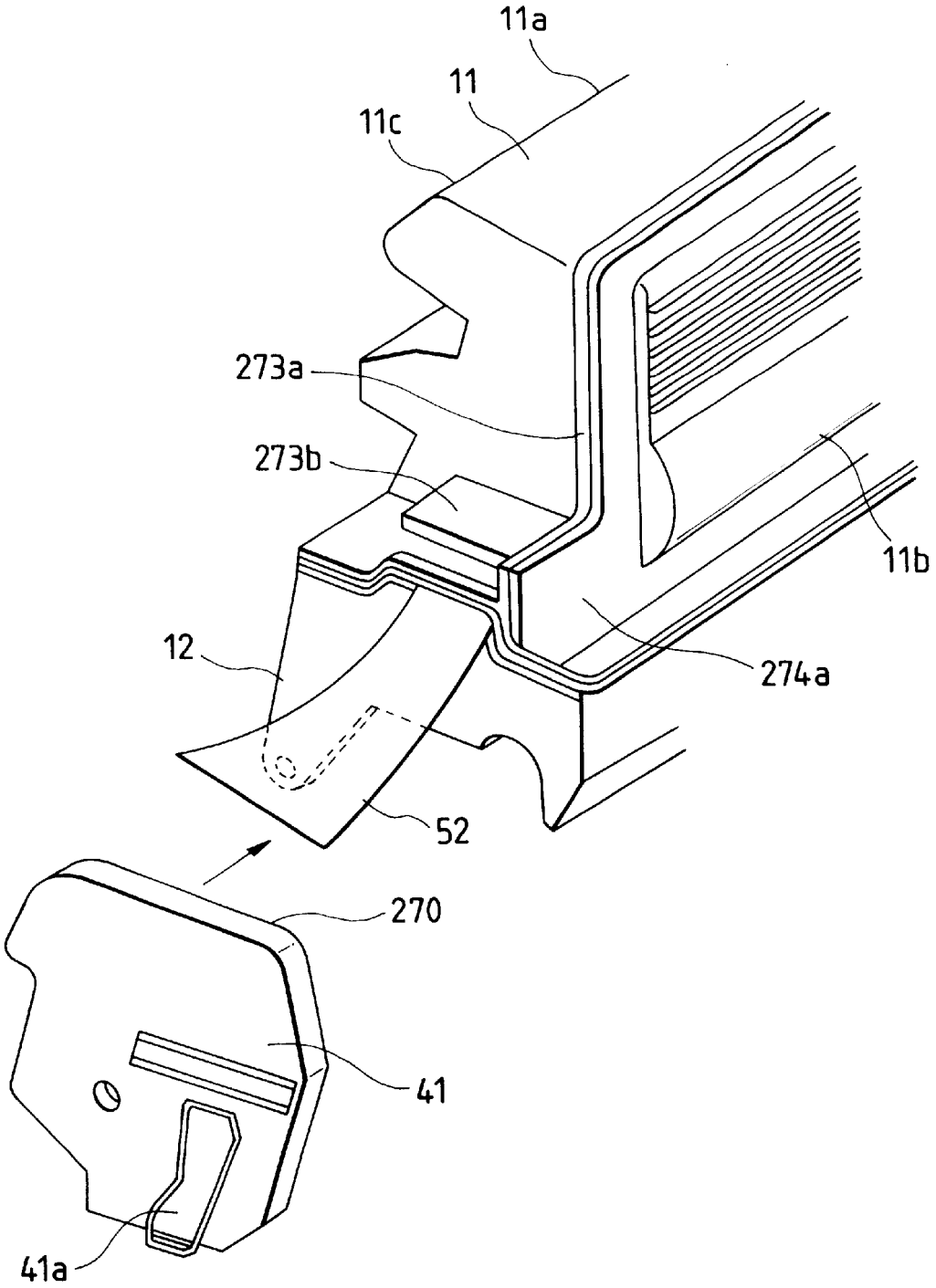
FIG. 61 is a perspective view showing a toner seal pulling portion of the toner frame and the developing frame and therearound.
Figure 62:
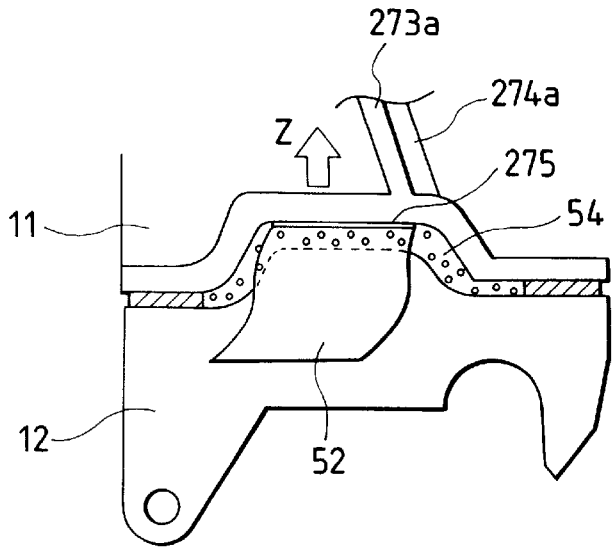
FIG. 62 is a side view showing a toner seal pulling portion of the toner frame and the developing frame and therearound.
Figure 65:
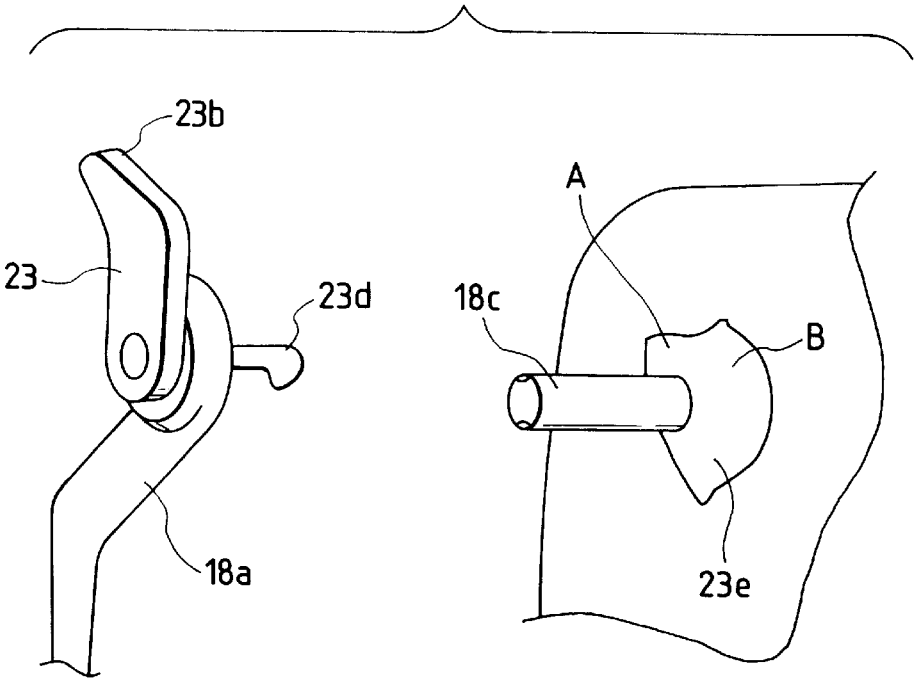
FIG. 65 is an exploded perspective view showing a dislodgment preventing mechanism for a drum shutter member.

When the toner frame body 11 is joined to the developing frame body 12, the toner frame body 11 and the developing frame body 12 are independently assembled as separate assemblies. Thereafter, the positioning cylindrical peg 12*w*1 and the positioning prismatic peg 12*w*2 of the developing frame body 12 are fitted into the positioning circular hole 11*r* and the positioning rectangular hole 11*q* of the toner frame body 11. Further, the ridges 12*v* of the developing frame body 12 are fitted into the grooves 11*n* of the toner frame body 11. Then, when the toner frame body 11 and the developing frame body 12 are urged against each other, the seal members 54, 56 are compressed, and ridges 12*z* (as spacers) formed on the flat surface 12*u* of the developing frame body 12 at both longitudinal ends thereof along the widthwise direction are approached to the surface 11*j* of the toner frame body 11. After the toner frame body 11 is welded to the developing frame body 12, the toner frame body 11 is subjected to a force direction toward a direction shown by the arrow z (FIG. 62) from the seal member 54 to tend to widen an opening portion 275 which is formed at a longitudinal end between the toner frame body 11 and the developing frame body 12 and through which the toner seal 52 extends. However, since the toner upper frame body 11*a* and the lower frame body 11*b* welded to the toner upper frame body 11*a* are provided with reinforcing ribs 273*a*, 274*a* and a reinforcing rib 273*b* perpendicular to the reinforcing rib 273*a* (FIG. 61) in the vicinity of the toner seal opening portion 275, the opening portion 275 is prevented from being widened, thereby avoiding sealing unevenness for every seal members 54. In order to permit the drawing of the toner seal 52, the ridges 12*z* are arranged only on both sides of the toner seal 52 in the widthwise direction.

(Back-up of the developing holder)

By abutting (backing-up) the reinforcing ribs 273*a*, 274*a* of the toner upper frame body 11*a* and the lower frame body 11*b* welded to the toner upper frame body 11*a* in the vicinity of the toner seal opening portion 275 against a back surface 270 of the developing holder 41, the developing holder 41 is prevented from cracking due to shock if the process cartridge is dropped and is prevented from dropping when the process cartridge B is mounted to the main body 14 of the apparatus. At this area, a gap may be formed between the developing holder 41 and the reinforcing ribs 273*a*, 274*a* to permit deformation of the developing holder 41, and the gap between back surface 270 of the developing holder 41 and the reinforcing ribs 273*a*, 274*a* may be 0.5 to 3.0 mm, and preferably about 1.0 mm.

In the above-mentioned condition, ultrasonic vibration is applied between the ridges 12*v* and the grooves 11*n* while the toner frame body 11 is being urged against the developing frame body 12, with the result that the triangular projections 12*v*1 are fused by friction heat, thereby welding the ridges to the bottoms of the grooves 11*n*. As a result, edges 11*n*1 of the grooves 11*n* of the toner frame body 11 and the ridges (spacers) 12*z* of the developing frame body 12 are closely contacted with the associated members, thereby defining a space having a sealed periphery between the surface 11*j* of the toner frame body 11 and the opposed flat surface 12*u* of the developing frame body 12. The toner seal 52 is housed within such a space.

In order to feed out the toner contained in the toner frame toward the developing frame body 12, by pulling the end 52*a* (FIG. 6) of the toner seal 52 protruded out of the process cartridge B by the operator, the toner seal 52 is torn to unseal the opening portion 53*b* (11*i*), thereby permitting the transfer of the toner from the toner frame body 11 to the developing frame body 12.

Since the opposed surfaces of the toner frame body 11 and the developing frame body 12 is constructed as mentioned above, the toner seal 52 can be drawn smoothly between the frames 11, 12.

Further, when the toner frame body 11 is welded to the developing frame body 12 by the ultrasonic welding, friction heat is generated to fuse the triangular projections 12*v*1. By such friction heat, thermal stress may act on the toner frame body 11 and the developing frame body 12 to deform them. However, according to the illustrated embodiment, since the ridges 12*v* of the developing frame body 12 are fitted into the grooves 11*n* of the toner frame along the substantially entire longitudinal range, in the condition that the frame bodies 11, 12 are joined together, areas around the welded portions are reinforced to be hard to generate thermal deformation due to thermal stress.

Further, if burrs are formed when longitudinal ribs 12*v*2 of the developing frame body 12 are welded to the developing frame body 12 by friction heat, as shown in FIGS. 32A and 32B, since the longitudinal ribs 12*v*2 formed on the edges of the developing frame body 12 cover edges 11*n*1 of the toner frame body 11, such burrs are prevented from being exposed outwardly.

(Another example of an openable and closable cover of cartridge mounting portion of the main body of apparatus)

In the condition the process cartridge B is mounted to the cartridge mounting portion S as shown in FIG. 15, a main body cartridge cover 261 used in place of the openable and closable member 35 makes clearance substantially uniform and minimizes such clearance in the vicinity of the grip portion 17 of the process cartridge B.

More specifically, points 262, 263 for determining the configuration of the grip portion 17 of the upper frame body 11*a* of the process cartridge B are selected to be spaced apart from a rotation center 260 around which the cartridge cover 261 is pivotally connected to the main body 14 of the apparatus by a distance corresponding to a radius r.

The configuration of the grip portion 17 is determined on the basis of the points 262, 263 so selected. As a result, as shown in FIGS. 4 and 7, except a portion of a recessed portion 17*b* opposed to a finger hooking portion 17*a* against which the operator hooks his fingers when the process cartridge B is mounted and dismounted with respect to the main body 14 of the apparatus and a finger hooking portion 17*e* (FIG. 37) having the ribs 11*c*, the clearance between the main body 14 of the apparatus and the process cartridge B becomes substantially uniform in the entire area looked at from a radial direction from the center of the photosensitive drum 7. Incidentally, the recessed portion 17*b* is a recess formed in a flat surface 17*d* opposed to the finger hooking portion 17*a*.

Figure 60:
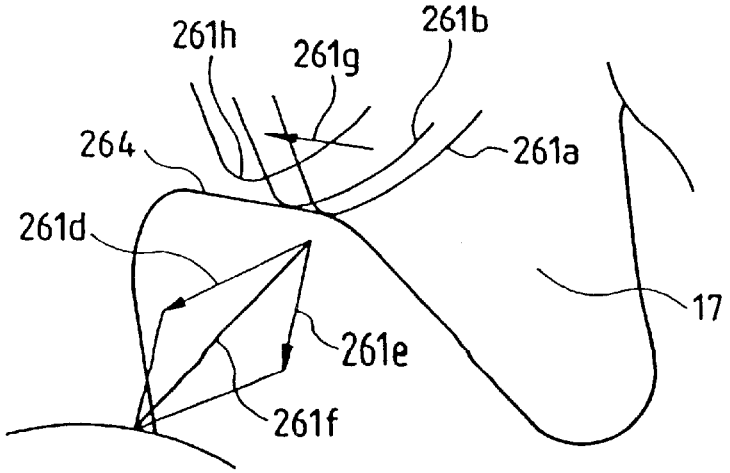
FIG. 60 is an enlarged view showing a part of FIG. 15.

As shown in FIGS. 15 and 60, a flat surface (horizontal surface) 264 is provided in the vicinity of the point 262 on the toner upper frame body 11*a* spaced apart from the rotation center 260 of the cartridge cover by the distance corresponding to the radius r and determined as mentioned above, so that the process cartridge B can smoothly be moved in the inserting direction X when the process cartridge B is mounted to the cartridge mounting portion S.

More specifically, by making the surface 264 flat, as shown in FIG. 60 which is an enlarged view showing a part of FIG. 15, displacement 261*f* obtained by composing displacement 261*d* of the process cartridge B caused by a lower end 261*h* of the cartridge cover 261 with displacement 261*e* of the process cartridge B caused by its own weight has a vector directing substantially toward the process cartridge inserting direction X. In this case, a movement (relative movement) of the body cartridge cover 261 with respect to the flat surface 264 of the process cartridge is effected along a direction 261*g* and has a vector parallel to the flat surface 264 of the cartridge.

By keeping the flat surface 264 of the cartridge horizontal, even if the process cartridge B is not located in the proper position, the cartridge cover 261 is shifted from a point 261*a* to a point 261*b* so that the process cartridge B can be pushed up to the proper position by the body cartridge cover 261.

As mentioned above, the upper frame is integrally formed to include the grooves 11*n*, grip portion recessed portion 17, (finger hooking portions 17*a*, 17*c*, 17*e*), partition plates 11*p*, toner loading port 11*d*, hole 11*e*1, circular hole 11*q*, rectangular hole 11*q*, attachment portion for the cover film plate 53 (toner seal surface 11*k*), pegs 11*o* and opening portion 11*i*. Further, the lower frame body 11*b* is integrally formed to include the ribs 11*c* and recessed portion 11*g*. Material for forming the upper frame body 11*a* and the lower frame body 11*b* may be plastic such as polystyrene, ABS resin (acrylonitrile/butadiene/styrene copolymer), polycarbonate, polyethylene or polypropylene. Incidentally, as shown in FIG. 7, regarding the finger hooking portions 17*a*, 17*c*, undulations are formed on either or both of opposed walls to change a dimension of the recessed portion in a narrower manner in order that the operator's fingers hooked to the grip portion 17 are hard to be shifted in the longitudinal direction. Further, as shown in FIG. 3, the lower finger hooking portion 17*e* of the grip portion 17 includes the longitudinal protruded ribs 11*c* in order that the operator's fingers hooked to the finger hooking portion are hard to shift in the widthwise direction, and the ribs 11*c* on which the operator's fingers are hooked form a mountain as a whole.

Figure 37:
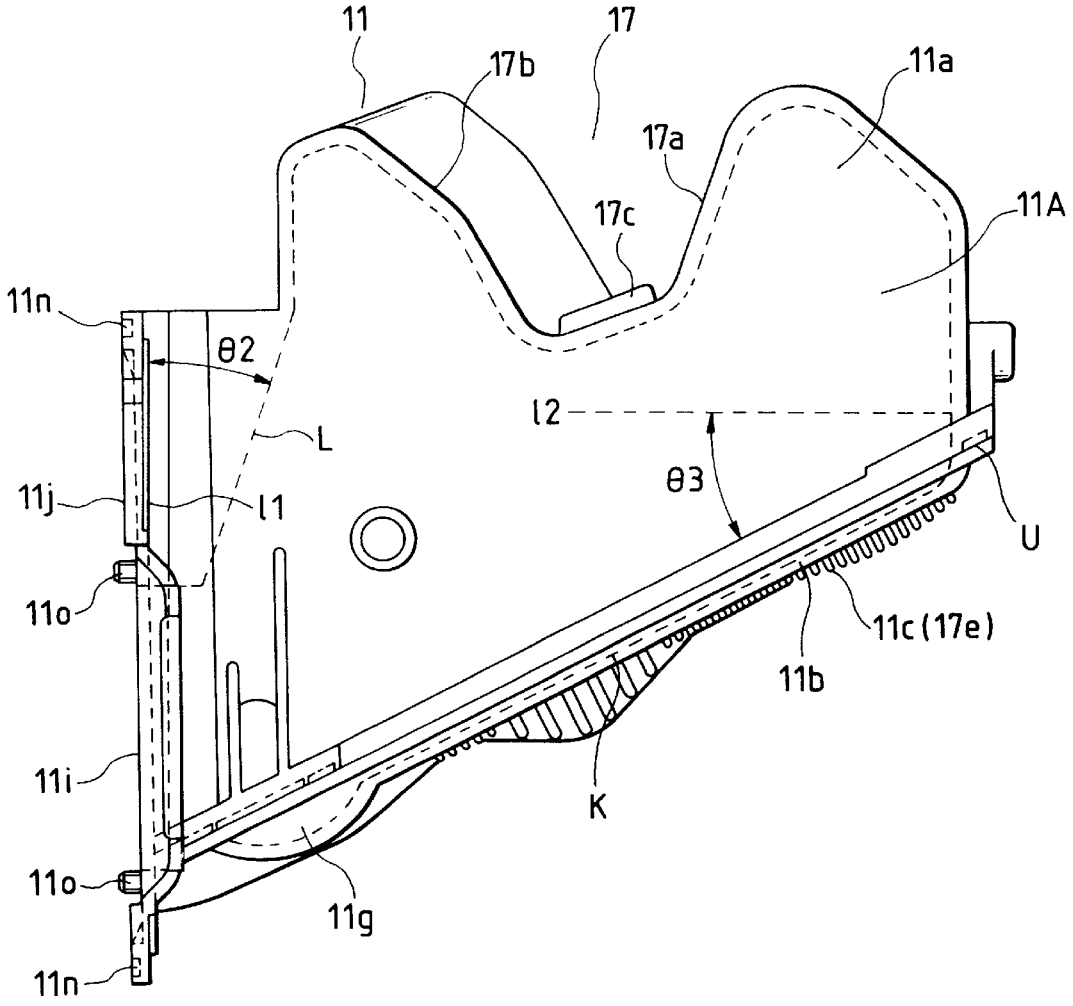
FIG. 37 is a side view of the toner frame.

FIG. 37 is a side view of the toner frame used in the illustrated embodiment. More specifically, FIG. 37 is a side view of the toner frame body 11 showing a condition that the joining surface 11*j* through which the toner frame body 11 and the developing frame body 12 are joined together is positioned vertically.

The toner frame body 11 used in the illustrated embodiment has two inclined surfaces K, L for efficiently dropping one-component toner contained in the toner container 11A toward the opening portion 11*i*. The inclined surfaces K, L are formed along the entire longitudinal width. The inclined surface L is disposed above the opening portion 11*i*, and the inclined surface K is disposed at a rear side of the opening portion 11*i* (widthwise direction of the toner frame body 11). Further, the inclined surface L is formed on the upper frame body 11*a* and the inclined surface K is constituted by the lower frame body 11*b*. The inclined surface L is inclined with a vertical straight line 11 (joining surface 11*j*) by an angle θ2 of about 10 to 40degrees (θ2=about 24 degrees in the illustrated embodiment). Further, the inclined surface K is inclined with respect to a horizontal line 12 perpendicular to the straight line 11 by an angle θ3 of about 20 to 40 degrees (θ3=about 27 degrees in the illustrated embodiment). In other words, in the illustrated embodiment, the configuration of the upper frame body 11*a* is determined so that the lower frame body 11*b* can be installed at the above-mentioned installation angle when the upper frame body 11*a* is joined to the lower frame body 11*b*. Thus, according to the illustrated embodiment, even in the toner containing portion 11A containing a large amount of toner (toner having a weight of about 800 grams or more), the toner can efficiently be supplied toward the opening portion 11*i*.

Next, the developing frame body will be explained in more detail.

(Developing frame body)

Figure 27:
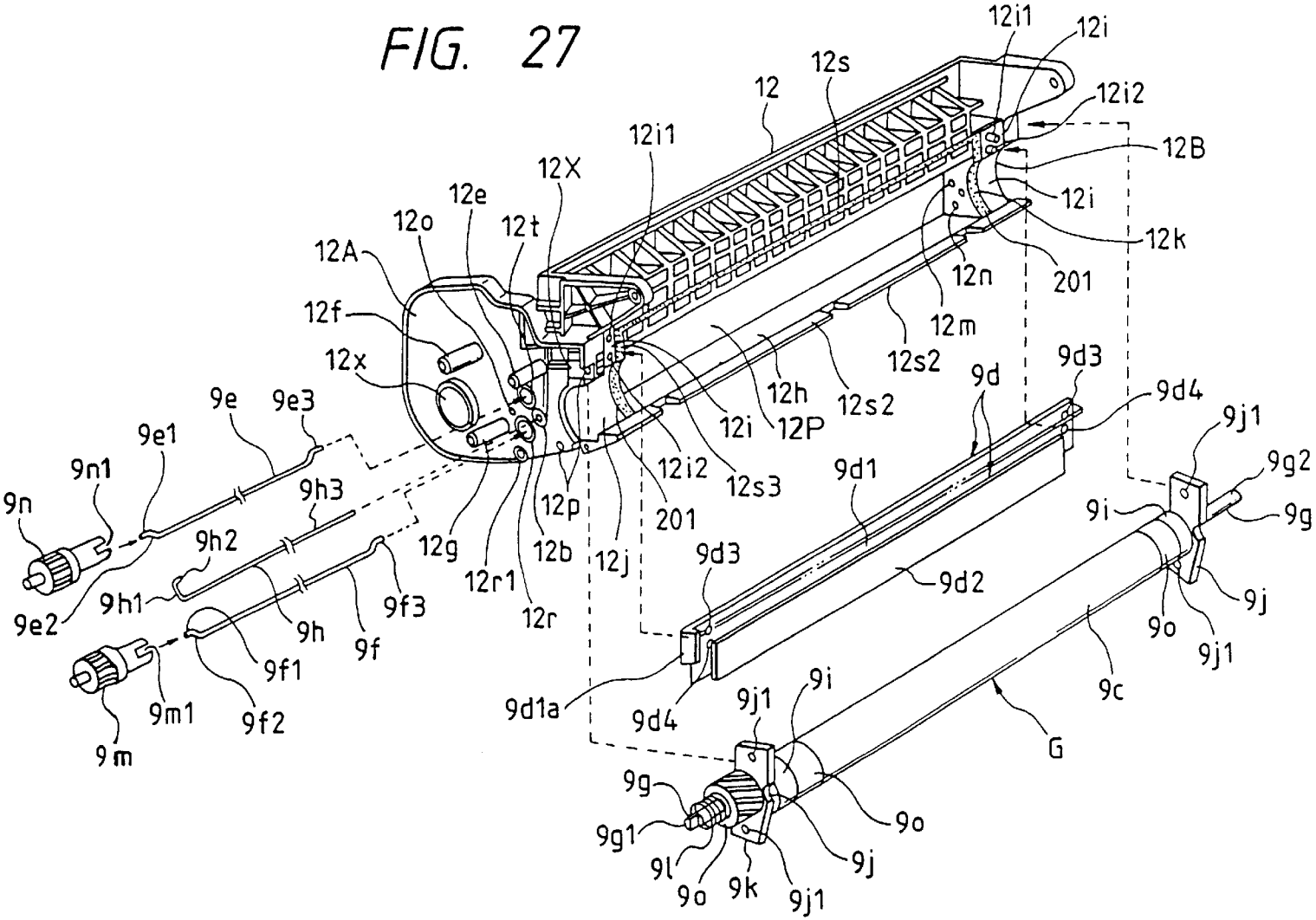
FIG. 27 is an exploded perspective view of the developing unit.
Figure 29:
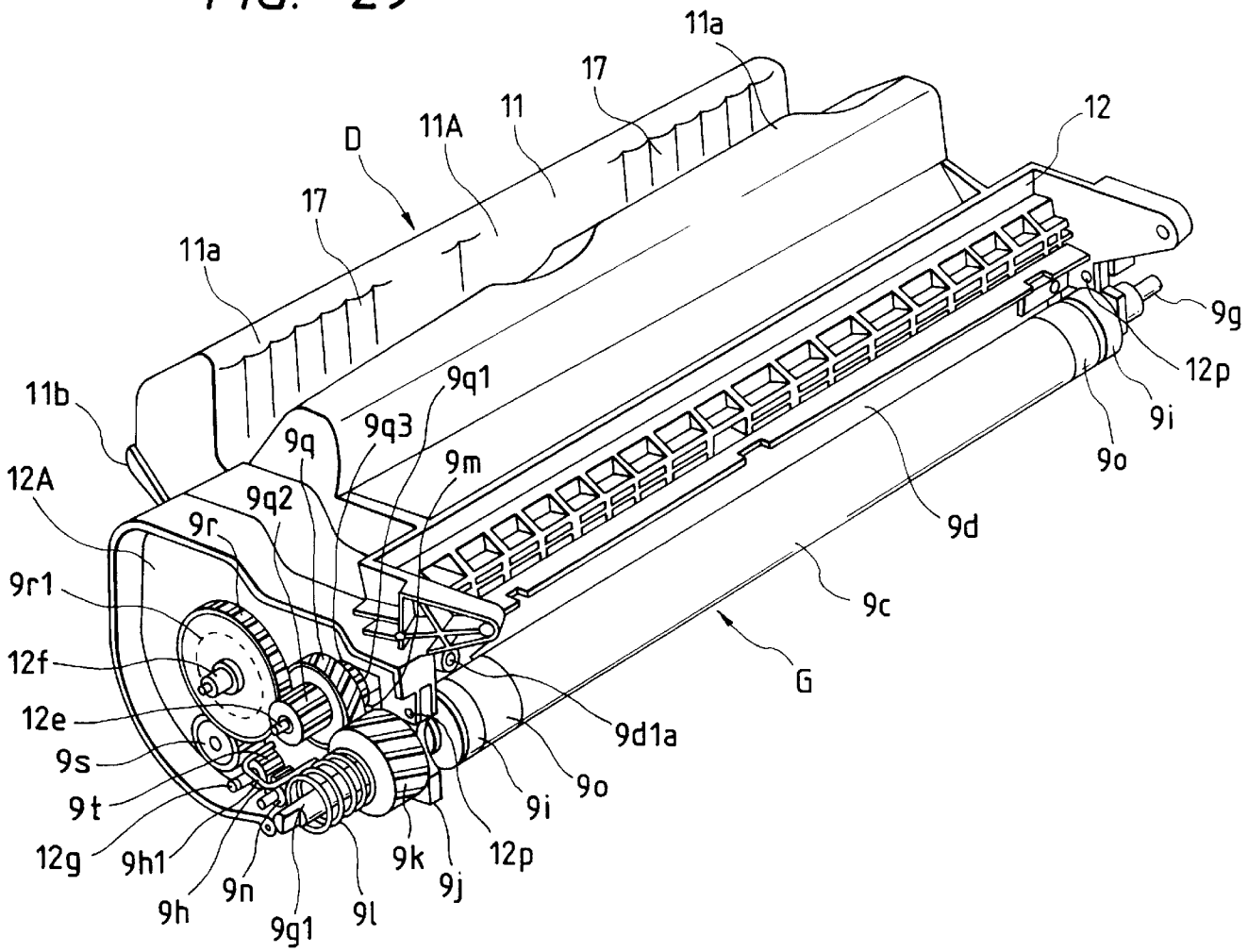
FIG. 29 is a perspective view showing a condition that the developing holder of the developing unit is removed.

Now, the developing frame body 12 will be described with reference to FIGS. 3, 27, 28, 29 and 52. FIG. 27 is a perspective view showing a condition that various parts are incorporated into the developing frame body 12, FIG. 28 is a perspective view looked at from a direction of the welding surface, showing a condition that the toner agitating members 9*e*, 9*f* are incorporated into the developing frame body 12, and FIG. 29 is a perspective view of the developing unit in a condition that the developing holder is not attached.

As mentioned above, the developing roller 9*c*, developing blade 9*d*, toner agitating members 9*e*, 9*f* and antenna rod 9*h* for detecting a remaining amount of toner are incorporated into the developing frame body 12.

The developing blade 9*d* is constituted by securing urethane rubber 9*d*2 to a metal plate 9*d*1 having a thickness of about 1 to 2 mm by hot melt or a both-face adhesive tape and serves to regulate an amount of toner on the peripheral surface of the developing roller 9*c*. Blade abutment flat surfaces (blade attaching portions) 12*i* provided on both longitudinal ends of the developing frame body 12 has a flatness regulated to about 0.05 mm. Each flat surface 12*i* is provided with a peg 12*i*1 and a threaded hole 12*i*2. Holes 9*d*3 formed in the metal plate 9*d*1 are fitted onto the pegs 12*i*1. Thereafter, the metal plate 9*d*1 is secured to the flat surfaces 12*i* by screws threaded into threaded holes 9*d*4 formed in the metal plate 9*d*1 and the threaded holes 12*i*2. Incidentally, an elastic seal member 12*s* made of molt-prene for preventing penetration toner from being adhered to the developing frame body 12 along an upper longitudinal edge of the metal plate 9*d*1. Further, magnetic seal members 201 extending from both ends of the elastic seal member 12*s* are attached to arcuate surfaces 12*j* along the developing roller 9*c*. And, elastic seal members 201*c* made of molt-prene are adhered to back surfaces of the magnetic seal members 201 to seal gaps between the developing frame body 12 and the magnetic seal members 201 (FIG. 52). Furthermore, as shown in FIG. 27, thin elastic seal members 12*s*2 contacted with the generatrix of the developing roller 9*c* are adhered to a lower flange portion 12*h*. Further, as shown in FIG. 52, an elastic seal member 12*s*3 for preventing the toner from leaking from a side of the urethane rubber 9*d*2 is attached to the developing frame body 12 beside an arcuate groove 203*a* into which the magnetic seal member 201 is fitted.

Now, the magnetic seal member will be described with reference to FIGS. 52 to 55.

Figure 52A:
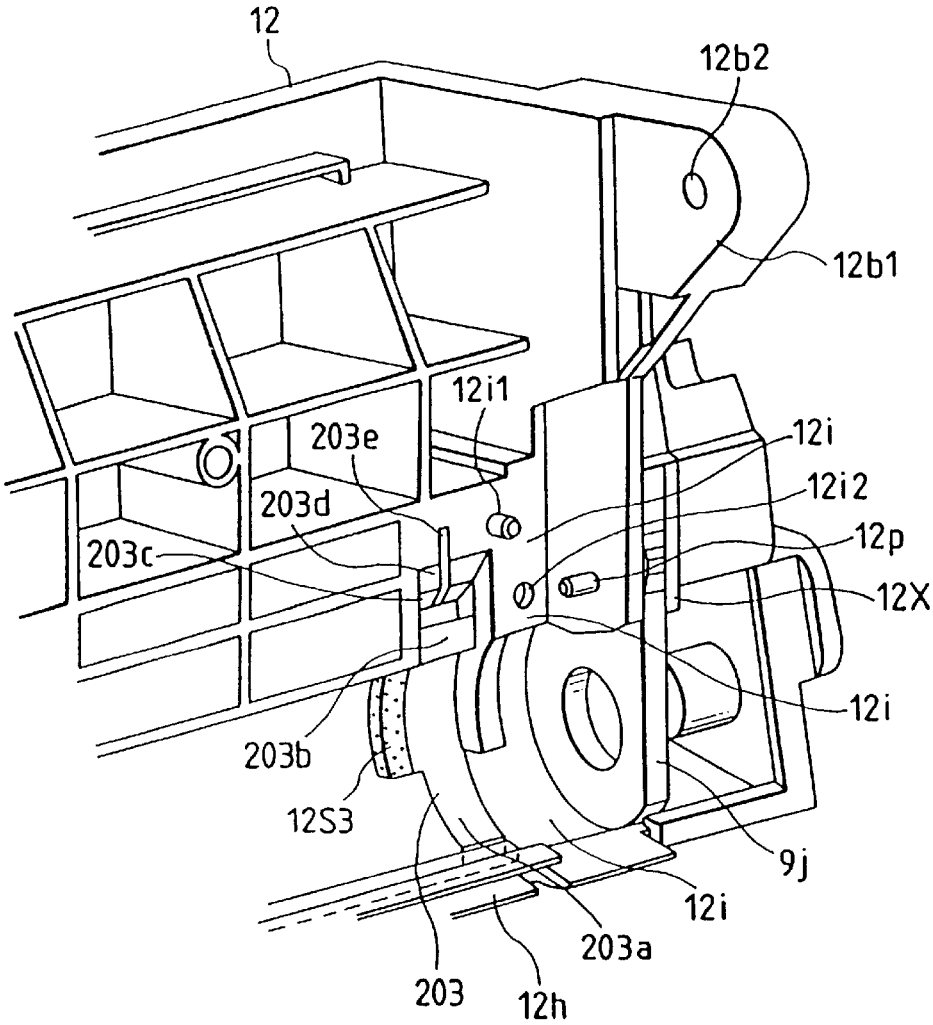
FIGS. 52A and 52B are perspective views of a magnetic seal attaching portion of the developing frame.
Figure 52B:
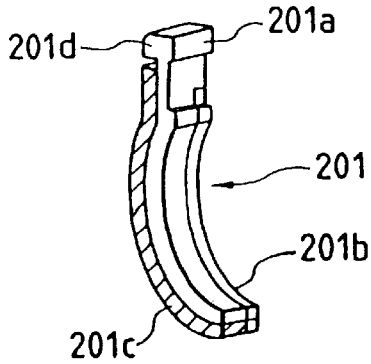
Figure 53:
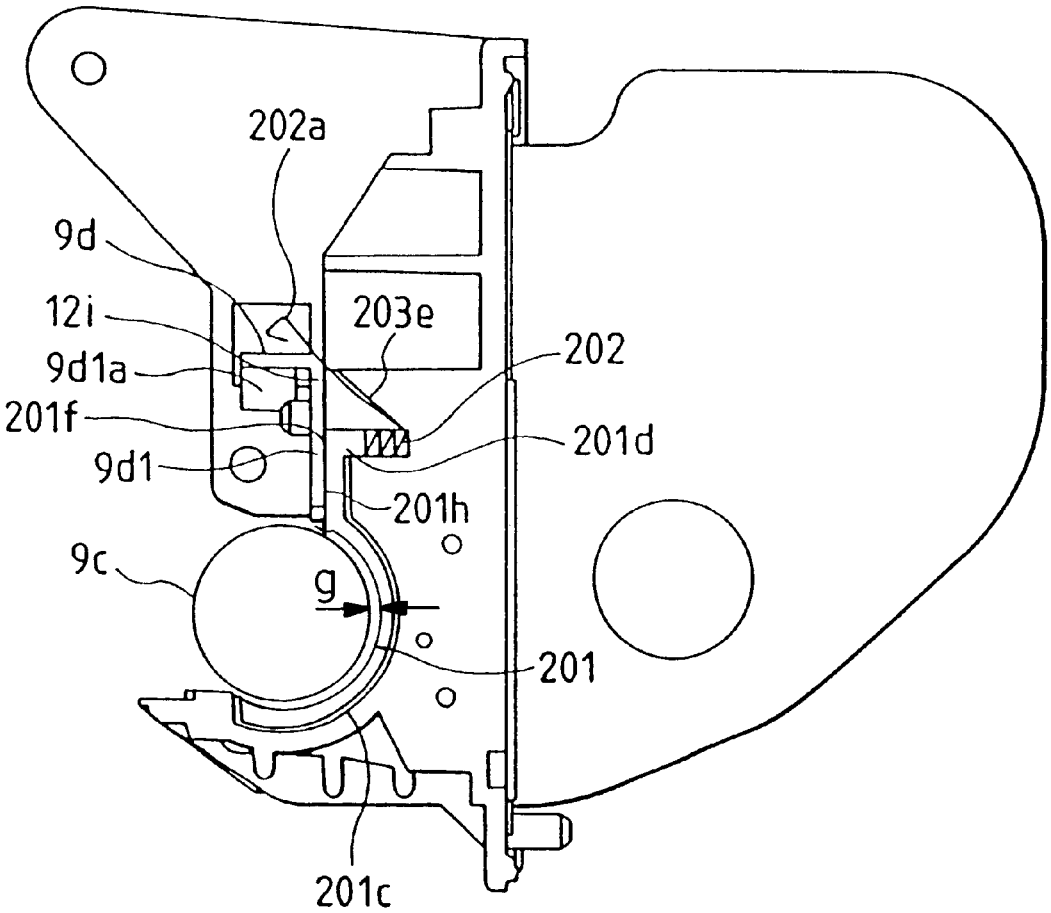
FIG. 53 is a longitudinal sectional view of the magnetic seal attaching portion of the developing frame.

The magnetic seal member 201 is constituted by a magnet 201*a* and a magnetic member 201*b*. The magnet is an injection molded part having a nylon binder including Nd—Fe—B powder, and the magnetic member 201*b* is made of iron. The magnetic seal member 201 is attached to the developing frame body 12 to form a gap of 0.1 to 0.7 mm between the magnetic seal member and the developing roller 9*c*. The toner is prevented from leaking through the longitudinal ends of the developing roller 9*c* by absorbing or attracting the magnetic toner by a magnetic force generated by the magnet 201*a* and the magnetic member 201*b*. The magnetic seal member 201 has an arm portion 201*d* to be positioned with respect to the developing frame body 12. As shown in FIG. 53, the arm portion 201*d* is disposed at a position opposite to an abutment surface 201*f* between the metal plate 9*d*1 of the developing blade 9*d* and the arm portion, and the arm portion 201*d* is urged to abut against the developing blade 9*d* by a spring member 202 attached in a positioning groove (arm portion attaching portion of the developing frame body 12) 203*c*. The magnetic seal member 201 can surely be contacted with the developing blade 9*d* by the spring member 202. Further, a contact portion 202*a* extending from an end of the spring member 202 which is not contacted with the magnetic seal member 201 is elastically urged against the metal plate 9*d*1 of the developing blade 9*d*, with the result that electricity communication between the magnetic seal members 201 and the developing blade 9*d* can be achieved in a parallel manner. In order to extend or reach the contact portion 202*a* up to the metal plate 9*d*1, the developing frame body 12 is provided with a slit 203*e* into which the contact portion 202*a* can enter and which extends from the bottom of the positioning groove 203*c* to the blade abutment surface 12*i* (FIG. 52). With this arrangement, surface potential of the developing roller 9*c*, metal plate 9*d*1 of the developing blade 9*d* and magnetic seal member 201 can be more stabilized at the same potential, thereby preventing noise due to leak.

By the way, if the magnetic seal member 201 is not grounded, voltage supplied to the developing roller 9*c* and the developing blade 9*d* or charges generated by friction between the developing roller 9*c* and the toner existing between the magnetic seal members 201 is accumulated in the magnetic seal member 201. If the magnetic seal member 201 is instantaneously approached to the developing blade 9*d* due to dispersion in tolerance of parts or any shock, leakage is generated between the developing roller 9*c* and the magnetic seal member 201, with the result that noise may easily be generated. Further, if there is an electrically unstable condition in which the developing blade 9*d* is electrically disengaged from or contacted with the magnetic seal member 201, leakage may be generated between the developing blade 9*d* and the magnetic seal member 201.

Therefore, in the illustrated embodiment, the arm portions 201*d* of the magnetic seal members 201 are urged by the spring members 202 to abut the abutment surfaces against the metal plate 9*d*1 of the developing blade 9*d*. With this arrangement, the developing blade 9*d* can stably abut against the magnetic seal members 201. By abutting the contact portions or arm portions 202*a* of the spring members 202 against the metal plate 9*d*1 of the developing blade 9*d*, electricity communication between the developing blade 9*d* and the magnetic seal members 201 is achieved by two parallel systems at both longitudinal ends of the developing roller 9*c*. In this way, it is possible to prevent occurrence of the electrically unstable condition in which the developing blade 9*d* is electrically disengaged from or contacted with the magnetic seal member 201, thereby preventing leak due to such unstable condition and preventing noise due to such leakage.

In this way, according to the illustrated embodiment, the developing blade 9*d* can surely be contacted with the magnetic seal members 201 by the arm portions 202*a* of the spring members 202, noise due to leakage can be prevented.

Further, since the abutment surfaces 201*h* of the magnetic seal members 201 are urged against the metal plate 9*d*1 of the developing blade 9*d* secured to the developing frame body 12 by the spring members 202, the constant gaps g between the magnetic seal members 201 and the developing roller 9*c* can be prevented from being changed due to the driving force.

(Magnetic seal assembly)

Next, a method for assembling the magnetic seal member will be briefly described.

As shown in FIG. 52, the developing frame body 12 is provided with the positioning grooves 203 for attaching the magnetic seal members 201, which grooves start from the flat surface 12*i* and extend along the arcuate surfaces 12*j*. The groove 203 includes an arcuate groove portion 203*a* extending the curvature of the arcuate surface 12*j*, a vertical straight groove portions 203*b* extending along the flat surface 12*i*, and a positioning groove portion 203*c* directing in a front-and-rear direction and for just receiving the arm portion 201*d* of the magnetic seal member 201. An inlet portion 203*d* of the magnetic seal member attaching groove 203 has an inclined portion such as C-chamfer so that the arm portion 201*d* of the magnetic seal member 201 is guided along the inclined portion for attachment. The arm portion 201*d* is fitted into the positioning groove portion 203*c* at the rear side of the inclined portion. The positioning groove portion 203*c* is provided at its rear side with a rectangular cross-section for just receiving the arm portion 201*d*.

Figure 54:
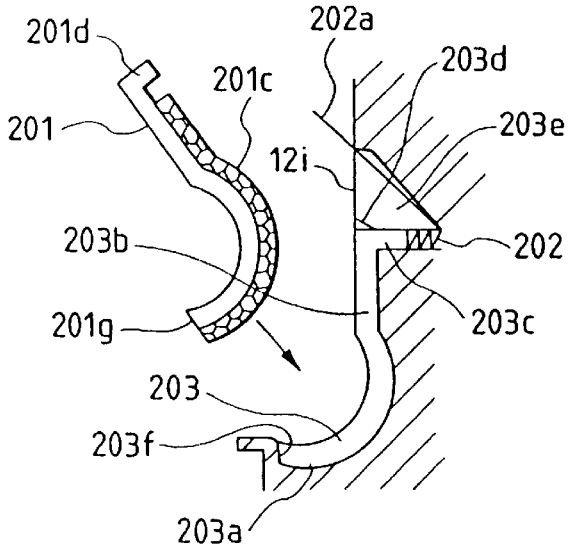
FIG. 54 is a longitudinal sectional view showing an attaching process for attaching the magnetic seal member to the developing frame.
Figure 55:
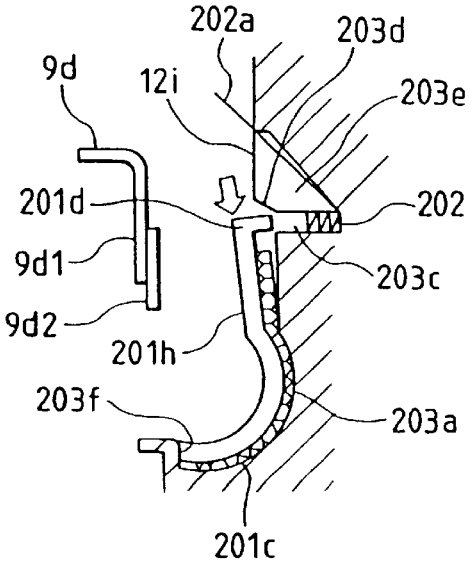
FIG. 55 is a longitudinal sectional view showing an attaching process for attaching the magnetic seal member to the developing frame.

As shown in FIG. 54, after the spring member 202 is fitted into the positioning groove portion 203*c* and the slit 203*e*, the magnetic seal member 201 is brought into the magnetic seal member attaching groove 203 of the developing frame body 12 as shown by the arrow, and a semicircular portion of the seal member is fitted into the arcuate groove portion 203*a* as shown in FIG. 55. Then, when the arm portion 201*d* is lightly pushed obliquely rearwardly toward a direction shown by the arrow to mate a lower end surface 201*g* of the magnetic seal member 201 with a lower end surface 203*f* of the attaching groove 203 of the developing frame body 12, a lower portion 201*e* of the elastic seal member 201*c* provided along the back surface of the magnetic seal member 201 is compressed, with the result that the tip end of the arm portion 201*d* is guided by the inlet portion 203*d* to be fitted into the positioning groove portion 203*c*. In this condition, a force (for pushing the magnetic seal member 201 upwardly) of the spring member 202 inserted into the attaching groove 203 is weak, and the abutment surface of the magnetic seal member 201 against the metal plate 9*d*1 of the developing blade 9*d* is floating from the abutment surface 12*i* for the developing blade 9*d*. In this condition, by attaching the developing blade 9*d* to the developing frame body 12, as shown in FIG. 53, the magnetic seal member 201 is positioned with respect to the developing frame body 12 in a condition that the abutment surface 201*f* of the magnetic seal member 201 is contacted with the developing blade 9*d*. The positioning portion of the magnetic seal member 201 with respect to the developing frame (the toner frame body 11 as the developing container and a developing container portion of the developing frame body 12) 12 is provided at a position opposite to the abutment surface of the developing blade 9*d* as the developer regulating member. With this arrangement, the magnetic seal member can easily be positioned with respect to the developing frame having a dimension that there is no play in the longitudinal direction.

Since the magnetic seal members are constructed as mentioned above, the positions of the magnetic seal members are determined correctly, and since the positioning portions of the magnetic seal members are urged against the positioning portion of the developer regulating member by the spring members (elastic members) 202, the positions of the magnetic seal members with respect to the developing frame are maintained in a stable condition, with the result that there is little influence of vibration or the like.

Further, since the metal plate 9*d*1 of the developing blade (electricity communication portion of the developer regulating member) is contacted with the elastic members, a circuit for developing bias is duplicated at this portion, thereby enhancing reliability.

Since the back surface of the positioning portion of the magnetic seal member is urged by the elastic member, when the elastic member and the magnetic seal member are pushed into the attaching groove of the developing frame and are urged by the developer regulating member, the developer regulating member is secured in this condition. Thus, the magnetic seal member can easily be attached.

In this case, by providing a portion which is contacted with the electricity communication portion of the developer regulating member on the elastic member, the developing bias circuit can be paralleled at this portion, thereby enhancing reliability.

(Developing blade)

One longitudinal end of the metal plate 9*d*1 of the developing blade 9*d* is bent at a right angle (90°) to form a bent portion 9*d*1*a* (FIGS. 27 and 53). This bent portion 9*d*1*a* is contacted with a leaf spring portion 121*a* (FIG. 24) of a developing bias contact 121 held by the developing holder 40 which will be described later, thereby maintaining the potential of the metal plate 9*d*1 to be equal to the potential of the developing roller 9*c*. The reason is that, in consideration of the fact that the amount of toner is detected by detecting change in electrostatic capacity between the toner remaining amount detecting antenna rod 9*h* and the developing roller 9*c*, the electrostatic capacity is prevented from being changed due to the influence from the metal plate 9*d*1.

(Developing roller)

Next, the developing roller unit G will be described.

As shown in FIG. 27, the developing roller unit G includes (1) the developing roller 9*c*, (2) spacer subrollers 9*i* coaxial with the developing roller 9*c* and each having a diameter greater than that of the developing roller 9*c* to keep a distance between the peripheral surface of the developing roller 9*c* and the peripheral surface of the photosensitive drum 7 constant, (3) developing roller bearings 9*j* for positioning the developing roller 9*c* within the developing frame body 12, (4) a developing roller gear (helical gear) 9*k* for receiving the driving force from the helical gear 7*b* of the photosensitive drum 7 to rotate the developing roller 9*c*, (5) C-shaped stoppers (shaft stop rings) 9*o* for maintaining the developing roller gear 9*k* at a predetermined position of the developing roller 9*c*, (6) a developing coil spring contact 91 having one end fitted into the developing roller gear 9*k* of the developing roller 9*c*, and (7) a magnet 9*g* disposed inside of the developing roller 9*c* and serving to adhere the toner to the peripheral surface of the developing roller 9*c*.

In the developing roller unit G, two holes 9*j*1 formed in the developing roller bearings 9*j* are aligned with holes 12*p* formed on both longitudinal ends of the developing frame body 12 and pins of the developing holder 40 (described later) are inserted into the aligned holes 9*j*1, 12*p*. By securing the developing holder 40 to the developing frame body 12 by screws, the developing roller unit G is attached to developing roller attaching portions 12X. Incidentally, a groove for just receiving the developing roller bearing 9*j* is formed above each attaching portion 12X at each longitudinal end (FIGS. 52A and 52B).

(Developing roller bearing)

Figure 58:
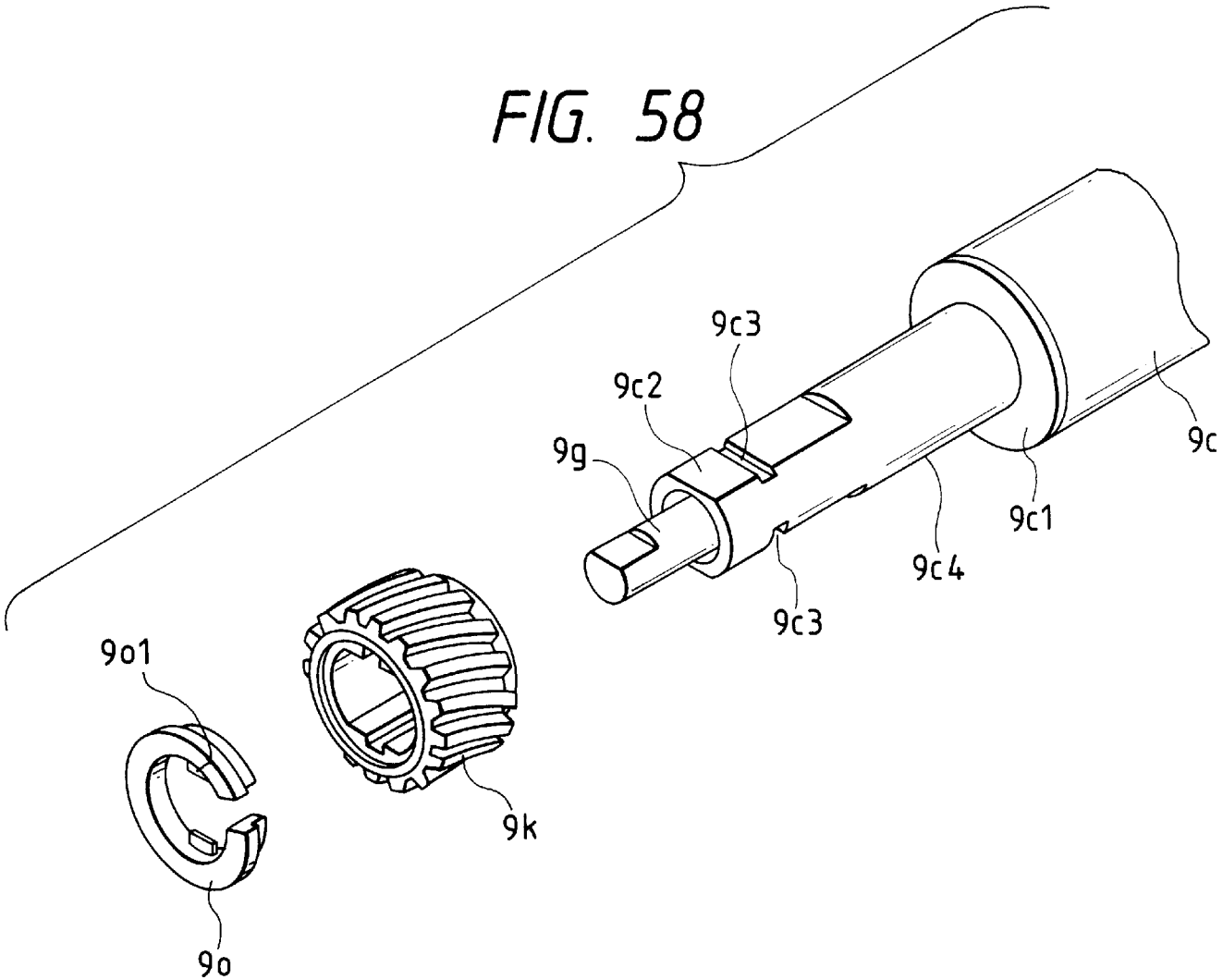
FIG. 58 is an exploded perspective view of a developing roller unit.

As shown in FIG. 58, the developing roller bearing 9*j* is fitted onto a journal 9*c*4 of a developing roller flange 9*c*1 secured to the end of the developing roller 9*c*, and the developing roller gear 9*k* being provided with a central hole having the same cross-section as that of a two-flat surface cutout portion 9*c*2 is fitted onto the two-flat surface cutout portion adjacent the developing roller bearing 9*j*. The axial movement of the developing roller gear is prevented by a C-shaped stopper 9*o*.

Figure 56:
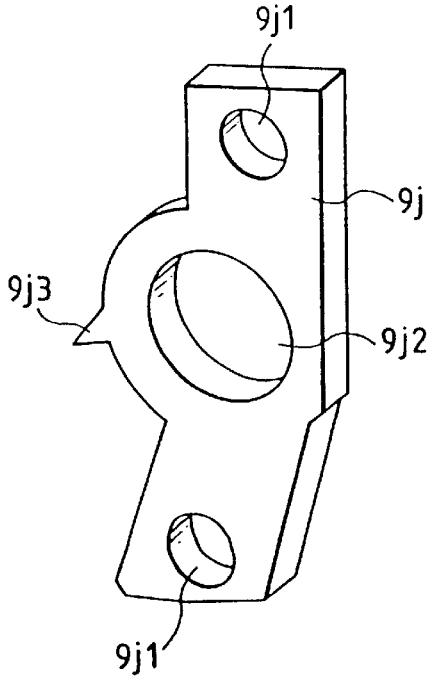
FIG. 56 is a perspective view of a developing roller bearing.
Figure 57B:
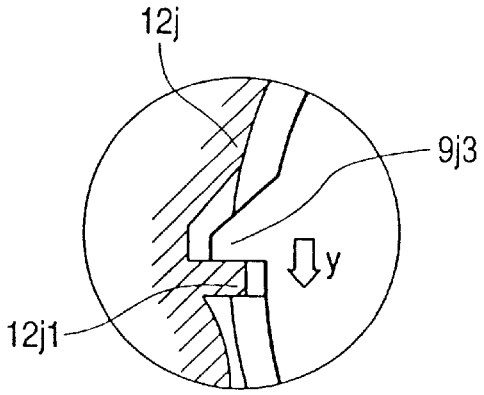
FIG. 57B is an enlarged view of a detail shown in FIG. 57A.
Figure 57A:
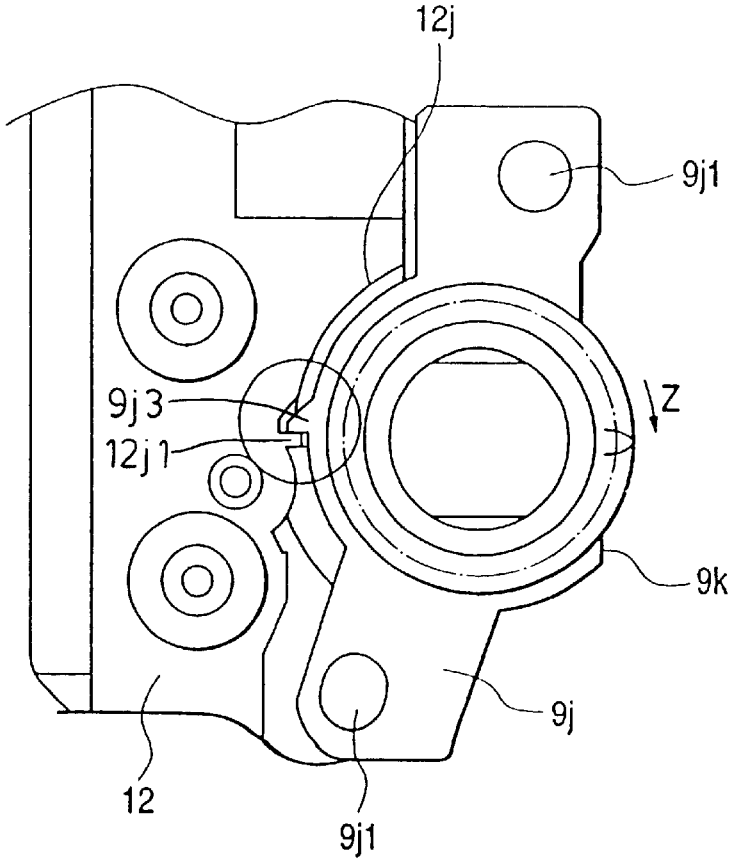
FIG. 57A is a side view of the developing roller bearing.

Next, the developing roller bearing will be explained with reference to FIGS. 56, 57A and 57B.

The developing roller bearing 9*j* is provided with a hole 9*j*2 for receiving the journal 9*c*4 and for rotatably supporting the developing roller 9*c*, and hole portions 9*j*1 into which pins 40*d* (FIGS. 23 and 24) of the developing holder 40 are inserted to secure the bearing to the developing frame body 12. When the driving force (shown by the arrow Z in FIG. 57A) from the gear 7*b* of the photosensitive drum 7 is transmitted to the developing roller gear 9*k*, the developing roller 9*c* is dropped toward a direction shown by the arrow y in FIG. 57B. In order to prevent such dropping of the developing roller 9*c* thereby to maintain the proper gap between the developing roller 9*c* and the magnetic seal members 201, the developing roller bearing 9*j* is provided with a protruded rib 9*j*3 protruding toward the arcuate surface 12*j* of the developing frame body 12 along the developing roller 9*c*. During the driving, the rib 9*j*3 is contacted with a rib 12*j*1 provided on the arcuate surface 12*j* of the developing frame body 12 along the developing roller 9*c*, with the result that the dropping of the developing roller 9*c* can be suppressed by supporting the developing roller bearing 9*j* by means of the rib 12*j*1. When a contact surface between the ribs 12*j*1, 9*j*3 is a substantially horizontal surface, a plane including such a contact surface includes the axis of the developing roller 9*c* or passes near such axis. When the contact surface is set to be perpendicular to a line of action of engagement between the developing roller gear 9*k* and the drum gear 7*b*, tooth load is supported by the rib 12*j*1 not to generate a lateral load (load transverse to the line of action), with the result that only the rotational force can be transmitted from the drum gear 7*b* to the developing roller gear 9*k*. Of course, the contact surface between the ribs 12*j*1, 9*j*3 may not be perpendicular to the line of action of engagement between the drum gear 7*b* and the developing roller gear 9*k*; in such a case, since the developing roller bearing is supported by the pins 40*d* of the developing holder 40 fitted into the hole portions 9*j*1, displacement due to lateral load component can be suppressed.

In the above-mentioned arrangement, when looked at from the axial direction of the developing roller 9*c*, the rib 9*j*3 (part of the developing roller bearing 9*j*) is engaged by the rib 12*j*1 of the developing frame body 12 at a side opposite to the above-mentioned engagement point with the interposition of the center of the developing roller 9*c*, substantially on a line connecting between the engagement point (pitch point) between the developing roller gear 9*k* and the drum gear 7*b* and the center of the developing roller 9*c*.

(C-shaped stopper)

Figure 59:
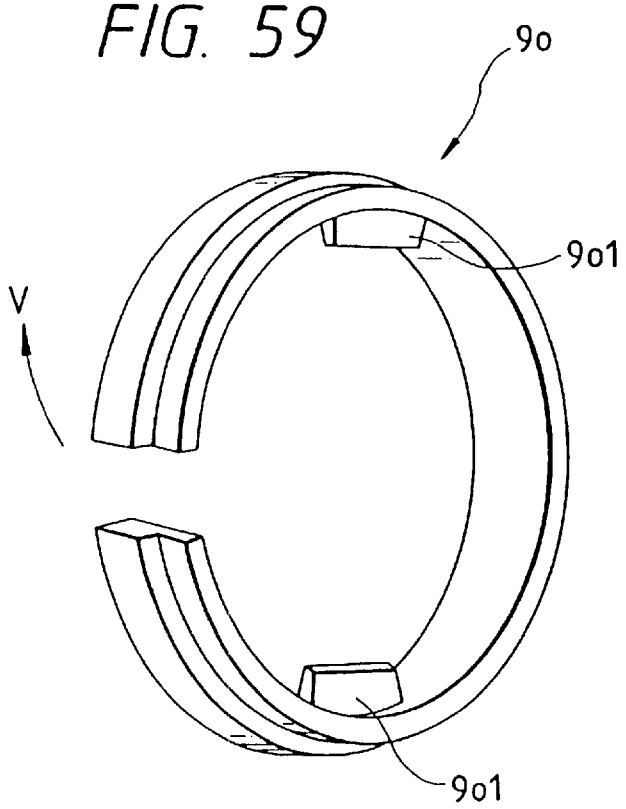
FIG. 59 is a perspective view of a shaft stop ring.

Explaining the C-shaped stopper (shaft stop ring) 9*o*, as shown in FIGS. 58 and 59, the C-shaped stopper 9*o* has an annular shape having two pawl portions 9*o*1 for engagement with the developing roller flange 9*c*1. The pawl portions 9*o*1 can be fitted into grooves 9*c*3 formed in the two-flat surface cutout portion 9*c*2 of the developing roller flange 9*c*1 and extending in perpendicular to the developing roller 9*c*, thereby preventing the rotation of the developing roller gear 9*k*. By such fitting, the developing roller gear 9*k* is prevented from shifting in the longitudinal direction and from dislodging from the journal 9*c*4. In the illustrated embodiment, the stopper 9*o* has a C-shaped configuration and can be widened in directions v in FIG. 59, so that, when the C-shaped stopper 9*o* is assembled to the developing roller flange 9*c*1, forces acting on the pawl portions 9*o*1 can be reduced to facilitate the assembling of the C-shaped 9*o*. The C-shaped stopper 9*o* may be formed from material such as POM or nylon resin.

In this way, in the illustrated embodiment, when the developing roller is attached to the developing frame body 12, the developing roller unit G is firstly assembled. Then, the assembled developing roller unit G is attached to the developing frame body 12 by using the developing holder 40, 41 (the developing holder 41 is provided with pins similar to the pins 40*d* of the developing holder 40). Thus, in comparison with a case where the developing roller 9*c* is attached to the developing frame body 12 independently, the assembling efficiency is enhanced.

Incidentally, the assembling of the developing roller unit G is effected in accordance with the following steps (refer to FIG. 27). First of all, the spacer sub-rollers 9*i* are attached to both ends of the developing roller 9*c*, and then, the developing roller bearings 9*j* are attached to the developing roller outwardly of the spacer subrollers. Then, at one end of the developing roller 9*c*, the developing roller gear 9*k* is attached outwardly of the bearing 9*j*, and the C-shaped stopper 9*o* is attached for preventing dislodgment, and then, the developing coil spring contact 91 is attached outwardly of the stopper. The developing coil spring contact 91 is contacted with the developing roller gear 9*k*. And, a D-cut end 9*g*1 of the magnet 9*g* is protruded from the end of the developing roller 9*c* at which the developing roller gear 9*k* is attached. Further, the other cylindrical end 9*g*2 of the magnet 9*g* is protruded from the other end of the developing roller 9*c*. In this way, the developing roller unit G is constructed.

(Toner remaining amount detection)

Next, the antenna rod 9*h* for detecting the remaining amount of toner will be described. As shown in FIG. 27, the antenna rod 9*h* has a laid U-shaped end. The "laid U-shaped" end 9*h*1 is contacted with a toner detecting contact 122 attached to the developing holder (FIG. 24) (described later) and is electrically connected thereto. In order to attach the antenna rod 9*h* to the developing frame body 12, first of all, a tip end 9*h*3 of the antenna rod 9*h* is passed through a through hole 12*b* formed in the side plate 12A of the developing frame body 12 to be inserted in the interior of the developing frame. Then, the tip end 9*h*3 is supported in a blind hole 12*k* formed in the opposite side plate of the developing frame body 12. In this way, the antenna rod 9*h* is positioned and supported by the through hole 12*b* and the blind hole 12*k*.

Further, a terminal end 9*h*2 of the "laid U-shaped" end 9*h*1 is inserted into a blind hole 12*o* (having a depth of about 5 mm) of the developing frame body 12, thereby positioning the antenna rod 9*h* in the axial direction. In this way, rigidity of the "laid U-shaped" end 9*h*1 (contact portion) contacted with the toner detecting contact 122 (described later) is enhanced. The hole 12*k* into which the tip end 9*h*3 is fitted is a blind hole (bag hole) for preventing penetration of toner.

(Toner agitating member)

Next, the toner agitating members 9*e*, 9*f* will be explained. As shown in FIG. 27, each of the toner agitating members 9*e*, 9*f* has a crank shape for agitating the toner by its own rotation. The toner agitating members are disposed in the vicinity of the developing roller 9*c* and the antenna rod 9*h* on a path through which the toner is shifted from the toner container 11A to the developing roller 9*c*. The toner agitating members 9*e*, 9*f* are perpendicular to each other.

First of all, tip ends 9*e*3, 9*f*3 of the toner agitating members 9*e*, 9*f* are inserted into through holes 12*t*, 12*r* formed in the side plate 12A of the developing frame body 12 at the same side at which the antenna rod 9*h* is assembled. Then, the tip ends 9*e*3, 9*f*3 are fitted into blind holes 12*m*, 12*n* formed in the opposite side plate 12B of the developing frame body 12 opposite to the side plate 12A. After the agitating members 9*e*, 9*f* are inserted into the developing frame body 12 in this way, agitating gears 9*m*, 9*n* are fitted into the through holes 12*t*, 12*r*. In this case, axial notch portions 9*m*1, 9*n*1 formed in tip ends of the gears 9*m*, 9*n* are engaged by crank arms 9*e*2, 9*f*2 of the toner agitating members 9*e*, 9*f*. Further, journals 9*e*1, 9*f*1 of the agitating members 9*e*, 9*f* are fitted into central holes (not shown) formed in bottoms of the notch portions 9*m*1, 9*n*1, thereby supporting the toner agitating members 9*e*, 9*f* on the developing frame body 12.

When the toner frame body 11 is joined to the developing frame body 12, the side plate 12A of the developing frame body 12 through which the antenna rod 9*h* and the toner agitating members 9*e*, 9*f* are inserted is opposed to a toner cap 11*f* provided on the toner upper frame body 11*a* and protruded from the side surface of the toner frame body 11, thereby covering the toner cap 11*f* (FIG. 31). Further, the side plate 12A is provided with a fitting hole 12*x* into which a toner feed gear 9*s* (FIG. 29) for transmitting a driving force to the toner feed member 9*b* is rotatably fitted. The toner feed gear 9*s* is engaged by an end of the toner feed member 9*b* and is connected to a coupling member 11*e* (FIGS. 30 and 31) rotatably supported by the toner upper frame body 11*a*, thereby transmitting the driving force to the toner feed member 9*b*.

Next, transmission of the driving force will be explained.

(Driving force transmitting device)

Figure 36:
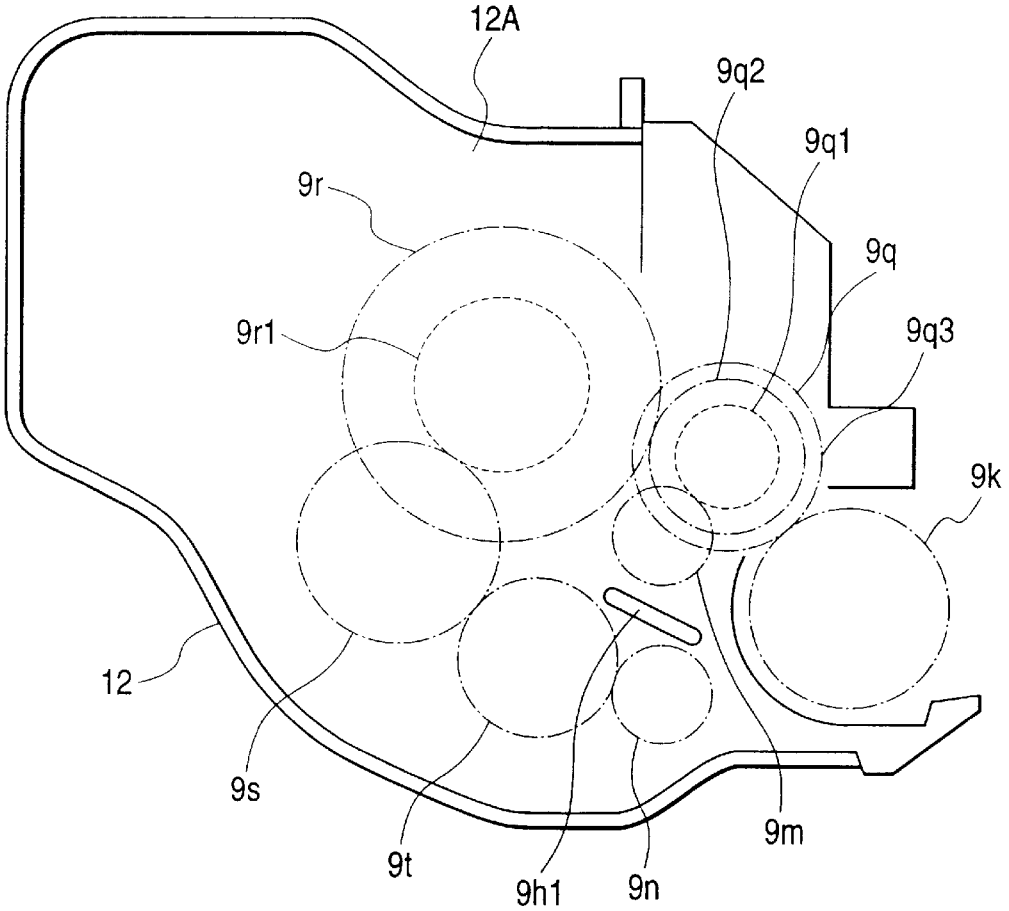
FIG. 36 is a side view showing a gear train of FIG. 29.

As shown in FIGS. 29 and 36, the agitating gear 9*m*, 9*n* and the toner feed gear 9*s* receive the driving force from the developing roller gear 9*k*. First of all, the driving force is transmitted to the agitating gear 9*m* through a small gear 9*q*1 of an idler gear (stepped gear) 9*q*. By this driving force, the agitating member 9*m* is rotated. A large gear 9*q*3 of the idler gear 9*q* is meshed with the developing roller gear 9*k* to receive the driving force from the developing roller gear 9*k*. Further, the driving force is transmitted from a middle gear 9*q*2 of the idler gear 9*q* to an idler gear (stepped gear) 9*r*. The driving force is further transmitted from a small gear 9*r*1 or the idler gear 9*r* to the toner feed gear 9*s* to rotate the toner feed member 9*b*. The driving force is further transmitted from the toner feed gear 9*s* to the agitating gear 9*n* through an idler gear 9*t*, thereby rotating the toner agitating member 9*f*. The idler gears 9*q*, 9*r*, 9*t* are rotatably supported on pegs 12*e*, 12*f*, 12*g* formed integrally with the developing frame body 12. Free ends of the pegs are supported by the developing holder 40 which will be described later.

The above-mentioned gear train is disposed at the same side as the side where the "laid U-shaped" end 9*h*1 of the antenna rod 9*h*.

With the arrangement as mentioned above, the supporting of the gears constituting the gear train and electrical connection of the toner remaining amount detecting contact can be effected by using the same member (developing holder 40 in the illustrated embodiment). Further, in the longitudinal direction of the developing frame body 12, from the same side, the toner agitating members 9*e*, 9*f*, antenna rod 9*h*, idler gears 9*q*, 9*r*, 9*t* constituting the gear train, agitating gears 9*m*, 9*n* and toner feed gear 9*s* can be assembled. Thus, the assembling ability can be improved greatly.

Incidentally, a lower flange portion 12*h* of the developing frame body 12 also act as a convey guide for the recording medium 2 (for example, recording sheet). That is to say, as shown in FIG. 8, a plurality of guide ribs (widthwise ridges) 121 are arranged side by side in the longitudinal direction. Further, to increase rigidity, the developing frame body 12 may be molded by hollow molding.

Further, in FIG. 28, an opening portion 12P is formed in the developing frame body 12 along the longitudinal direction. In the condition that the toner frame body 11 is joined to the developing frame body 12, the opening portion 12P is opposed to the opening portion 11*i* of the toner frame body 11. Thus, the toner contained in the toner frame body 11 can be supplied to the developing roller 9*c*. The agitating members 9*e*, 9*f* and the antenna rod 9*h* are attached along the entire longitudinal length of the opening portion 12P.

According to the illustrated embodiment, the developing frame body 12 is formed to include a developing roller attaching portion 12X, side plate 12A, developing blade attaching portion (blade abutting flat surface 12*i*), antenna rod 9*h* attaching portion (through hole 12*b*, blind hole 12*k* hole 120), agitating member attaching portion (through holes 12*t*, 12*r*, blind holes 12*m*, 12*n*) and gear attaching portion (pegs 12*e*, 12*f*, 12*g*). Material for forming the developing frame body 12 may be the same material as the toner frame body 11.

(Developing holder)

Next, the developing holder 40 will be explained.

Figure 23:
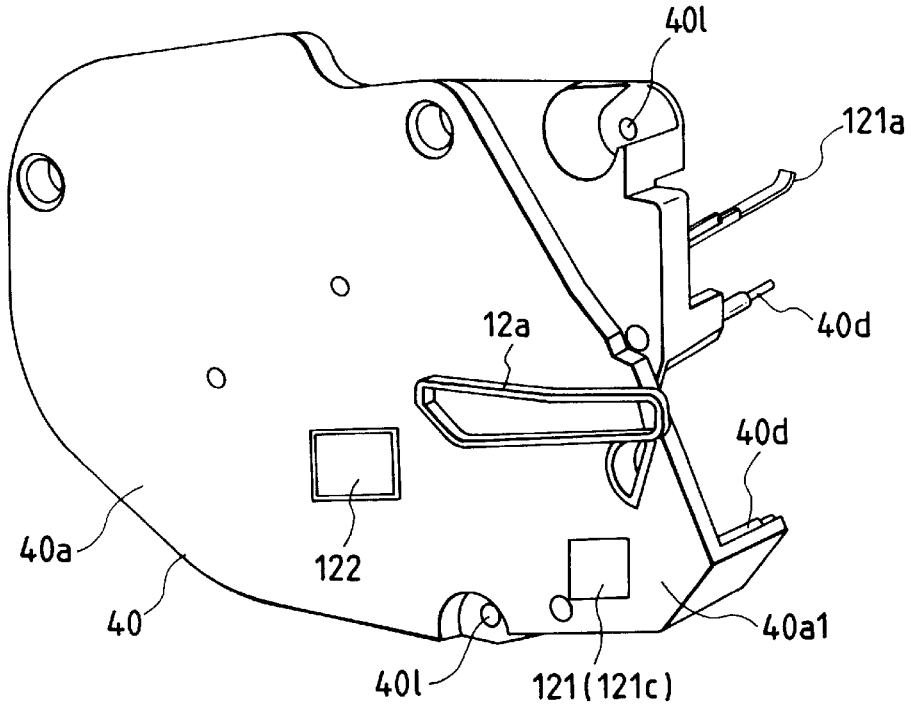
FIG. 23 is a perspective view of a developing holder.
Figure 24:
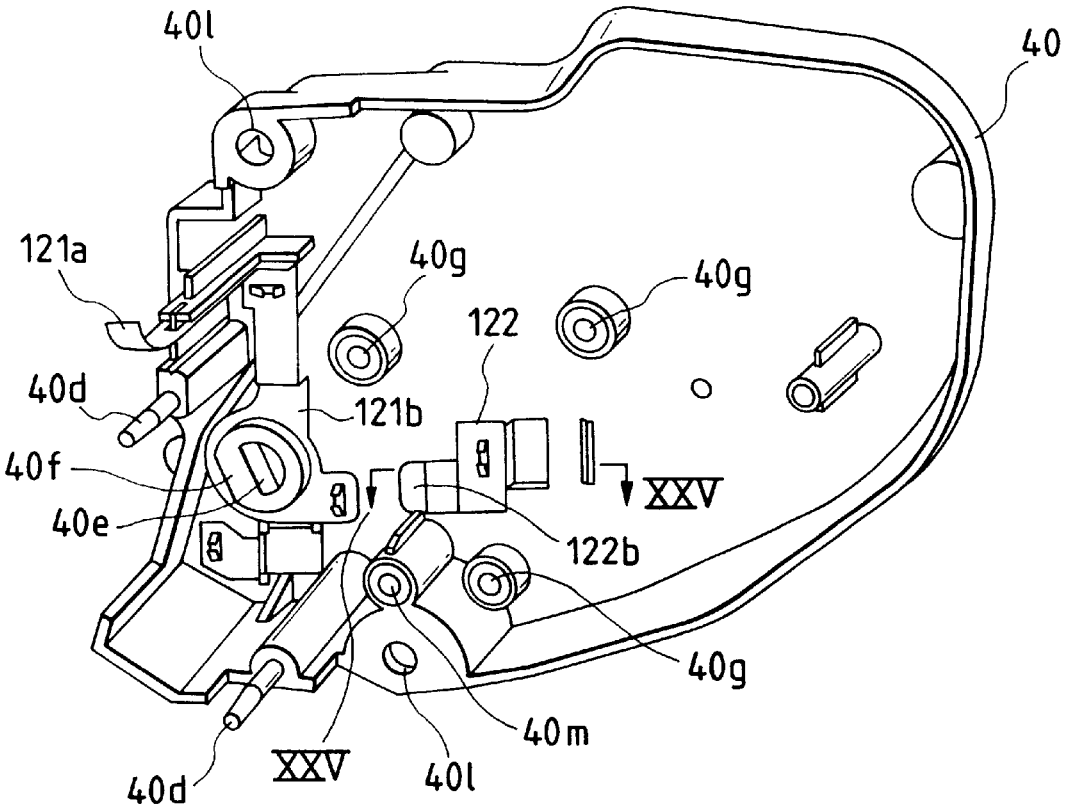
FIG. 24 is a perspective view showing interior of the developing holder.
Figure 25:
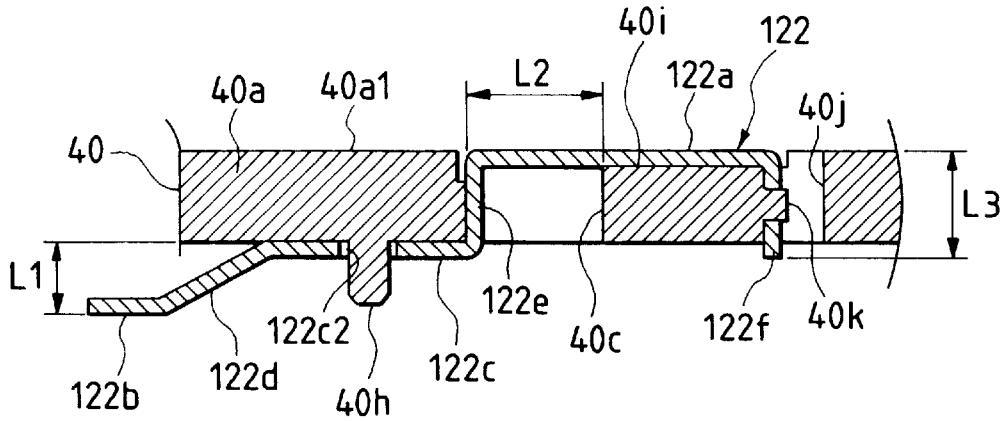
FIG. 25 is an enlarged sectional view taken along the line XXV—XXV in FIG. 24.
Figure 26:
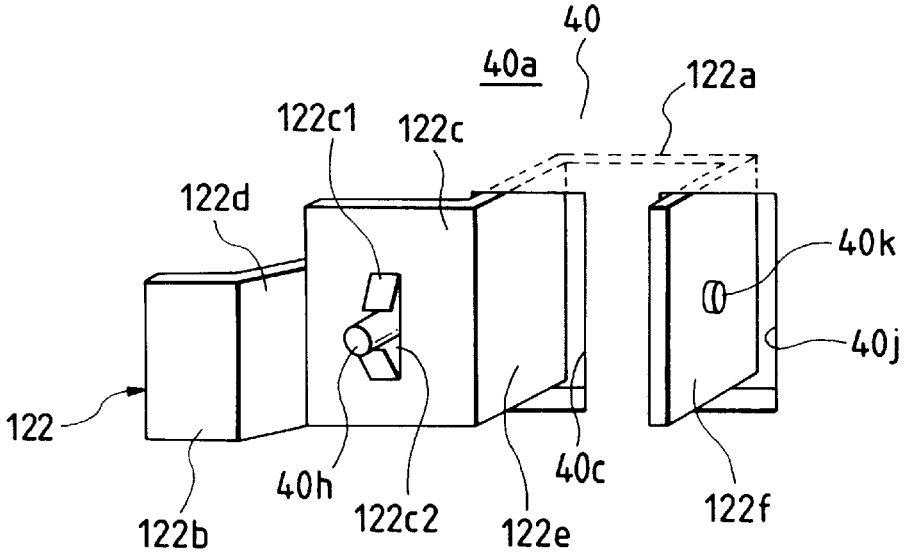
FIG. 26 is an enlarged view showing a toner detecting contact and therearound.

The developing holder will be described with reference to FIGS. 4 to 9A and 9B and FIGS. 23 to 25. FIG. 23 is a perspective view of the developing holder attached to the driving side, looked at from outside, FIG. 24 is a perspective view looked at from inside, FIG. 25 is an enlarged sectional view taken along the line XXV—XXV in FIG. 24 and FIG. 26 is an enlarged perspective view of the toner detecting contact.

The developing holders 40, 41 are attached to the assembly shown in FIG. 29 from both sides, thereby completing the developing unit D. In this case, first of all, in the developing unit G, one of two pins 40*d* of the developing holder 40 is passed through the upper hole 12*p* outwardly of the bearing fitting portion of the developing frame shown in FIG. 27 and is fitted into the upper hole 9*j*1 (FIG. 56) of the developing roller bearing 9*j* and fitted into the upper hole 12*p* inwardly of the developing frame body 12. Further, the other pin 40*d* is fitted into the lower hole 9*j*1 of the developing roller bearing 9*j* and the lower hole 12*p* of the developing frame body 12. The developing holders 40, 41 are secured to the developing frame body 12 by screw members so that the developing roller bearings 9*j* are pinched between the bearing fitting portions of the developing frame body 12. In this case, the screw members are inserted through holes 401 of the developing holders 40, 41 (although the holes of the developing holder 41 are not shown, the holes similar to those of the developing holder 40 are provided). Further, one end 9*g*1 of the magnet 9*g* (FIGS. 3 and 29) contained in the developing roller 9*c* is fitted into a D-cut hole 40*e* of the developing holder 40 and the other end 9*g*2 is fitted into a hole (not shown) of the developing holder 41, thereby determining the longitudinal position. Further, inclination of polarity of the magnet 9*g* is determined, as mentioned above, by fitting the D-cut end 9*g*1 into the D-cut hole 40*e* of the developing holder 40.

The developing unit D is rotatably supported with respect to the cleaning frame body 13 supporting the photosensitive drum 7 by inserting the arm portion 12*b*1 of the developing frame body 12 into a recessed portion 21 (FIG. 9B) of the cleaning frame body 13 and by joining the arm portion by means of a frame joining member 168 (FIGS. 64A and 64B). Further, a compression coil spring 169 attached to the frame joining member 168 is urged against the arm portion 12*b*1 of the developing frame body 12 to maintain the gap between the photosensitive drum 7 and the developing roller 9*c* constant (to prevent the gap from changing or varying due to vibration). In this way, the spacer subrollers 9*i* on both longitudinal ends of the developing roller 9*c* are urged against the photosensitive drum 7.

Further, as already explained, the longitudinal guides 12*a* are integrally formed with the outer surfaces of the developing holders 40, 41. A developing bias contact 121 and the toner detecting contact 122 formed from a metal plate for detecting the remaining amount of toner are fitted on the developing holder 40. That is to say, the contacts 121, 122 are attached to the developing holder 40 by press-fitting notches of the contacts onto pegs formed on the inner surface of the developing holder.

(Attaching of toner detecting contact)

Now, a method for attaching the toner detecting contact 122 will be explained with reference to the accompanying drawings.

FIG. 25 is an enlarged sectional view taken along the line XXV—XXV in FIG. 24 and FIG. 26 is an enlarged view showing the toner detecting contact of FIG. 24 and therearound. The toner detecting contact 122 is provided with an external contact portion 122*a* located on the outer surface of the holder 40 to be contacted with a toner detecting contact member 126 of the main body 14 of the apparatus shown in FIG. 19 and an internal contact member 122*b* to be urged against the "laid U-shaped" end 9*h*1 of the antenna rod 9*h*, when the process cartridge B is mounted to the main body 14 of the apparatus. And, as shown in FIG. 25, the external contact portion 122*a* is located substantially flush with an outer surface 40*a*1 of the side plate 40*a* of the developing holder 40. The internal contact portion 122*b* is located within the developing holder 40 to be opposed to the antenna rod 9*h*.

As shown in FIG. 26, in the toner detecting contact 122, bent portions 122*c*1 of a attachment base 122*c* are fitted onto a peg 40*h* protruded inwardly from the side plate 40*a* of the developing holder 40, so that the attachment base 122*c* is contacted with the side plate 40*a*. Further, a rising portion 122*d* is obliquely bent from the attachment base 122*c* and the internal contact portion 122*b* is formed on a free end portion of the rising portion 122*d* in parallel with the side plate 40*a*. Further, an insertion portion 122*e* bent outwardly from the attachment base 122*c* at a right angle extends outwardly along one edge of a first rectangular hole 40*c* formed in the side plate 40*a*. A free end portion of the insertion portion is bent at a right angle in a direction opposite to the internal contact portion 122*b* to define the external contact portion 122*a*. The external contact portion 122*a* is recessed by a distance substantially the same as a plate thickness of the external contact portion 122*a* to be contacted with a bottom of a recessed portion 40*i* provided in the side plate 40*a* (FIG. 25). As result, the outer surface of the external contact portion 122*a* becomes substantially flush with the outer surface 40*a*1 of the side plate 40*a*. Furthermore, a free end portion 122*f* of the external contact portion 122*a* extends through a second rectangular hole 40*j* of the side plate 40*a* to reach the inside of the side plate 40*a*. And, the free end portion 122*f* is fitted onto a peg 40*k* protruded inwardly in the second hole 40*j*. The toner detecting contact 122 is attached to the developing holder 40 in this way.

As shown in FIG. 25, a width L2 of the first hole 40*c* of the side plate 40*a* is greater than both a distance L1 between the inner surface of the attachment base 122*c* of the toner detecting contact 122 and the surface of the internal contact portion 122*b* and a height L3 of the free end portion 122*f*, and a distance between a top surface of the peg 40*k* within the second hole 40*j* and a surface of the hole 40*j* opposed to the peg 40*k* is sufficient to pass the end portion 122*f* of the toner detecting contact 122.

Regarding the attaching of the toner detecting contact 122, first of all, the free end portion 122*f* is inserted into the first hole 40*c* from inside of the developing holder 40, and then, the free end portion 122*f* is rotated in a clockwise direction in FIG. 25 to fit the free end portion 122*f* onto the peg 40*k* in the second hole. Then, the hole 122*c*2 of the attachment base 122*c* is fitted onto the peg 40*h*. On the other hand, the free end portion 122*f* rides over the peg 40*k* by its own elasticity, so that the hole of the free end portion 122*f* is fitted onto the peg 40*k* up to its bottom.

(Attaching the developing bias contact)

Next, the developing bias contact 121 will be explained.

As shown in FIGS. 23 and 24, the developing bias contact 121 is attached to the inside of the developing holder 40 and is constituted by a leaf spring portion 121*a*, an internal contact portion 121*b* bent from the leaf spring portion 121*a*, and an external contact portion 121*c* bent from the internal contact portion 121*b* and located on the outer surface of the side plate 40*a*. In the condition that the developing holder 40 is attached to the developing frame body 12, the leaf spring portion 121*a* elastically abuts against a bent portion 9*d*1*a* (FIG. 27) of the metal plate of the developing blade 9*d*, thereby maintaining the potential of the metal plate 9*d*1 to be substantially equal to the potential of the developing roller 9*c*. Further, the internal contact portion 121*b* is disposed around a boss 40*f* in which the hole 40*e* is formed to elastically abut against a developing coil spring contact 91 (FIG. 27) fitted onto the boss 40*f* (with abutment pressure of about 100 to 300 grams). Further, a sliding portion of the internal contact portion 121*b* slidingly contacted with the developing coil spring contact 91 may be coated by conductive grease, if necessary. The external contact portion 121*c* is provided in a recess of the side plate 40*a* and is substantially in flush with the outer surface 40*a*1 of the side plate 40*a*. In the condition that the process cartridge B is mounted to the main body 14 of the apparatus, the external contact portion 121*c* abuts against a developing bias contact member 125 (FIGS. 19A and 19B) of the main body 14 of the apparatus to receive developing bias applied from the main body 14 of the apparatus to the developing roller 9*c*. The developing bias received from the main body 14 of the apparatus is applied to the developing roller 9*c* through the developing bias contact 121 and the developing coil spring contact 91.

In the condition that the developing holder 40 is attached to the developing frame body 12, the toner detecting contact 122 is electrically connected to the antenna rod 9*h* by the fact that the internal contact portion (leaf spring) 122*b* abuts against the "laid U-shaped" end 9*h*1 of the antenna rod 9*h* shown in FIG. 29. Incidentally, abutment pressure between the antenna rod 9*h* and the internal contact portion 122*b* is about 100 grams. In the condition that the process cartridge B is mounted to the main body 14 of the apparatus, the external contact portion 122*a* provided on the outer surface 40*a*1 of the developing holder 40 is electrically connected to a toner detecting contact member 126 of the main body 14 of the apparatus. Thus, an electrical signal corresponding to electrostatic capacity varied with the change in the toner amount existing between the developing roller 9*c* and the antenna rod 9*h* is transmitted to the toner detecting contact member 126 through the antenna rod 9*h* and the toner detecting contact 122. When the electrical signal transmitted to the toner detecting contact member 126 reaches a predetermined value is detected by a controller (not shown), exchange of the process cartridge B is alarmed to the operator. Further, tip ends of the pegs 12*e*, 12*f*, 12*g* as gear shafts for the idler gears (9*q*, 9*r*, 9*t*) shown in FIG. 29 fitted into three fitting holes 40*g* of the developing holder 40, as mentioned above. An end face of the boss 40*m* provided on the developing holder 40 is slidably contacted with the agitating gear 9*n* to prevent outward movement of the agitating gear 9*n*.

As mentioned above, since the single member (developing holder) has various functions, the assembling ability is enhanced, thereby reducing cost.

Further, according to the illustrated embodiment, the developing holder 40 is formed to include the longitudinal guide 12*a*, magnet 9*g* attaching portion (hole 40*e*), developing bias contact 121 attaching portion (boss 40*f* and the like), toner detecting contact 122 attaching portion (peg 40*h*, first hole 40*c*, second hole 40*j*, recess 40*i* and the like), boss 40*m*, pins 40*d* and holes 40*g*, 40. The developing holder 41 is formed to include the longitudinal guide 12*a* and the like. According to the illustrated embodiment, the developing holders 40, 41 are molded by the same resin as that of the developing frame body 12, respectively.

The developing holders 40, 41 are positioned by inserting the pins 40*d* of the developing holders 40, 41 into the holes 12*p* of the developing frame body 12. Then, by threading small screws (not shown) into female threaded holes (in the developing frame body 12) through threaded holes 40*l* (in the developing holders 40, 41), the developing holders 40, 41 are secured to the developing frame body 12.

(Construction of the lower surface of the Cleaning frame)

Figure 35:
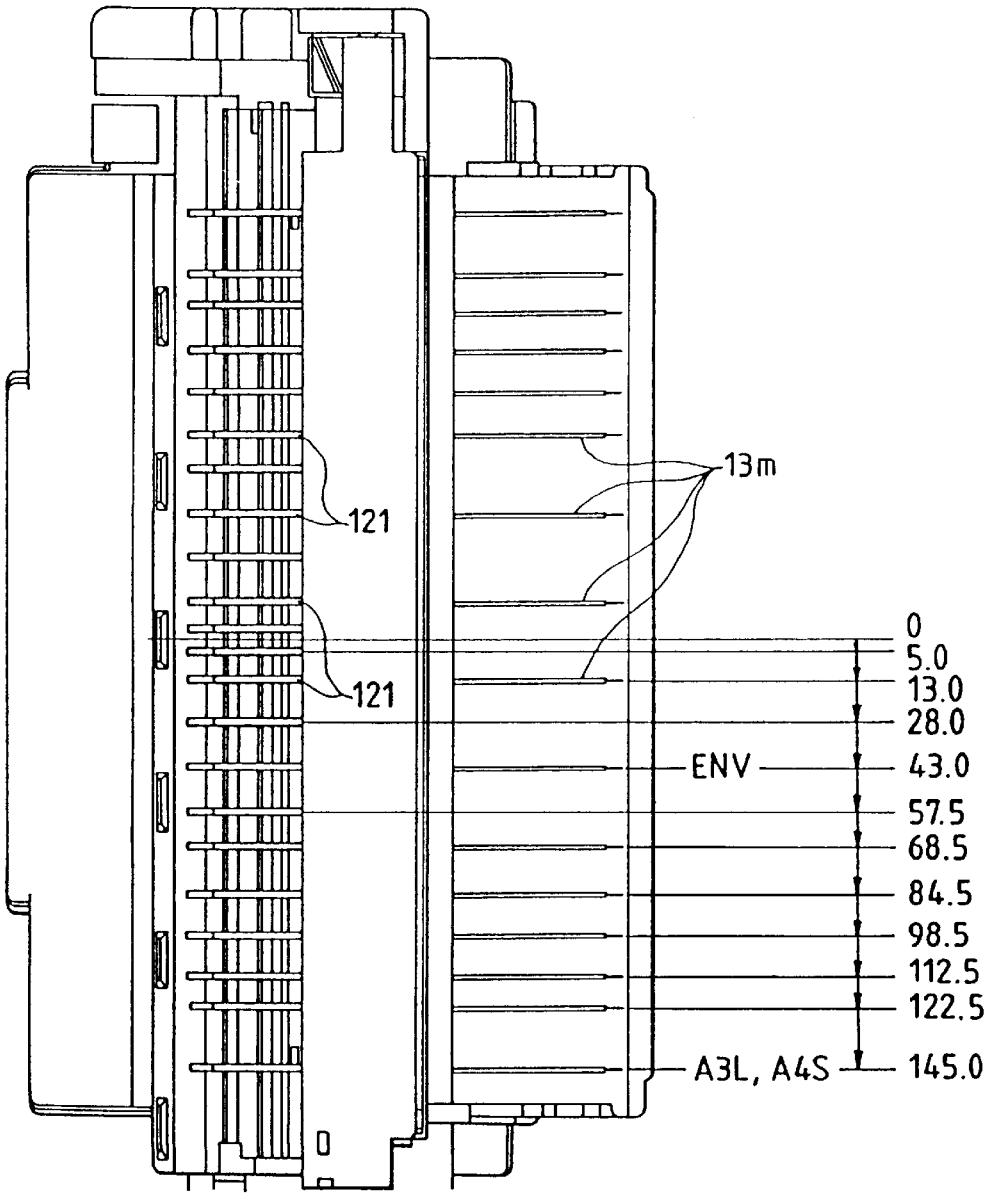
FIG. 35 is a bottom view of the process cartridge.

As shown in FIGS. 8 and 35, the developing frame body 12 is provided at its lower surface with the guide ribs 12*l* and the cleaning frame body 13 is provided at its lower surface with the guide ribs 13*m*, which ribs 12*l*, 13*m* are constituted by ridges extending along the shifting direction of the recording medium 2. The guide ribs 12*l*, 13*m* are situated slightly inside (about 5 mm in the illustrated embodiment) of both longitudinal ends of the recording medium 2. Additional guide ribs for aiding the conveyance of the recording medium are provided at other positions. The electrophotographic image forming apparatus A according to the illustrated embodiment can form an image on recording media 2 having various sizes and can convey any recording medium 2 to pass the recording medium through a central portion of the image forming apparatus (center line CL of the apparatus coincides with the center of the recording medium 2). To this end, the developing frame body 12 and the cleaning frame body 13 are provided at their lower surfaces with plural ribs which are symmetrical with respect to a center line C1. Heights of ribs in the developing frame body 12 are the same and heights of ribs in the cleaning frame body 13 are also the same to convey the recording medium advantageously. With this arrangement, a nonfixed toner image is prevented from being contacted with the lower surface of the cleaning frame body 13 to prevent distortion of the image, while improving the conveyance of the recording medium.

FIG. 35 shows various dimensions from the center line CL as numerical values (unit: mm), as an example of the illustrated embodiment (only one side). The standard paper codes of the recording material 2 corresponding to the numerals (Japanese Industrial Standards) are shown. For example, A3L indicates a case where a longitudinal direction of a recording medium having A3 size becomes a conveying direction, and A4S indicates a case where a widthwise direction of a recording medium having A4 size becomes a conveying direction. Further, ENV corresponds to a recording medium 2 having an envelope size and EXE corresponds to a recording medium 2 having exesize. Incidentally, the guide ribs 12*l* or (and) 13*m* disposed at distances of 5.0 mm, 13.0 mm and 28.0 mm from the center line CL support a central area of the recording medium 2.

Incidentally, unlike the aforementioned embodiment, in this embodiment, the guide ribs 13*m* have heights gradually increasing toward outside, and the each pair of ribs 13*m* corresponding to each recording medium have the same height. With this arrangement, the inner ribs can surely be prevented from contacting with the imaged surface of the recording medium, thereby avoiding the distortion of the image positively. Also in this case, the disposition of the ribs is the same as the case where the ribs have the same height.

(Construction of the electrical contact)

Next, connection and arrangement of contacts for electrically interconnecting the process cartridge B and the laser beam printer A when the process cartridge is mounted to the main body 14 of the printer will be explained with reference to FIGS. 5, 8 and 19A and 19B.

As shown, the process cartridge B has a plurality of contacts. That is to say, there are provided (1) a conductive grounding contact 119 electrically connected to the photosensitive drum 7 to ground the photosensitive drum 7 with respect to the main body 14 of the apparatus, (2) a conductive charge bias contact 120 electrically connected to the charge roller shaft 8*a* to apply the charge bias to the charge roller 8 from the main body 14 of the apparatus, (3) a conductive developing bias contact 121 electrically connected to the developing roller 9*c* to apply the developing bias to the developing roller 9*c* from the main body 14 of the apparatus, and (4) a conductive toner remaining amount detecting contact 122 electrically connected to the antenna rod 9*h* to detect the remaining amount of toner, which conductive contacts 119 to 122 are exposed from the side surface (right side surface) of the cartridge frame. All of four contacts 119 to 122 are disposed on the same side surface of the cartridge frame at distances that electrical leakage does not occur between the contacts. Incidentally, as mentioned above, the grounding contact 119 and the charge bias contact 120 are provided on the cleaning frame body 13, and the developing bias contact 121 and the toner remaining amount detecting contact 122 are provided on the developing frame body 12 (developing holder 40). Further, the toner remaining amount detecting contact 122 also acts as a process cartridge presence/absence detecting contact by which the main body 14 of the apparatus can detect the fact that the process cartridge B is mounted to the main body 14 of the apparatus.

The grounding contact 119 is formed by making the drum shaft 7*a* of the photosensitive drum 7 by conductive material or by insert-molding conductive material in resin. In the illustrated embodiment, the drum shaft 7*a* is made of iron. The other contacts 120, 121, 122 are formed by wiring conductive materials (for example, stainless steel or bronze phosphide) each having a thickness of about 0.1 to 0.3 mm from the inside of the process cartridge B. The charge bias contact 120 is exposed from the driving side (one side end C1) of the cleaning unit C, and the developing bias contact 121 and the toner remaining amount detecting contact 122 are exposed from the driving side (one side end D1) of the developing unit D.

A further detailed explanation is continued.

Figure 20:
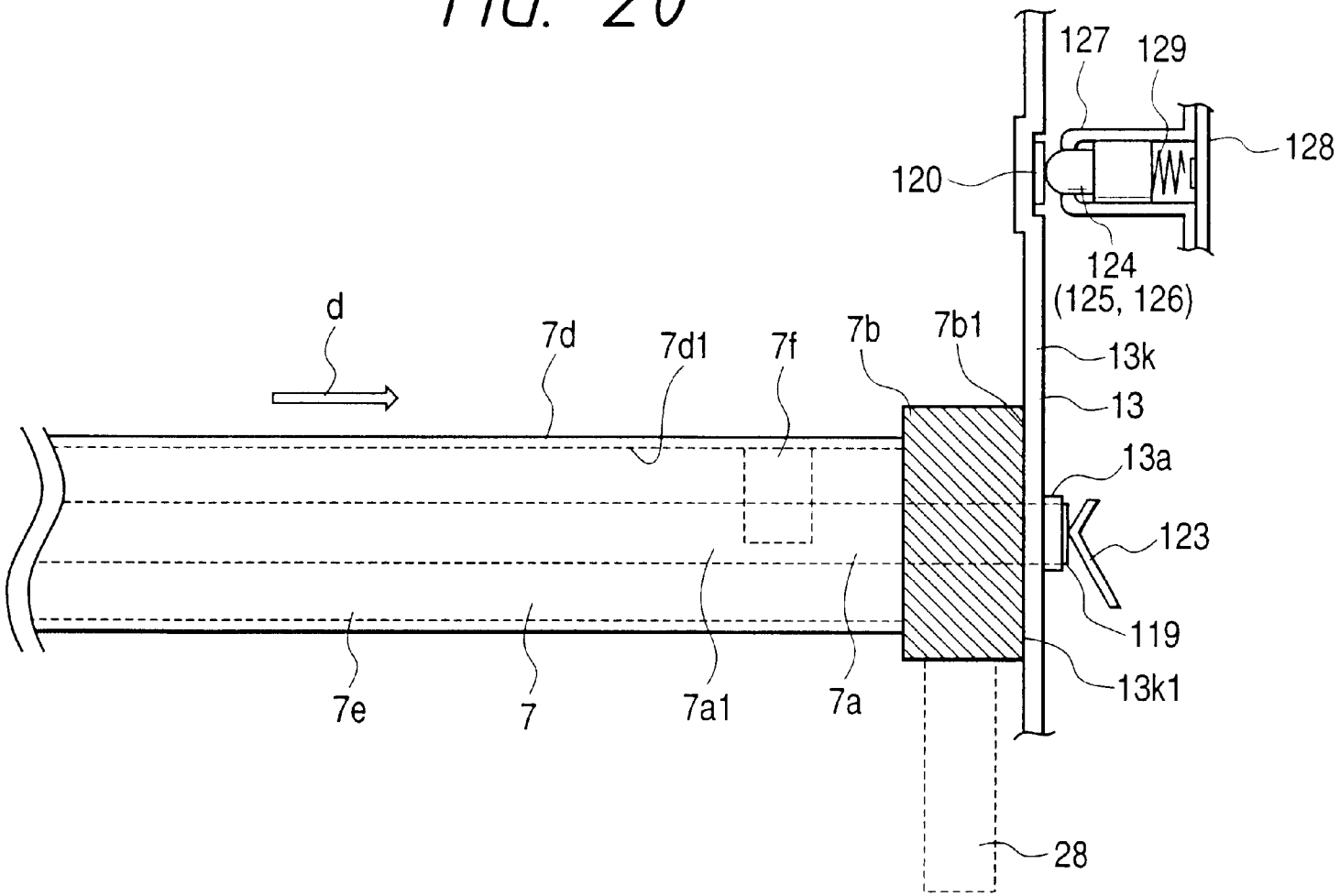
FIG. 20 is a plan view showing a condition that contacts are connected to contact members.

As mentioned above, in the illustrated embodiment, as shown in FIG. 20, the helical drum gear 7*b* is provided on one axial end of the photosensitive drum 7. The drum gear 7*b* is meshed with the drive helical gear 28 of the main body 14 of the apparatus to rotate the photosensitive drum 7. The drum gear 7*b* generates a thrust force (directing toward a direction shown by the arrow d in FIG. 20) during its rotation, thereby tending to bias the photosensitive drum 7 having longitudinal play with respect to the cleaning frame body 13 toward the side at which the drum gear 7*b* exists. As a result, an end 7*b*1 of the drum gear 7*b* abuts against an inner surface 13*k*1 of a side surface 13*k* of the cleaning frame body 13. In this way, the axial position of the photosensitive drum 7 is regulated within the process cartridge B. The grounding contact 119 and the charge bias contact 120 are exposed from the side surface 13*k* of the cleaning frame body 13. The grounding contact 119 (end of the drum shaft 7*a*) is slightly (about 0.8 mm) protruded outwardly from the cylindrical guide 13*a*. The drum shaft 7*a* passes through a drum barrel 7*d* (made of aluminum in the illustrated embodiment) coated by a photosensitive layer 7*e* and has both ends supported by both sides C1, C2 of the cleaning frame body 13 via the cylindrical guides 13*a*. The drum barrel 7*d* is electrically connected to the drum shaft 7*a* by a grounding plate 7*f* contacted with an inner surface 7*d*1 of the drum barrel 7*d* and an outer surface 7*a*1 of the drum shaft 7*a*.

Further, as shown in FIG. 5, the charge bias contact 120 is disposed in the vicinity of a portion of the cleaning frame body 13 supporting the charge roller 8 substantially immediately above the longitudinal guide 12*a* in the vertical direction (FIG. 9A). The charge bias contact 120 is electrically connected to the charge roller 8 via an electrode 166 (FIG. 63) on a conductive member 120*a*.

Next, the developing bias contact 121 and the toner remaining amount detecting contact 122 will be explained. As shown in FIG. 5, the contacts 121, 122 are provided on one side D1 of the developing unit D at the same side as the left side 13*c* of the cleaning frame body 13. An external contact portion (outwardly exposed portion) 121*c* of the developing bias contact 121 is disposed in the vicinity of a right side end portion of the frame supporting the magnet 9*g* contained in the developing roller 9*c* immediately above the longitudinal guide 12*a*. The developing bias contact 121 is electrically connected to the developing roller 9*c* via the developing coil spring contact 91 electrically communicating with the side end of the developing roller 9*c* (FIG. 9B). Further, the toner detecting contact 122 shown in FIG. 5 is disposed at an upstream side of the longitudinal guide 12*a* in the cartridge mounting direction (shown by the arrow X in FIG. 5). As shown in FIG. 5, the toner detecting contact 122 is disposed at the toner container 11A side of the developing roller 9*c* and is contacted with the antenna rod 9*h* (FIG. 9B) extending along the longitudinal direction of the developing roller 9*c*. As mentioned above, the antenna rod 9*h* is spaced apart from the developing roller 9*c* by the constant distance along the longitudinal direction of the developing roller 9*c*. The electrostatic capacity between the antenna rod 9*h* and the developing roller 9*c* is varied with the amount of toner existing therebetween. Thus, the change in electrostatic capacity is detected by the controller (not shown) of the main body 14 of the apparatus as change in potential, thereby detecting the remaining amount of toner.

The toner remaining amount means a toner amount in which the amount of toner existing between the developing roller 9*c* and the antenna rod 9*h* indicates predetermined electrostatic capacity. In this way, the fact that the remaining amount of toner within the toner container 11A reaches the predetermined amount can be detected. When the controller of the main body 14 of the apparatus detects, through the toner detecting contact 122, the fact that the electrostatic capacity reaches a first predetermined value, it is judged that the remaining amount of toner within the toner container 11A reaches the predetermined amount. When the fact that the electrostatic capacity reaches the first predetermined value is detected, the main body 14 of the apparatus informs the operator of need for exchange of the process cartridge B (for example, lighting of a lamp or sound of a buzzer). When the fact that the electrostatic capacity reaches a second predetermined value smaller than the first predetermined value is detected, the controller detects the fact that the process cartridge B was mounted to the main body 14 of the apparatus. If the fact that the process cartridge B was mounted is not detected, the controller does not start the image formation of the main body 14 of the apparatus.

Incidentally, the fact that the process cartridge B is not mounted may be indicated to the operator (for example, lighting a lamp).

Figure 19A:
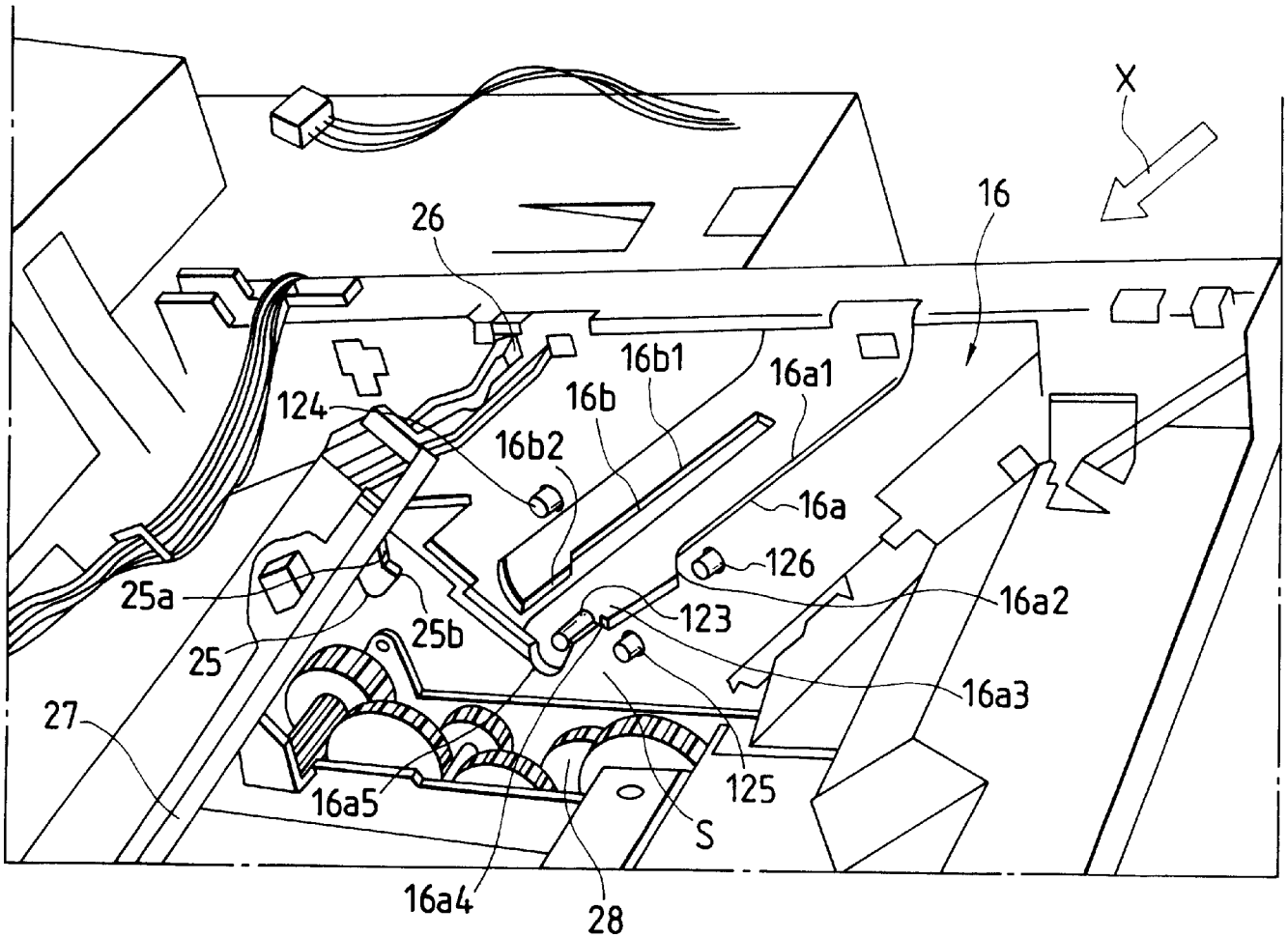
FIG. 19A is a perspective view showing interior of the main body of the apparatus.
Figure 19B:
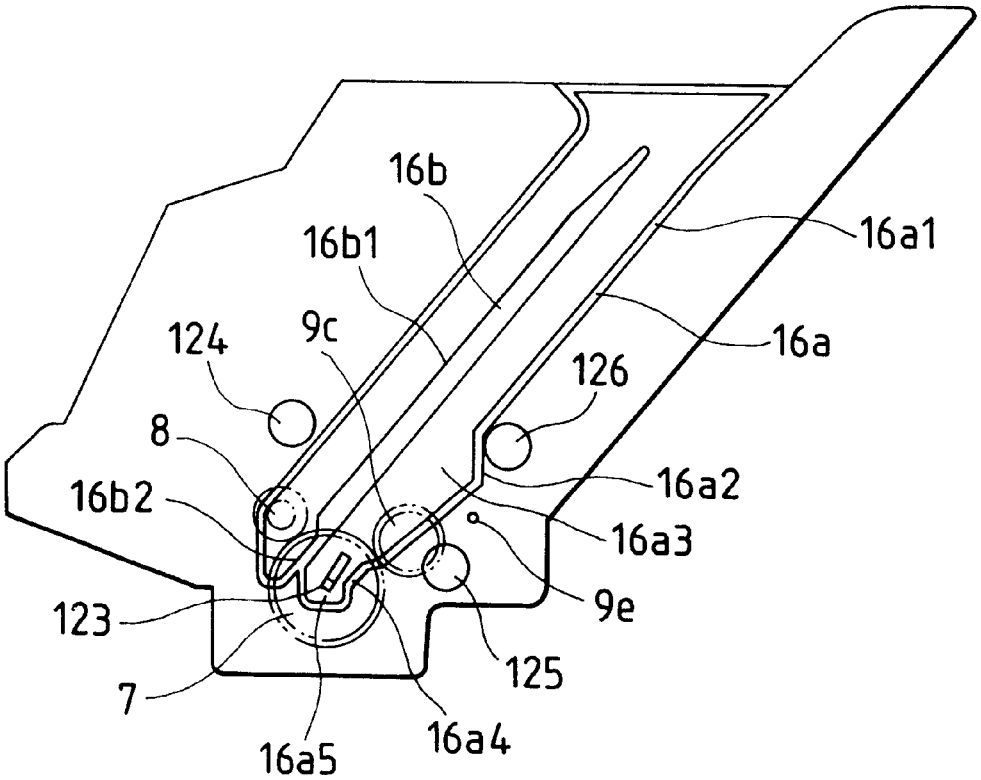
FIG. 19B is a side view showing interior of the main body of the apparatus.

Next, connection between the contacts of the process cartridge B and the contacts of the main body 14 of the apparatus will be described. As shown in FIGS. 19A and 19B, on an inner surface of one side of the cartridge mounting space S of the image forming apparatus A, there are provided four contact members (grounding contact member 123 electrically connected to the grounding contact 119; charge bias contact member 124 electrically connected to the charge bias contact 120; developing bias contact member 125 electrically connected to the developing bias contact 121; and toner detecting contact member 126 electrically connected to the toner detecting contact 122) capable of being connected to the contacts 119 to 122 when the process cartridge B is mounted.

As shown in FIGS. 19A and 19B, the grounding contact member 123 is disposed in correspondence to the positioning groove 16*a*5. The developing bias contact member 125 and the toner detecting contact member 126 are disposed below the first guide portion 16*a*. The charge bias contact member 124 is disposed above the second guide portion 16*b*.

Now, a positional relationship between the contacts and the guides will be explained.

First of all, in FIG. 5, along the vertical direction, on the process cartridge B, the developing bias contact 121 is located at a lowermost part, and the toner detecting contact 122, longitudinal guide 12*a* and cylindrical guide 13*a* (grounding contact 119) are located above the developing bias contact at substantially the same level, and the widthwise guide 13*b* and charge bias contact 120 are located above the toner detecting contact and the like. Further, in the cartridge mounting direction (shown by the arrow X), the toner detecting contact 122 is disposed at a most upstream side, and the longitudinal guide 12*a* is disposed at a downstream side of the toner detecting contact, and the charge bias contact 120 and developing bias contact 121 are disposed at a downstream side of the longitudinal guide 12*a* in an overlapped relationship to the longitudinal guide 12*a*. The widthwise guide 13*b* and cylindrical guide 13*a* (grounding contact 119) are disposed at a further downstream side. With this arrangement, the charge bias contact 120 can be arranged near the charge roller 8, the developing bias contact 121 can be arranged near the developing roller 9*c*, the toner detecting contact 122 can be arranged near the antenna rod 9*h* and the grounding contact 119 can be arranged near the photosensitive drum 7. In this way, wiring of electrodes can be omitted and distance between the contacts can be shortened.

The sizes of the contact areas between the contacts and the contact members are as follows. First of all, the charge bias contact 120 has a length of about 10.0 mm and a width of about 10.0 mm (allowable range: 8.0 mm to 12 mm), the developing bias contact 121 has a length of about 9.0 mm (allowable range: 6.0 mm to 12 mm) and a width of about 8.0 mm (allowable range: 5.0 mm to 11 mm), the toner detecting contact 122 has a length of about 8.0 mm (allowable range: 6.0 mm to 10 mm) and a width of about 9.0 mm (allowable range: 7.0 mm to 11 mm), and the grounding contact 119 is a cylinder having an outer diameter of about 7.0 mm. The charge bias contact 120, developing bias contact 121 and toner detecting contact 122 are rectangular.

As shown in FIG. 20, the grounding contact member 123 is formed from a conductive leaf spring member. The grounding contact member 123 (FIGS. 19A and 19B) is attached in the positioning groove 16*a*5 into which the cylindrical guide 13*a* (for positioning the drum shaft 7*a*) of the photosensitive drum 7 to which the process cartridge grounding contact 119 is attached is fitted. The grounding contact member is grounded via a chassis of the main body 14 of the apparatus. Each of the other contact members 124, 125, 126 is protruded from a holder 127 by a compression coil spring 129. Such an arrangement will be described regarding the charge bias contact member 124 as an example. As shown in FIG. 20, the charge bias contact member 124 is attached within the holder 127 not to be dislodged and can be protruded from the holder, and the holder 127 is secured to an electrical substrate 128 attached to the side surface of the main body 14 of the apparatus, and the contact members and wiring patterns are electrically interconnected via the compression coil springs 129.

Next, a condition that the various contacts of the process cartridge are contacted with the respective contact members of the image forming apparatus when the process cartridge B is mounted to the image forming apparatus A will be explained with reference to FIG. 21, regarding the charge bias contact 120 as an example. Incidentally, FIG. 21 is an explanatory view showing a condition of the process cartridge B when it is mounted to the image forming apparatus A. The arrow H indicates a relative path of the charge bias contact member 124 of the main body of the apparatus with respect to the process cartridge B when the process cartridge B is mounted to the image forming apparatus A. FIG. 21 is a sectional view taken along the line XXI—XXI in FIG. 5.

Figures 21A, 21B, 21C:
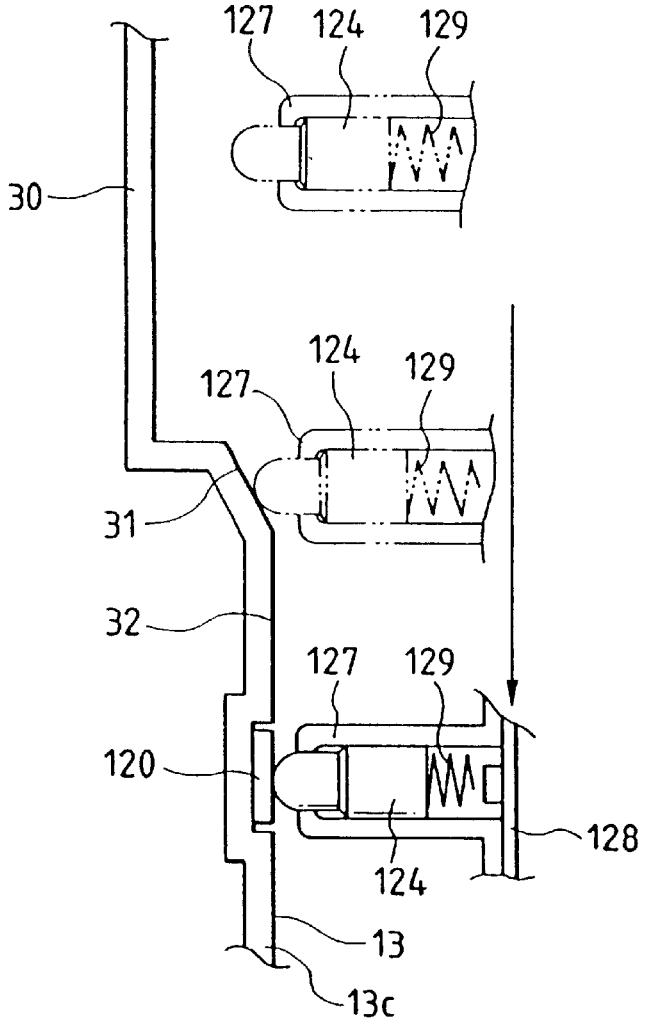
FIGS. 21A, 21B and 21C are sectional views taken along line XXI—XXI of FIG. 5 showing a condition that contacts are connected to contact members.

When the process cartridge B is inserted into the image forming apparatus A and is guided by the guide portions 16*a*, 16*b*, the charge bias contact member 124 is in a condition shown in FIG. 21A before the process cartridge reaches the predetermined mounting position. In this case, the charge bias contact member 124 is not yet contacted with a flat surface 30 of the cleaning frame body 13. When the process cartridge B is further inserted, the charge bias contact member 124 reaches a position shown in FIG. 21B. Here, the charge bias contact member is contacted with an inclined surface 31 formed on the right side end 13*c* of the cleaning frame body 13. When the contact member 124 is pushed along the inclined surface 31, the compression coil spring 129 is gradually flexed, so that the contact member 124 smoothly reaches a flat surface 32 from which the charge bias contact 120 is exposed. When the process cartridge B is inserted up to the mounting position, the contact member 124 reaches a position shown in FIG. 21C and is contacted with the charge bias contact 120. Similarly, the other two contact members 125, 126 are contacted with the contacts 121, 122.

In this way, in the illustrated embodiment, when the process cartridge B is guided by the guide members 16 and reaches the predetermined mounting position, the contacts are positively contacted with the respective contact members.

When the process cartridge B is mounted to the predetermined position, the leaf spring-shaped grounding contact member 123 is contacted with the grounding contact 119 protruded from the cylindrical guide 13*a* (FIG. 20). When the process cartridge B is mounted to the main body 14 of the apparatus, the grounding contact 119 and the grounding contact member 123 are electrically interconnected, thereby grounding the photosensitive drum 7. Further, the charge bias contact 120 and the charge bias contact member 124 are electrically interconnected, thereby applying high voltage (AC voltage overlapped with DC voltage) to the charge roller 8. Further, the developing bias contact 121 and the developing bias contact member 125 are electrically interconnected, thereby applying a high voltage to the developing roller 9*c*. Further, the toner detecting contact 122 and the toner detecting contact member 126 are electrically interconnected, thereby transmitting information corresponding to the electrostatic capacity between the developing roller 9*c* and the antenna rod 9*h* to the main body 14 of the apparatus.

Next, a case where the photosensitive drum 7 is rotated by driving the image forming apparatus A will be explained. When the process cartridge B is mounted to the image forming apparatus A, in order to facilitate the insertion of the cartridge, thrust play of about 2 to 3 mm with respect to the axial direction of the photosensitive drum 7 is provided. To this end, the protruding amount of the charge bias contact member 124 and the like must be greater than such play. In the illustrated embodiment, as shown in FIG. 18, there is provided a leaf spring 45 for biasing the process cartridge B toward one side (at which the contact members 123 to 126 are provided) of the main body 14 of the apparatus when the process cartridge B is mounted. The leaf spring 45 is disposed above the first guide portion 16*a* opposite to the side at which the various contact members are provided.

Further, as is in the illustrated embodiment, when the contacts 119 to 122 of the process cartridge B are provided at the side (driving side) at which the helical drum gear 7*b* is provided, the drive connection between the helical drum gear 7*b* and the main body 14 of the apparatus and the electrical connection between the contacts 119 to 122 and the contact members of the main body 14 of the apparatus can be achieved at the same side of the process cartridge B. When said side is selected as a reference of the process cartridge B, the accumulated error of dimensions becomes smaller, so that accuracy of the attaching portions of the contacts 119 to 122 and accuracy of the attaching position of the helical drum gear 7*b* can be improved. Further, as is in the aforementioned embodiment, when a twist direction of the helical drum gear 7*b* is selected so that a thrust force directing toward the side at which the helical drum gear 7*b* is provided is generated, the positioning of the photosensitive drum 7 in the axial direction can be effected at the side at which the contacts are provided. In this case, in addition to the above-mentioned advantage, the accuracy of the positional relationship between the photosensitive drum 7 and the photosensitive drum 7 can also be improved. Further, as is in the aforementioned embodiment, in a case where the lever 23 (FIG. 6) for opening and closing the drum shutter member 18 is provided at the side opposite to the side at which the contacts 119 to 122 are provided, when the process cartridge B is mounted to the image forming apparatus A, sliding resistance of the contacts 119 to 122 and resistance acting on the lever 23 when the drum shutter member 18 is opened and closed are dispersed toward both longitudinal ends of the process cartridge B. Thus, the insertion resistance can be made uniform in the longitudinal direction, so that the process cartridge B can smoothly be inserted.

Further, as is in the aforementioned embodiment, when all of the contacts of the process cartridge B are disposed on one side surface of the cartridge frame and further when the process cartridge B is elastically biased by the leaf spring 45, the electrical contacts can be electrically stably connected to the contact members of the main body 14 of the apparatus.

Figure 22:
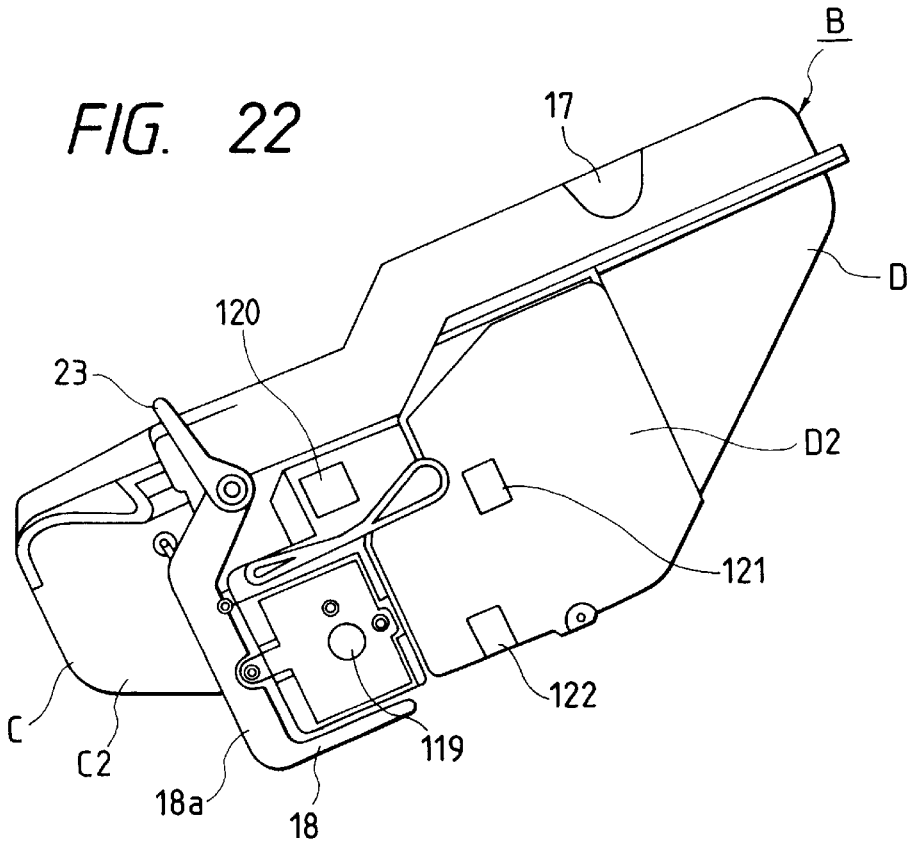
FIG. 22 is a side view of a process cartridge to which an embodiment of the present invention is applied.

Incidentally, FIG. 22 shows an example that the contacts 119 to 122 are provided at the side at which the shutter lever 23 is provided. Also in this arrangement, adequate effect can be achieved.

In the above-mentioned embodiments, while an example that the process cartridge B is used for forming a monochromatic image was explained, the process cartridge according to the present invention can advantageously be applied to a process cartridge which has a plurality of developing means to form a plural-color image (for example, two-color image, three-color image or full-color image).

The electrophotographic photosensitive body is not limited to the photosensitive drum 7, but, for example, the followings may be included. A photoconductive body may be used as the photosensitive body, and the photoconductive body may be, for example, amorphous silicone, amorphous selenium, zinc oxide, titanium oxide or organic photoconductor (OPC). Further, the configuration on which the photosensitive body is mounted may be a drum or a belt, and, in the drum-type photosensitive body, the photoconductor may be deposited or coated on a cylinder made of aluminium alloy.

The developing method may be a conventional two-component magnet brush developing method, cascade developing method, touch-down developing method or cloud developing method.

In the first embodiment, while an example that the charging means is of so-called contact charging type was explained, as another arrangement, a conventional charging arrangement in which a three-wall formed from tungsten wires is coated by a metal shield and a surface of a photosensitive drum is uniformly charged by shifting positive or negative ions generated by applying high voltage to the tungsten wires toward the surface of the photosensitive drum may be used.

The charging means may be of blade (charging blade) type pad type, block type, rod type or wire type, as well as the aforementioned roller type.

Regarding the method for cleaning the residual toner remaining on the photosensitive drum, a cleaning means may be constituted by using a blade, a fur brush or a magnet brush.

As mentioned above, since all of the plurality of contacts of the process cartridge are provided on one side surface of the cartridge frame, by positioning the process cartridge by biasing the process cartridge toward the side at which the electrical contacts are provided by the elastic means, the process cartridge can be electrically connected to the image forming apparatus stably.

Alternatively, by providing the helical drum gear and the electrical contacts at the side biased toward the photosensitive body by the rotation of the helical drum gear caused by the driving force transmitted from the helical drum gear to the photosensitive body, the electrical connection and the drive connection of the process cartridge with respect to the image forming apparatus can be effected more positively.

Alternatively, by arranging the various contacts as mentioned above, the wiring of electrodes for the contacts within the process cartridge can be shortened.

Alternatively, since the electrical substrate of the main body of the apparatus to be connected to the electrical contacts can be installed vertically on the side surface of the apparatus, the entire apparatus can be made more compact.

What is claimed is:

1. A developing apparatus comprises:

a developer bearing member for bearing and conveying developer to a developing position;

a developer regulating member for regulating a thickness of the developer borne on said developer bearing member, and voltage being allowed to be applied to said developer regulating member;

a magnetic seal member opposed to an end in a longitudinal direction of said developer bearing member; and an elastic member for urging said magnetic seal member against said developer regulating member to establish electrical connection between said developer regulating member and said magnetic seal member.

2. A developing apparatus according to claim 1, further comprising a developing container, wherein said developer bearing member is provided at an opening portion of said developing container and said elastic member is disposed between said magnetic seal member and said developing container.

3. A developing apparatus according to claim 1, wherein said elastic member is electrically connected with said developer regulating member via a route different from said magnetic seal member.

4. A developing apparatus according to claim 3, further comprising an electrical conductive portion for electrically connecting said elastic member with said developer regulating member in the route.

5. A developing apparatus according to claim 1, wherein said developer bearing member and said developer regulating member are electrically connected to each other.

6. A developing apparatus according to claim 1, further comprising a developing container, wherein said developer bearing member is provided at an opening portion of said developing container, and a positioning portion of said magnetic seal member with respect to said developing container includes a protruded portion protruded toward a direction transverse to a longitudinal direction of said developer bearing member.

7. A developing apparatus according to claim 1, wherein said developer regulating member includes an elastic blade for regulating the thickness of the developer borne on said developer bearing member and a support member for supporting said elastic blade, and said elastic member urges said magnetic seal member against said support member.

8. A developing apparatus according to claim 1, wherein said magnetic seal member includes a magnet or a magnetic member.

9. A developing apparatus according to claim 1, wherein said elastic member includes a spring member.

10. A developing apparatus according to claim 1, further comprising a developing container, wherein said developer bearing member is provided at an opening portion of said developing container, and further comprising an elastic seal member disposed between said magnetic seal member and said developing container.

11. A developing apparatus according to any one of claims 1 to 10, wherein the developing apparatus constitutes, together with an image bearing member, a process cartridge detachably attachable to a main body of an image forming apparatus.

12. A developing apparatus according to claim 11, wherein said image bearing member includes an electrophotographic photosensitive body.

13. A method for assembling a developing apparatus including a developer bearing member for bearing and conveying developer to a developing position, a developer regulating member for regulating a thickness of the developer borne on said developer bearing member, a magnetic seal member opposed to an end in a longitudinal direction of said developer bearing member, and a spring member for urging said magnetic seal member against said developer regulating member, said method comprising the steps of:

a first step for attaching said spring member to a magnetic seal member attaching portion;

a second step for attaching said magnetic seal member to said magnetic seal member attaching portion so that said magnetic seal member is provided on said spring member after said first step; and a third step for attaching said developer regulating member to a developer regulating attaching portion by urging said magnetic seal member by means of said developer regulating member in opposition to an elastic force of said spring member, after said second step.

14. A method according to claim 13, wherein said magnetic seal member attaching portion comprises a groove portion provided on a developing container.

15. A method according to claim 13, wherein said developing apparatus further comprises an electrical conductive portion for electrically connecting said elastic member with said developer regulating member in a route different from said magnetic seal member.

16. A developing apparatus comprises:

a developer bearing member for bearing and conveying developer to a developing position;

a developer regulating member for regulating a thickness of the developer borne on said developer bearing member, and a voltage being applied to said developer regulating member;

a magnetic seal member opposed to an end in a longitudinal direction of said developer bearing member; and an elastic member for urging said magnetic seal member against said developer regulating member to establish an electrical connection between said developer regulating member and said magnetic seal member, wherein said elastic member is electrically connected to said developer regulating member in a route different from said magnetic seal member.

17. A developing apparatus according to claim 16, further comprising a developing container, wherein said developer bearing member is provided at an opening portion of said developing container and said elastic member is disposed between said magnetic seal member and said developing container.

18. A developing apparatus according to claim 16, further comprising an electrical conductive portion for electrically connecting said elastic member with said developer regulating member via a route different from said magnetic seal member.

19. A developing apparatus according to claim 16, wherein said developer bearing member and said developer regulating member are electrically connected to each other.

20. A developing apparatus according to claim 16, wherein said developer regulating member includes an elastic blade for regulating a thickness of the developer borne on said developer bearing member and a support member for supporting said elastic blade, and said elastic member urges said magnetic seal member against said support member.

21. A developing apparatus according to claim 16, wherein said elastic member includes a spring member.

22. A developing apparatus according to claim 16, further comprising a developing container, wherein said developer bearing member is provided at an opening portion of said developing container, and an elastic seal member disposed between said magnetic seal member and said developing container.

23. A developing apparatus according to any one of claims 16 to 22, wherein the developing apparatus constitutes, together with an image bearing member, a process cartridge detachably attachable to a main body of an image forming apparatus.

24. A developing apparatus according to claim 23, wherein said image bearing member includes an electrophotographic photosensitive body.

25. A developing apparatus comprising:

a developer bearing member for bearing and conveying developer to a developing position;

a developer regulating member for regulating a thickness of the developer borne on said developer bearing member, and voltage being allowed to be applied to said developer regulating member;

a magnetic seal member opposed to an end in a longitudinal direction of said developer bearing member; and a spring member for urging said magnetic seal member against said developer regulating member to establish electrical connection between said developer regulating member and said magnetic seal member.

26. A developing apparatus according to claim 25, wherein the developing apparatus constitutes, together with an image bearing member, a process cartridge detachably attachable to a main body of an image forming apparatus.

* * * * *

UNITED STATES PATENT AND TRADEMARK OFFICE

CERTIFICATE OF CORRECTION

PATENT NO. : 6,208,817 B1
DATED : March 27, 2001
INVENTOR(S) : Kazuo Chadani et al.

It is certified that error appears in the above-identified patent and that said Letters Patent is hereby corrected as shown below:

Column 8,
Line 11, "width-wise" should read -- widthwise --; and
Line 59, "in" should read -- in the --.

Column 13,
Line 31, "width-wise" should read -- widthwise --.

Column 19,
Line 13, "Z)." should read -- X). --.

Column 22,
Line 49, "width-wise" should read -- widthwise --.

Column 28,
Line 18, "gaps g" should read -- gaps s --.

Column 31,
Line 38, "sub-rollers" should read -- subrollers --.

Column 33,
Line 41, "hole 120)" should read -- hole 120, --.

Column 39,
Line 43, "desrcibed. As" should read -- described. ¶ As --.

Signed and Sealed this

Twenty-second Day of January, 2002

*Attest:*

*Attesting Officer*

JAMES E. ROGAN
*Director of the United States Patent and Trademark Office*